US009353563B2

(12) United States Patent
Bacchetti

(10) Patent No.: US 9,353,563 B2
(45) Date of Patent: May 31, 2016

(54) HINGE DEVICE FOR DOORS, SHUTTERS OR THE LIKE

(71) Applicant: Luciano Bacchetti, Nave (IT)

(72) Inventor: Luciano Bacchetti, Nave (IT)

(73) Assignee: IN & TEC S.R.L., Brescia (IT)

( * ) Notice: Subject to any disclaimer, the term of this patent is extended or adjusted under 35 U.S.C. 154(b) by 0 days.

(21) Appl. No.: 14/542,950

(22) Filed: Nov. 17, 2014

(65) Prior Publication Data

US 2015/0067984 A1 Mar. 12, 2015

Related U.S. Application Data

(63) Continuation of application No. 14/007,571, filed as application No. PCT/IB2012/051707 on Apr. 5, 2012, now Pat. No. 8,898,860.

(30) Foreign Application Priority Data

Apr. 5, 2011 (IT) ..... VI2011A0081
Apr. 19, 2011 (WO) ..... PCT/IB2011/051688

(51) Int. Cl.
*E05F 3/20* (2006.01)
*E05F 1/12* (2006.01)
(Continued)

(52) U.S. Cl.
CPC ..... *E05F 1/1207* (2013.01); *E05D 3/02* (2013.01); *E05D 11/02* (2013.01); *E05D 11/04* (2013.01); *E05D 11/084* (2013.01); *E05D 11/1014* (2013.01); *E05F 1/1223* (2013.01);
(Continued)

(58) Field of Classification Search
CPC . Y10T 16/283; Y10T 16/304; Y10T 16/2771; Y10T 16/5387; E05F 1/066; E05F 1/1008; E05F 1/12; E05F 1/1207; E05F 1/1223; E05F 3/00; E05F 3/04; E05F 3/10; E05F 3/12; E05F 3/20; E05Y 2201/264; E05Y 2201/638; E05Y 2201/21; E05Y 2201/256; E05Y 2900/132
USPC ..... 49/381, 384, 386, 397, 236, 237, 238, 49/398, 399; 16/54, 50, 313–314, 352, 16/318, 330, 303, 310
See application file for complete search history.

(56) References Cited

U.S. PATENT DOCUMENTS 424,614 A 4/1890 Morris
1,200,538 A * 10/1916 Smith et al. ..... 16/303
(Continued)

FOREIGN PATENT DOCUMENTS

EP 0255781 A2 2/1988
FR 2751020 A1 1/1998
(Continued)

*Primary Examiner* — Chuck Mah
(74) *Attorney, Agent, or Firm* — Themis Law

(57) ABSTRACT

A hinge device for rotatably moving a closing element includes a fixed element anchorable to a stationary support structure coupled to a movable element anchorable to the closing element for rotating around a first longitudinal axis between an open position and a closed position. The device further includes at least one slider movable along a second axis between a compressed and an extended position. One between the movable element and the fixed element includes at least one operating chamber defining the second axis so as to slidably house the slider, the other element including a pivot defining the first axis. The pivot and the slider are reciprocally coupled so that to the rotation of the movable element around the first axis corresponds the sliding of the slider along the second axis and vice versa.

20 Claims, 42 Drawing Sheets

(51) Int. Cl.

| | |
|---|---|
| ***E05D 11/08*** | (2006.01) |
| ***E05D 3/02*** | (2006.01) |
| ***E05D 11/02*** | (2006.01) |
| ***E05D 11/10*** | (2006.01) |
| ***E05D 11/04*** | (2006.01) |
| *E05D 7/12* | (2006.01) |
| *E05D 5/10* | (2006.01) |
| *E05F 3/12* | (2006.01) |

(52) U.S. Cl.

CPC .. *E05F 3/20* (2013.01); *E05D 7/12* (2013.01); *E05D 2005/108* (2013.01); *E05F 3/12* (2013.01); *E05Y 2201/21* (2013.01); *E05Y 2201/256* (2013.01); *E05Y 2201/264* (2013.01); *E05Y 2201/638* (2013.01); *E05Y 2800/00* (2013.01); *E05Y 2900/132* (2013.01); *Y10T 16/2766* (2015.01); *Y10T 16/2771* (2015.01); *Y10T 16/304* (2015.01); *Y10T 16/537* (2015.01); *Y10T 16/5373* (2015.01); *Y10T 16/5387* (2015.01); *Y10T 16/53888* (2015.01)

(56) References Cited

U.S. PATENT DOCUMENTS

| | | | | | |
|---|---|---|---|---|---|
| 1,281,774 | A | | 10/1918 | Franckaerts et al. | |
| 1,393,889 | A | | 10/1921 | Emile et al. | |
| 1,824,217 | A | | 9/1931 | Friedrich et al. | |
| 2,118,950 | A | * | 5/1938 | Stannard | 16/54 |
| 2,164,358 | A | * | 7/1939 | Stannard | 16/54 |
| 2,222,965 | A | * | 11/1940 | Voelkel | 16/312 |
| 2,456,537 | A | * | 12/1948 | Seaman et al. | 16/54 |
| 4,100,646 | A | * | 7/1978 | Schubeis | 16/54 |
| 4,155,144 | A | * | 5/1979 | Koganei | 16/54 |
| 4,177,567 | A | * | 12/1979 | Limbach et al. | 33/23.11 |
| 4,485,522 | A | * | 12/1984 | Chen | 16/54 |
| 4,788,746 | A | * | 12/1988 | Idler | 16/297 |
| 4,829,628 | A | * | 5/1989 | Vuksic | 16/54 |
| 6,205,619 | B1 | * | 3/2001 | Jang | 16/352 |
| 6,658,694 | B2 | * | 12/2003 | Wang | 16/50 |
| 2004/0068833 | A1 | * | 4/2004 | Sawa | 16/60 |
| 2004/0250377 | A1 | * | 12/2004 | Park | 16/50 |
| 2009/0241289 | A1 | * | 10/2009 | Choi et al. | 16/275 |
| 2010/0319260 | A1 | * | 12/2010 | Sawa | 49/326 |

FOREIGN PATENT DOCUMENTS

| | | | | |
|---|---|---|---|---|
| GB | 401858 | A | | 11/1933 |
| GB | 1019931.3 | | | 10/2011 |
| GB | 2479804 | A | | 10/2011 |
| JP | 09184354 | A | * | 7/1997 |
| KR | 1020060021588 | | | 3/2006 |
| KR | 1020070043283 | | | 4/2007 |
| WO | WO0166894 | A1 | | 9/2001 |
| WO | WO03067011 | A1 | | 8/2003 |
| WO | WO2006025663 | A1 | | 3/2006 |
| WO | WO2008018720 | A1 | | 2/2008 |
| WO | WO2011006477 | A1 | | 1/2011 |
| WO | WO2011055106 | A2 | | 5/2011 |
| WO | WO2011141880 | A1 | | 11/2011 |

* cited by examiner

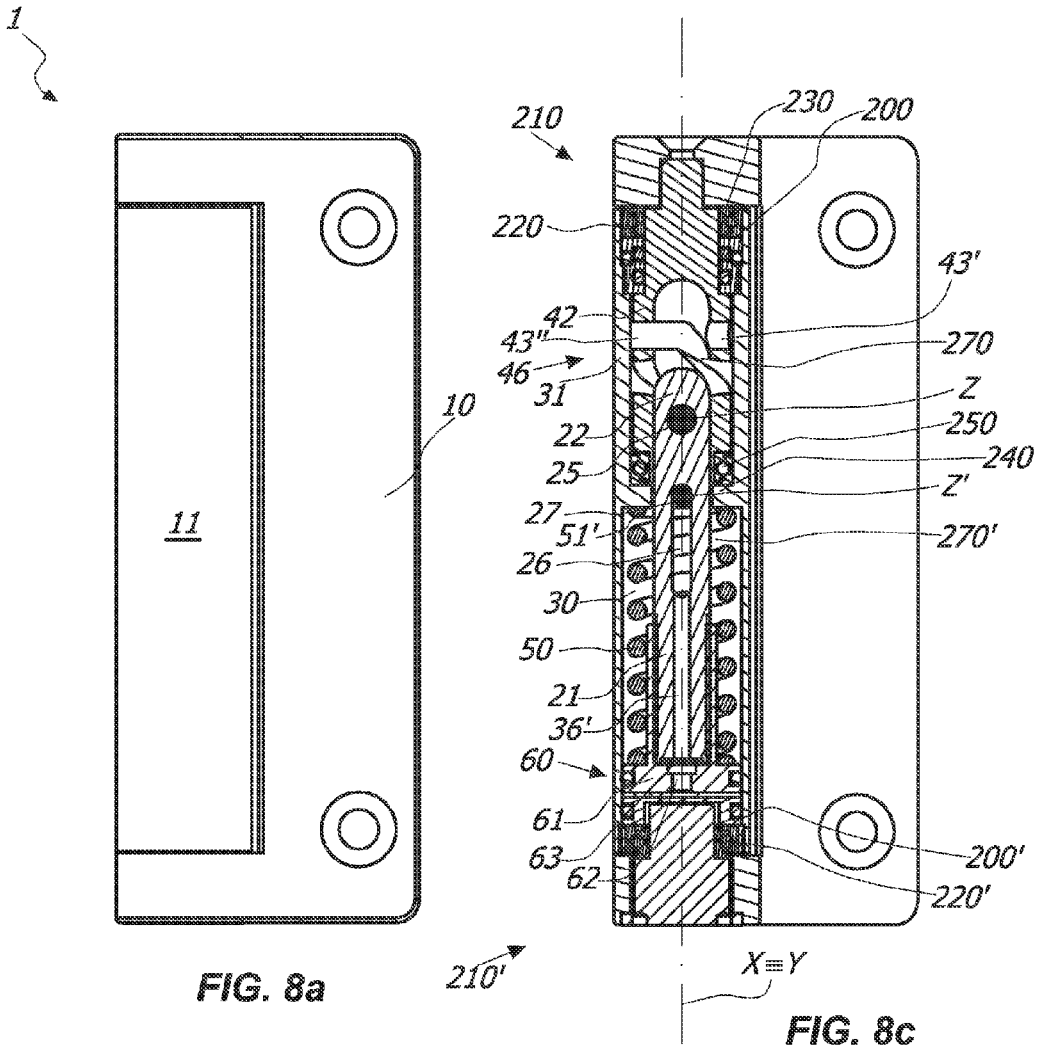
FIG. 8a
FIG. 8c
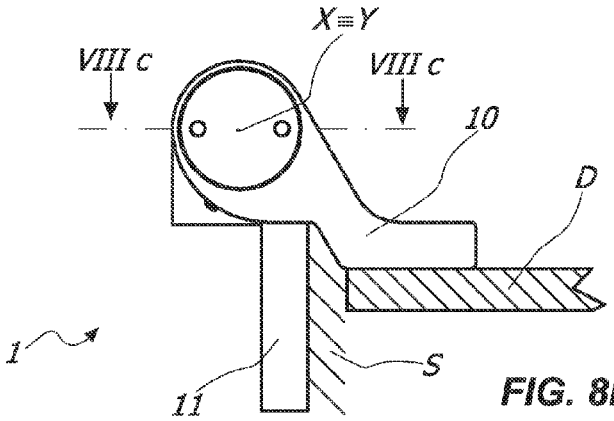
FIG. 8b 110
220
100
42
43'
43"
22
25
24"
24'
39'
250
27
51'
26
39"
21
36'
30
64
63
50
62
61
38
23
80
220'
X≡Y
90
62
63
92
91

120

31
36"

40
46
25
45"
44'
20
61
X≡Y

S
100
D
X≡Y 110
42
22
20
Z≡Z'
60
23
25≡27
21
X≡Y
91
92
90
62
63

110
100
40
220
250
26
25≡27
Z≡Z'
24'
36'
24"
36"
62
63
X≡Y
120
X≡Y
S
D 120
40
22
20
Z≡Z'
60
23
25≡27
21
X≡Y
91
92
90
62
63

50
40
220
250
25≡27
Z≡Z'
24'
26
24"
36'
36"
62
63

HINGE DEVICE FOR DOORS, SHUTTERS OR THE LIKE

FIELD OF THE INVENTION

The present invention generally relates to the technical field of closing hinges, and particularly relates to a hinge device for moving a closing element, such as a door, a shutter, a gate or the like, anchored to a stationary support structure, such as a wall, a frame, a supporting pillar and/or a floor.

BACKGROUND OF THE INVENTION

As it is known, closing hinges generally comprise a movable element, usually fixed to a door, a shutter or the like, pivoted on a fix element, usually fixed to the frame thereof, or to a wall and/or to the floor.

From documents U.S. Pat. No. 7,305,797, US2004/0206007 and EP1997994 hinges are known, in which the action of the closing means that ensure the return of the shutter to the closed position is not counteracted. From document EP0407150 a door closing device is known, which includes hydraulic damping means for counteracting the action of the closing means.

All these prior art devices are more or less bulky, and have therefore an unpleasant visual appeal.

Moreover, they do not provide for an adjustment of the closing speed and/or the latch closing of the door, or in any case they do not allow a simple and quick adjustment.

Further, these prior art devices have a large number of constructive parts, so resulting difficult to manufacture as well as comparatively expensive, and they require a frequent maintenance.

Other prior art hinges are known from documents GB19477, U.S. Pat. No. 1,423,784, GB401858, WO03/067011, US2009/241289, EP0255781, WO2008/50989, EP2241708, CN101705775, GB1516622, US20110041285, WO200713776, WO200636044, WO200625663 and US20040250377.

These known hinges can be improved in terms of bulk, reliability and/or performance.

SUMMARY OF THE INVENTION

A main object of this invention is to overcome, at least in part, the above drawbacks, by providing a hinge device that has high performance, simple construction and low cost properties.

Another object of the invention is to provide a hinge device that has an extremely low bulk.

Another object of the invention is to provide a hinge device which ensures the automatic closing of a door from an open position.

Another object of the invention is to provide a hinge device, which ensures the controlled movement of a door to which it is connected upon its opening as well as upon its closing.

Another object of the invention is to provide a hinge device, which can support even very heavy doors and door or window frame structures, without changing its behavior and without needing adjustments.

Another object of the invention is to provide a hinge device, which has a minimum number of constitutive parts.

Another object of the invention is to provide a hinge device, which can keep the exact closing position in time.

Another object of the invention is to provide an extremely safe hinge device.

Another object of the invention is to provide a hinge device that is extremely easy to install.

Another object of the invention is to provide a hinge device, which can be mounted on closing means that have right as well as left opening sense.

These and other objects, as better explained hereafter, are fulfilled by a hinge device having one or more of the features that are herein described, claimed, and/or shown.

The hinge device may be employed for the rotating movement of a closing element, such as a door, a shutter or the like, which may be anchored to a stationary support structure such as for example a wall and/or the frame of a door or of a window and/or the wall.

Appropriately, the device may include a fixed element anchorable to the stationary support structure and a movable element anchorable to the closing element.

The fixed and the movable elements may be reciprocally coupled to rotate around a first longitudinal axis, which may be substantially vertical, between an open position and a closed position, corresponding to the positions of open and closed closing element.

As used herein, the terms “fixed element” and “movable element” are intended to indicate the one or more parts or components of the hinge device which, respectively, are designed to be fixed and movable during the normal use of the hinge device.

Advantageously, the device may comprise at least one slider slidably movable along a respective second axis between a compressed end position, corresponding to one between the closed and the open position of the movable element, and an extended end position, corresponding to the other between the closed and the open position of the movable element.

In a preferred, non-exclusive embodiment, the at least one slider and the movable element may be mutually coupled so that to the rotation of the movable element around the first axis corresponds to the sliding of the slider along the second axis and vice versa.

The first and the second axis may be reciprocally parallel or coincident. In the last case, the first and the second axis may define a single axis which acts as both rotation axis for the movable element and sliding axis for the slider.

Appropriately, one between the movable and the fix elements may include at least one operating chamber defining the second longitudinal axis to slidably house the at least one slider, whereas the other between the movable element and the fix element may comprise a pivot defining the first rotation axis of the movable element.

Advantageously, the hinge device may include a generally box-like hinge body which may include the at least one operating chamber. The hinge body may have an elongated shape to define the first rotation axis of the movable element and/or the second sliding axis of the slider.

In a preferred, non-exclusive embodiment, the pivot may include an actuating member which cooperates with the at least one slider to allow the rotating movement of the movable element around the first axis.

As used herein, the expression “actuating member” and derivatives thereof is intended to indicate at least one mechanic member which, interacting with another mechanic member, is suitable for moving thereof of any motion and/or in any direction. Therefore, as used herein, the actuating member may be fix or may move of any motion and/or in any direction, provided that it is suitable to allow the rotating movement of the movable element around the first axis.

In another preferred, non-exclusive embodiment, the slider may include the actuating member, which may cooperate with the pivot to allow the rotating movement of the movable element around the first axis.

Appropriately, the at least one slider may be rotatably blocked in the at least one operating chamber, so as to avoid any rotation around the second axis during the sliding thereof between the compressed and extended end positions.

In a preferred, non-exclusive embodiment of the invention, the actuating member may include a cylindrical portion of the pivot or of the at least one slider.

Thanks to such configuration, the hinge device according to the invention allows the rotating movement of the closing element around the first longitudinal axis in a simple and effective way.

The bulkiness and the production costs result extremely moderate. Moreover, thanks to the minimum number of constitutive parts, the average life of the device is maximized, minimizing at the same time the maintenance costs.

Further, thanks to such configuration, the hinge device according to the invention may be indifferently mounted on closing elements having right as well as left opening senses.

In order to ensure the automatic closing of the door once it has been opened, the hinge device according to the invention may further include counteracting elastic means, for example one or more springs or a pneumatic cylinder, acting on the at least one slider to automatically return it from one between said compressed and extended end positions towards the other between said compressed and extended end positions.

On the other side, independently from the presence or not of the counteracting elastic means, the slider of the hinge device according to the invention may include a plunger element movable in the at least one operating chamber along the second axis, the operating chamber including a working fluid, for example oil, acting on the plunger element to hydraulically counteract the action thereof, so as to adjust the rotation of the movable element from the open position to the closed position.

In this last embodiment, if the hinge device also includes the counteracting elastic means it acts as a hydraulic door closer or as a hydraulic hinge with automatic closing wherein the closing action of the counteracting elastic means is hydraulically damped by the working fluid.

If, on the contrary, the hinge device does not include the counteracting elastic means, it acts as an hydraulic brake to hydraulically damp the closing action which may be imparted to the closing element manually or by a further hinge, for example the hinge manufactured according to the teachings of the European patent EP-B1-2019895.

If, on the other hand, the device includes the counteracting elastic means but does not include the working fluid, the device acts as a mechanic door closer or hinge with automatic closing.

In any case, to adjust the closing angle of the closing element, the at least one operating chamber may possibly comprise at least one set screw having a first end interacting with the at least one slider and a second end operable from the outside by a user to adjust the stroke of the slider along the second axis.

Preferably, the at least one operating chamber may include one couple of set screws placed in correspondence of the ends of the hinge body, so as to allow the double adjustment thereof.

Advantageously, one between the pivot and the at least one slider may have at least one groove inclined with respect to the first longitudinal axis, which defines at least partially the actuating member, whereas the other between the at least one slider and the pivot may be mutually coupled with the at least one groove. With this aim, at least one outwardly extending appendix may be provided, to slide in the at least one groove.

Preferably, at least one pair of equal grooves angularly spaced of 180° may be provided, with a respective pair of appendices each outwardly extending to slide in a respective groove.

Appropriately, the appendices may define a third axis substantially parallel to the first and/or to the second axis.

In a particularly preferred but non-exclusive embodiment of the invention, these grooves may be communicating between one another to define a single guide element passing through the pivot or the slider, a first passing through pin being provided which is housed in the single guide element to define the appendices.

In order to ensure the maximum control of the closing element upon the closing as well as upon the opening of the closing element, each appendix may have at least one sliding portion in the respective groove which has an outer diameter substantially equal to the width of the respective groove.

Further, in order to minimize the vertical bulk, each groove may have at least one helical portion wound around the first axis defined by the pivot, which may be right-handed or left-handed.

Advantageously, the at least one helical portion may develop for at least 90° along the cylindrical portion of the pin, preferably for at least 180°, up to 360° and over.

In this manner, the actuating member is defined by a single spiral with two or more starts, with the first pin sliding within it. The first pin and the actuating member, therefore, are connected to one another by means of a helical primary pair wherein the pin translates and rotates during the interaction with the single guide element constituted by the spiral having two starts.

Advantageously, the single guide element may include only one single helical portion having constant slope.

In a first preferred embodiment, the single guide element is closed to both ends so as to define a closed path having two blocking end point for the first pin sliding therethrough. This configuration allows the maximum control of the closing element, both during opening and closing.

In another preferred embodiment the single guide element is closed to only one end so as to define a partly open path having one blocking end point for the first pin sliding therethrough and one open end point.

In order to have optimal vertical bulk, the at least one helical portion may have a pitch comprised between 20 and 100 mm, and preferably comprised between 30 and 80 mm.

As used herein, the expression "pitch" of the helical portion and derivatives thereof is intended to indicate the linear distance in millimeters between the initial point of the helical portion and the point where the helical portion makes a complete rotation of 360°, taken in correspondence of the central point of the helical portion along an axis parallel to the axis around which the helical portion winds.

In order to ensure a blocking point of the closing element along the opening/closing path thereof, each groove may have a flat portion before or after the helical portion, which may develop for at least 10° along the cylindrical portion, up to 180°.

This way, it is possible to block the closing element, for example in its open position.

The blocking points, and therefore the flat portions, may be more than one along the opening/closing path of the closing element.

Advantageously, in order to further minimize the vertical bulks, the pivot and the slider may be telescopically coupled to each other.

Appropriately, one between the pivot and the at least one slider may include a tubular body to internally house at least one portion of the other between the pivot and the at least one slider.

The tubular body may have a cylindrical wall encompassing the portion of the other between the pivot and the at least one slider. The cylindrical wall and the portion of the other between the pivot and the at least one slider may be reciprocally connected to allow the sliding movement of the slider upon the rotation of the tubular body and vice versa.

In a preferred, non-exclusive embodiment of the invention, the pivot may include the tubular body, whereas the elongated body of the at least one slider may include a stem having its first end slidingly inserted in the tubular body, the latter including a cylindrical wall defining the cylindrical portion having the at least one inclined groove.

On the other side, in another preferred, non-exclusive embodiment of the invention, the elongated body of the at least one slider may include the tubular body, whereas the pivot may be housed within the at least one slider, the latter including a first end sliding in the at least one inclined groove of the pivot.

The counteracting elastic means, if present, may be configured to slidingly move along the second axis between a position of maximum and minimum elongation.

In a preferred, non-exclusive embodiment, the counteracting elastic means and the at least one slider may be reciprocally coupled so that the counteracting elastic means are in their position of maximum elongation in correspondence of the extended end position of the slider.

In this embodiment, the counteracting elastic means may be interposed between the cylindrical portion of the pivot and the second end of the at least one slider, which may be opposed to the first end.

This way, upon the opening of the closing element, the counteracting elastic means act on the second end of the at least one slider to return it back to its extended end position, returning at the same time the closing element back to its closed position. With this purpose, the at least one slider may include a radial expansion of the second end, whereas the counteracting elastic means may be contact engaged against the pivot. Alternatively or in combination with this feature, the counteracting elastic means may be housed internally to the pivot so as to act on the at least one slider in correspondence of its first end.

Also in this case, upon the opening of the closing element, the counteracting elastic means act on the at least one slider to return it back to its extended end position, returning at the same time the closing element back to its closed position. With this aim, the counteracting elastic means may be contact engaged against an upper wall of the pivot and they may comprise a pushing member acting against the first end of the at least one slider.

In another preferred, non-exclusive embodiment of the invention, the counteracting elastic means and the at least one slider may be reciprocally coupled so that the counteracting elastic means are in the position of maximum elongation in correspondence of the compressed end position of the slider.

In such embodiment, the counteracting elastic means may be placed within the at least one operating chamber so as to act on the at least one slider in correspondence with the second end.

With this aim, the counteracting elastic means may be contact engaged against a lower wall of the at least one operating chamber, whereas the second end of the at least one slider may include the above mentioned radial expansion.

Advantageously, the hinge device according to the invention may further include one or more anti-friction elements, which may preferably be interposed between the movable element and the fixed element to facilitate the mutual rotation thereof.

Suitably, the anti-friction element may include at least one annular bearing, while the boxlike hinge body may include at least one support portion to support said the annular bearing.

Suitably, the box-like hinge body may include at least one support portion susceptible to be loaded by the closing element through the movable element, the at least one support portion being designed to support the at least one anti-friction element.

Preferably, the at least one anti-friction element and the at least one support portion may be configured and/or may be in a mutual spaced relationship so that the movable element and the fixed element are spaced apart each other.

In a preferred embodiment of the invention, the above support portion may be a first support portion which is positioned in correspondence of at least one end of the box-like hinge body to be loaded by the closing element during use through the movable element. In this case, the annular bearing may be a first annular bearing, which may be of the radial-axial type, interposed between the first support end portion and the loading movable element.

It is understood that the first support portion may support one or more first annular bearings.

Preferably, the movable element has a loading surface susceptible to came into contact with said the first annular bearing in such a manner to rotate thereon.

In order to further minimize the mutual frictions, the first annular bearing and the first support end portion of the box-like hinge body may be configured and/or may be in a mutual spaced relationship so that during use the loading movable element is spaced apart from said box-like hinge body.

Preferably, the hinge device of the invention may include a couple of first annular bearings positioned in correspondence of a respective couple of first support end portions positioned to both ends of said box-like hinge body. In this manner, the hinge device of the invention may be reversible, i.e. may be turned upside down by maintaining the same anti-friction property on both ends.

In a further preferred but non exclusive embodiment of the invention, the above at least one support portion may be a second support portion positioned within the working chamber to be loaded by said pivot during use. In this case, the above at least one annular bearing may be a second annular bearing, which may be of the axial type, interposed between the second support portion and the pivot.

It is understood that the second support portion may support one or more second annular bearings.

Preferably, the pivot may have a loading surface susceptible to came into contact with the second annular bearing in such a manner to rotate thereon.

In case of hinge device including the counteracting elastic means located within the working chamber but outside the pivot, the second support portion may be susceptible to separate said the working chamber into a first and second areas, the pivot and the second annular bearing being housed into the first area, the counteracting elastic means being housed in the second area.

Thanks to this configuration, no torsion action between the pivot and the counteracting elastic means may arise, since the two elements are mutually separated by the second support portion. Moreover, the counteracting elastic means have not loss of force due to frictions, since the pivot rotate on the annular bearing which is positioned onto the second support portion.

In this manner, an extremely performing hinge device can be provided.

Suitably, the counteracting elastic means may include a spring having one end interacting, preferably directly, with the second support portion.

In case of hinge device including the counteracting elastic means located within the pivot, the anti-friction element may be is an anti-friction interface member interposed between the counteracting elastic means and the slider.

Advantageously, the first end of the slider may have a round surface, the anti-friction interface member having a contact surface interacting with the rounded first end. Preferably, the anti-friction interface member may have a spherical of discoidal shape.

It is understood that the box-like hinge body may include both the first and the second support portions for supporting respectively the first and the second one or more annular bearings.

On the other hand, the box-like hinge body may include the first support portion or portions or the second support portion for supporting respectively the first or the second one or more annular bearings.

In order to rotatably block the at least one slider in the at least one operating chamber, the at least one slider may include an axial passing slot extending along the second longitudinal axis, whereas the device may further include a second pin radially inserted through the slot and anchored to the at least one operating chamber.

The second pin rotatable blocking the at least one slider into the at least one operating chamber may be different from the first pin for connecting the first end of the at least one slider to the inclined grooves of the pivot.

However, in a preferred, non-exclusive embodiment of the invention, the first pin defining the appendices of the at least one slider may coincide with the second pin rotatable blocking the at least one slider into the at least one operating chamber. In other words, in this embodiment the hinge device may include a single pin which fulfils both functions.

The plunger element of the at least one slider, if present, may comprise a pushing head designed to separate said at least one operating chamber into at least a first and a second variable volume compartments.

Appropriately, the first and the second variable volume compartments may be fluidically connected to each other and/or adjacent.

Moreover, the first and second variable volume compartments may be advantageously designed to have in correspondence of the closed position of the closing element respectively the maximum and the minimum volume.

In order to allow the flow of the working fluid from the first to the second compartment during the opening of the closing element, the pushing head of the plunger element may comprise a passing through hole so as to put into fluidic communication the first and the second compartment.

Furthermore, in order to prevent the backflow of the working fluid from the second compartment to the first one during the closing of the closing element, a check valve may be provided which interacts with the passing through hole of the pushing head, which valve may be preferably of the one-way normally closed type to open upon the opening of the closing element.

For the controlled backflow of the working fluid from the second compartment to the first one during the closing of the closing element, an appropriate hydraulic circuit may be provided.

In a preferred, non-exclusive embodiment, in which the plunger element may be housed with a predetermined clearance in the a least one operating chamber, this backflow hydraulic circuit may be defined by the interspace between the pushing head of the plunger element and the inner surface of the at least one operating chamber.

In another preferred, non-exclusive embodiment of the invention, in which the plunger element may be tightly housed in the at least one operating chamber, the hinge body of the hinge device may comprise the hydraulic circuit for the controlled backflow of the working fluid.

Appropriately, this hydraulic circuit may have an inlet for the working fluid which is present into the second compartment and one or more outlets thereof in the first compartment, for example a first and a second outlets which may be fluidically connected to one another.

These first and second outlets may control and adjust, respectively, the speed of the closing element and its latch action towards the closed position.

For this purpose, the plunger element may comprise a substantially cylindrical rear portion facing the inner surface of the first compartment, which may remain decoupled from the first outlet of the at least one hydraulic circuit for the whole stroke of the plunger element.

On the other hand, the rear portion of the plunger element may be in a spatial relationship with the second outlet so that the second outlet remains coupled with the first outlet for a first initial part of the stroke of the plunger element and remains decoupled from the second outlet for a second final part of this stroke, so that the closing element latches towards the closed position when the movable element is in proximity of the fix element.

Appropriately designing the parts, it is possible to adjust the position of the latch action, which may be normally accomplished when the movable element is in a position comprised between 5° and 15° with respect to the closed position.

In order to adjust the flow of the working fluid from the second compartment to the first one during the closing of the closing element, the hinge body may have a first screw having a first end interacting with the first outlet of the hydraulic circuit and a second end operable from the outside by a user.

In this way the user, appropriately operating on the second end of the first screw, acts on the first end thereof so that it progressively obstructs the first outlet, adjusting the speed with which the working fluid returns from the second to the first compartment.

On the other hand, for adjusting the force with which the closing element latches towards the closed position, the hinge body may have a second screw having a first end interacting with the second outlet of the hydraulic circuit and a second end operable from the outside by a user.

This way the latter, appropriately operating on the second end of the second screw, acts on the first end thereof so that it progressively obstructs the second outlet, adjusting the latch speed of the closing element towards the closed position.

Advantageous embodiments of the invention are defined according to the dependent claims.

BRIEF DESCRIPTION OF THE DRAWINGS

Further features and advantages of the invention will appear more evident upon reading the detailed description of some preferred, non-exclusive embodiments of a hinge device according to the invention, which are described as non-limiting examples with the help of the annexed drawings, in which:

FIGS. 8*a*, 8*b* and 8*c* are respectively front, bottom and sectioned along a plane VIIIc-VIIIc views of the embodiment of the hinge device 1 of FIG. 7, with the movable element 10 in the closed position;

DETAILED DESCRIPTION OF EMBODIMENTS OF THE INVENTION

Referring to the above mentioned figures, the hinge device according to the invention, generally indicated with 1, is particularly suitable for rotatably moving a closing element D, such as a door, a shutter or the like, which may be anchored to a stationary support structure S, such as for instance a wall and/or a frame of a door or of a window and/or a supporting pillar and/or the floor.

FIGS. 1 to 45*c* show several embodiments of the hinge device 1. Where not otherwise specified, similar or equal parts and/or elements are indicated with a single reference number, which means that the described technical features are common to all similar or equal parts and/or elements.

All the embodiments shown herein include a movable element, which may include a movable connecting plate 10, anchorable to the closing element D, and a fixed element, which may include a fixed connecting plate 11, anchorable to the stationary support structure S.

The fix plate 11 and the movable plate 10 may be mutually coupled for rotating around a first longitudinal axis X, which may be substantially vertical, between an open position, shown for instance in FIGS. 2*c*, 9*c*, 12*c* and 17*c*, and a closed position, shown for example in FIGS. 2*b*, 9*b*, 12*b* and 17*b*, corresponding to the respectively closed or open positions of the closing element D.

Figures 4A, 4B:
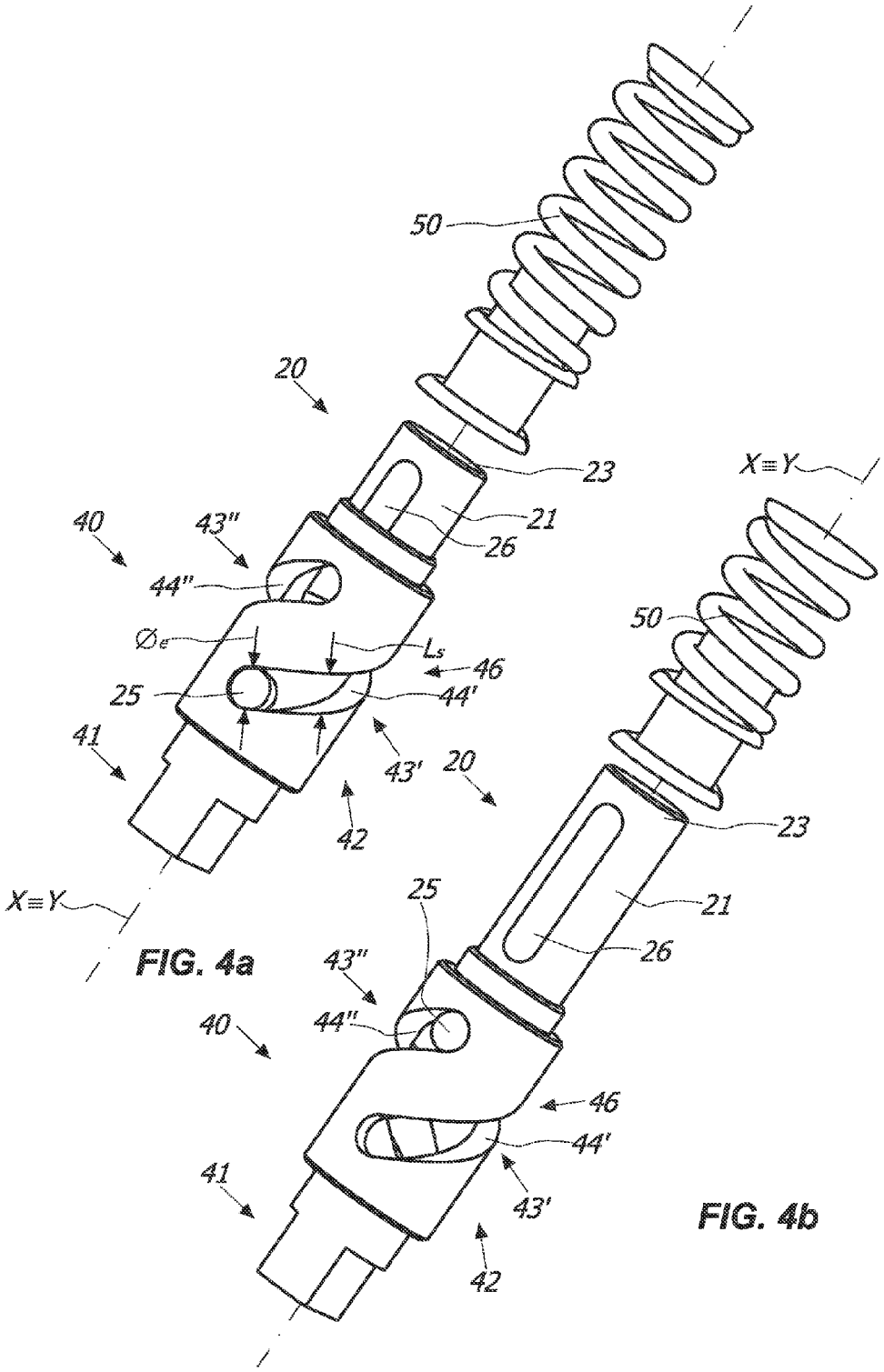
FIGS. 4*a* and 4*b* are axonometric views of the assembly slider 20-pivot 40-spring 50 of the embodiment of the hinge device 1 of FIG. 1, wherein the slider 20 is respectively in the compressed and extended end positions.
Figure 5A:
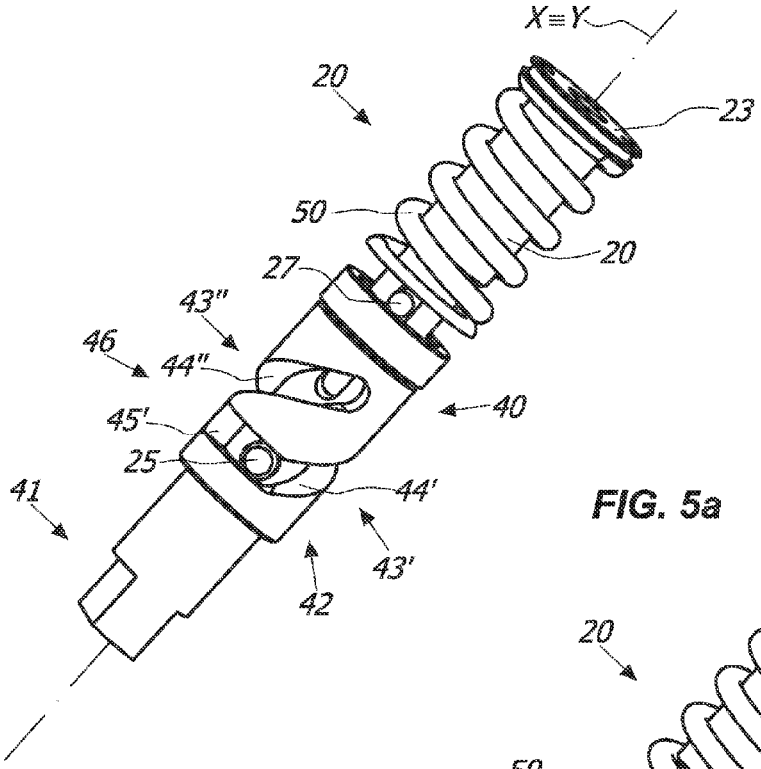
FIGS. 5*a* and 5*b* are axonometric views of the assembly slider 20-pivot 40-spring 50 of another embodiment of the hinge device 1, wherein the counteracting elastic means 50 are interposed between the pivot 40 and the second end 23 of the slider 20, and wherein the slider is respectively in the compressed and extended end positions.
Figure 5B:
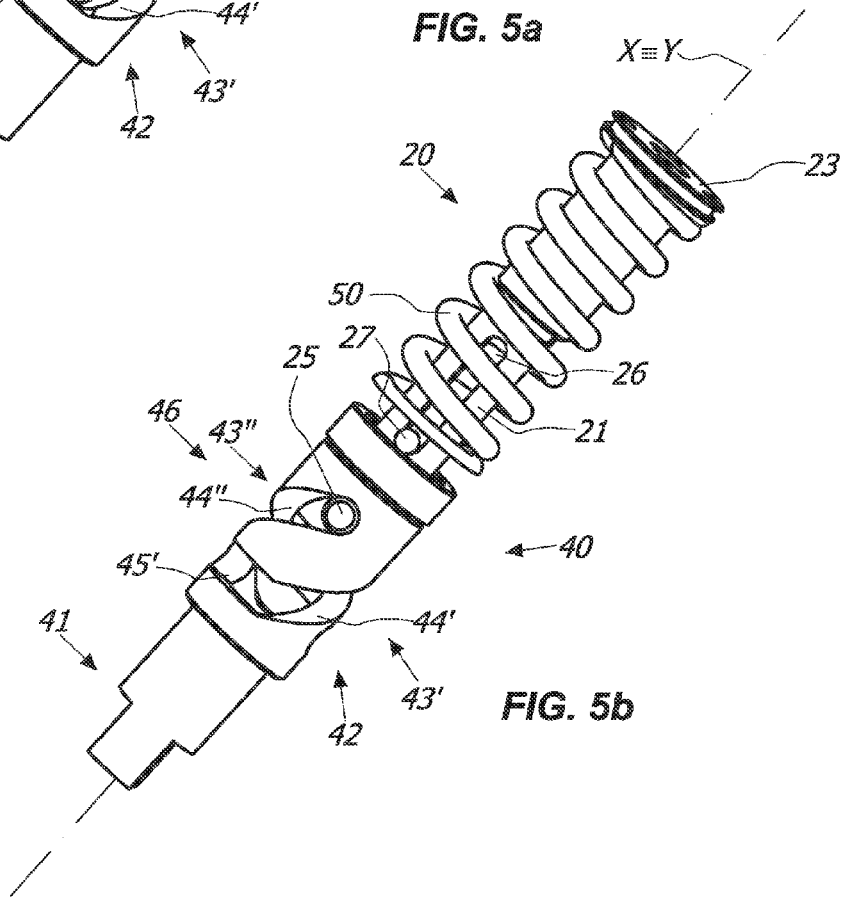
Figure 6A:
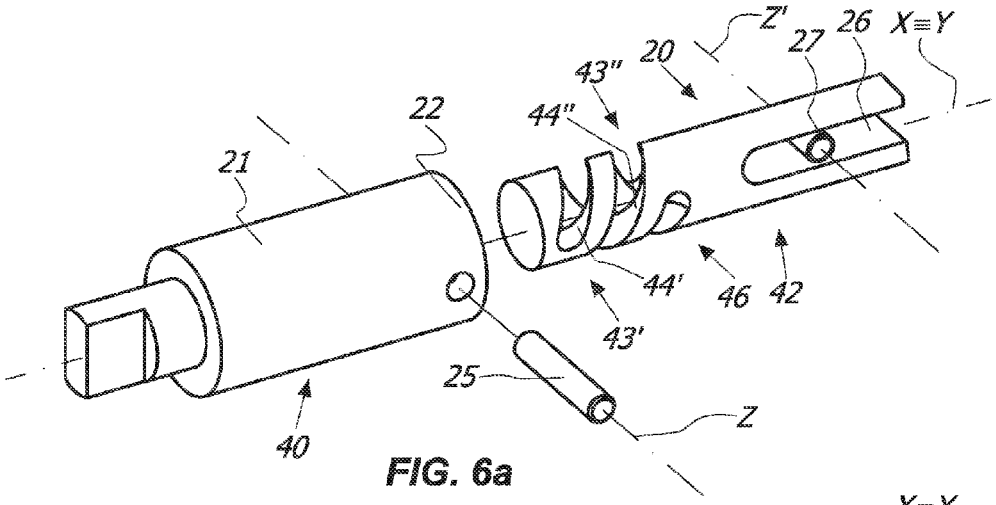
FIGS. 6*a*, 6*b* and 6*c* are axonometric views of the assembly slider 20-pivot 40 of another embodiment of the hinge device 1, wherein the slider 20 includes the grooves 43', 43" which form the single guide element 46 and the pivot 40 includes the first pin 25 insertable into the single guide element 46, respectively in an exploded configuration, in an assembled configuration with the slider 20 in the extended end position and in an assembled configuration with the slider 20 in the compressed end position.
Figure 6B:
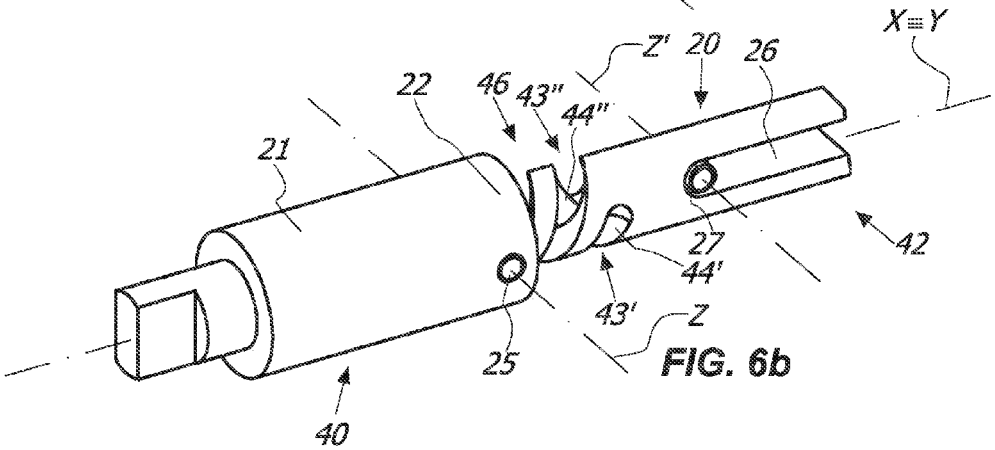
Figure 6C:
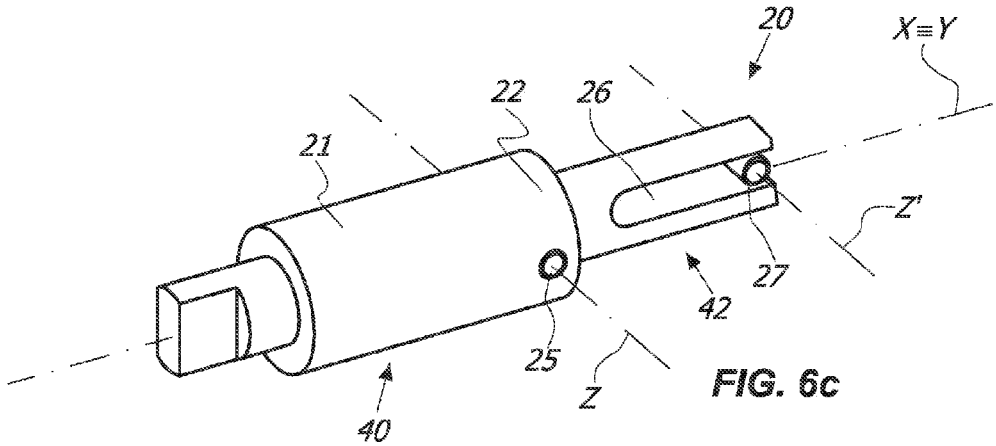

In all the embodiments of the invention shown herein, the hinge device 1 may include at least one slider 20 movable along a respective second axis Y between a compressed end position, shown for instance in FIGS. 4*a*, 5*a* and 6*c*, and an extended end position, shown for instance in FIGS. 4*b*, 5*b* and 6*b*.

The first and the second axis X, Y may be reciprocally parallel, such as for example in the embodiments of the invention shown in FIGS. 32 to 34*c*, or coincident, such as for example in the embodiments of the invention shown in FIGS. 1 to 31*b*.

In this last case, the first and the second axis X, Y may define a single axis, indicated with X≡Y, which acts as both rotation axis for the movable plate 10 and sliding axis for the slider 20.

In all the embodiments of the invention shown herein, the hinge device 1 may comprise at least one operating chamber 30 defining the second longitudinal axis Y to slidably house the respective slider 20. On the other hand, the hinge device 1 may comprise two or more operating chambers 30, 30' each one defining a respective second longitudinal axis Y, Y' and comprising a respective slider 20, 20', such as for instance in the embodiment of the invention shown in FIGS. 32 to 34*c*.

Each operating chamber 30 may be made within a hinge body 31, which may have a generally box-like shape.

The slider 20 may include a body 21 elongated along the axis Y, with a first end 22 and a second opposed end 23.

Of course, in the embodiments of the invention in which the first and the second axis X, Y coincide, the operating chamber 30 may be single and define the single axis X≡Y.

Advantageously, in all the embodiments of the invention shown herein, the hinge device 1 may comprise a pivot 40, which may define the rotations axis X of the movable plate 10.

Of course, in the embodiments of the invention wherein the first and the second axis X, Y coincide, the pivot 40 may define the single axis X≡Y, and may be at least partially housed in the operating chamber 30 so as to be coaxial with the operating chamber.

Figure 1:
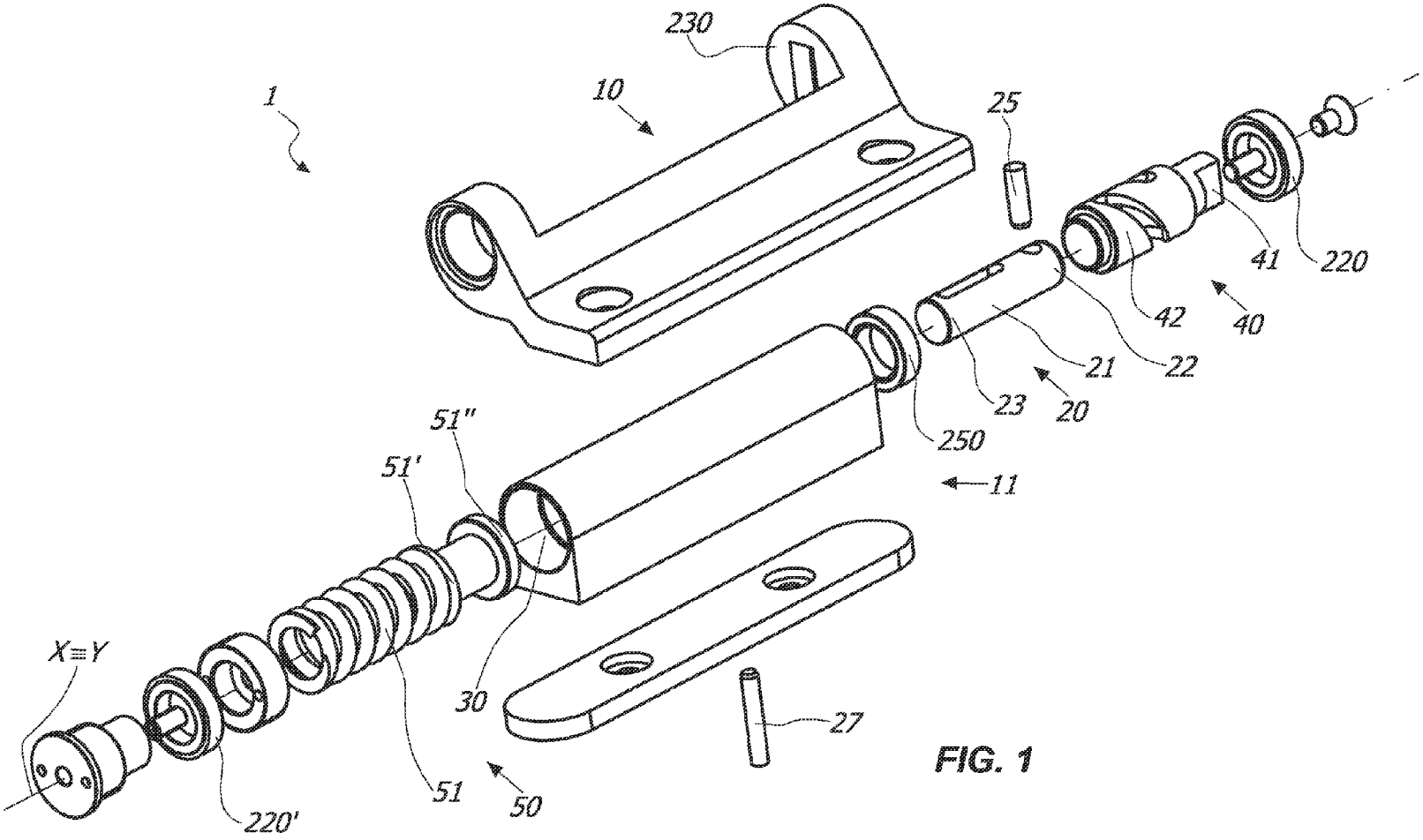
FIG. 1 is an exploded view of a first embodiment of the hinge device 1.
Figure 2A:
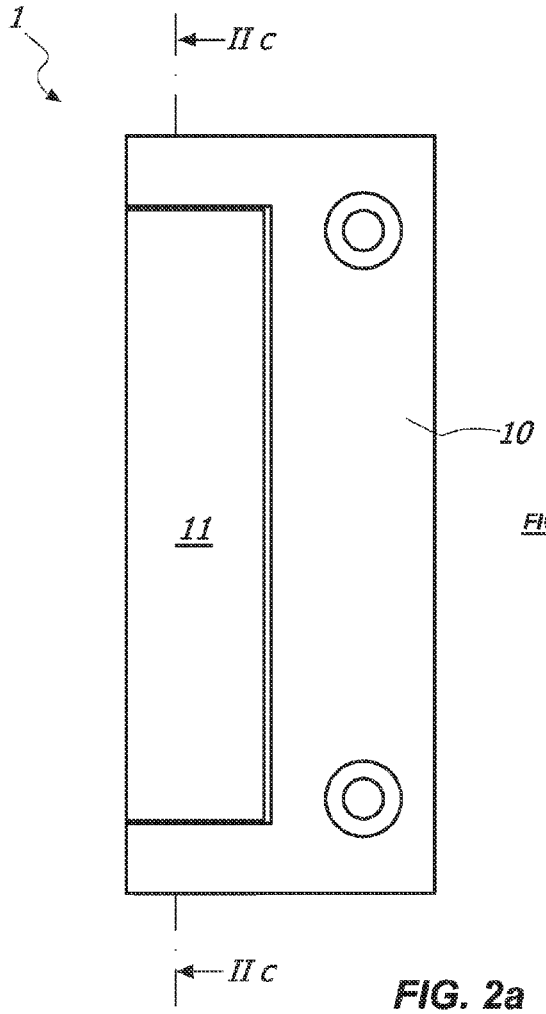
FIGS. 2*a*, 2*b* and 2*c* are respectively front, bottom and sectioned along a plane lie-lie views of the embodiment of the hinge device 1 of FIG. 1, with the movable element 10 in the closed position.
Figure 2C:
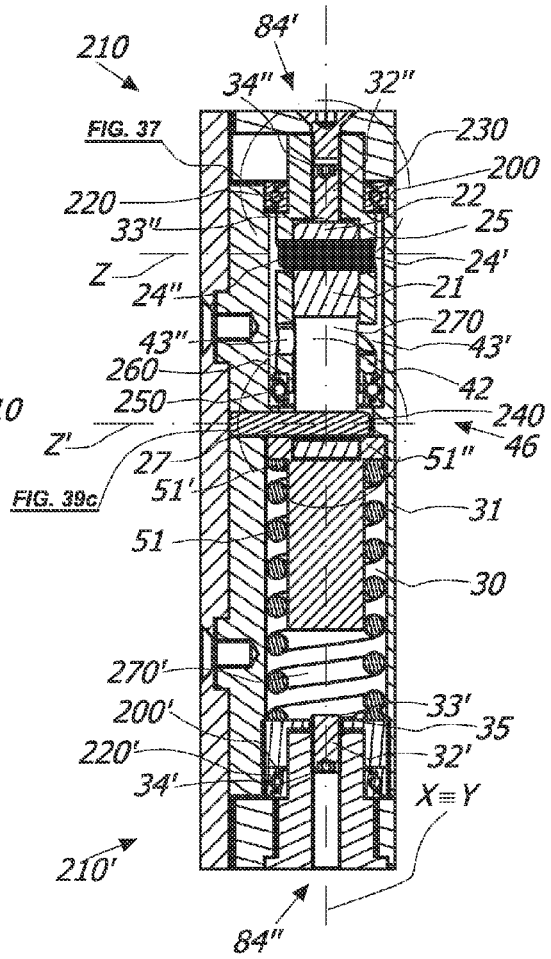
Figure 2B:
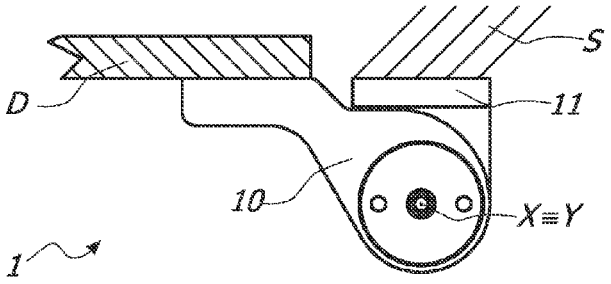
Figure 3A:
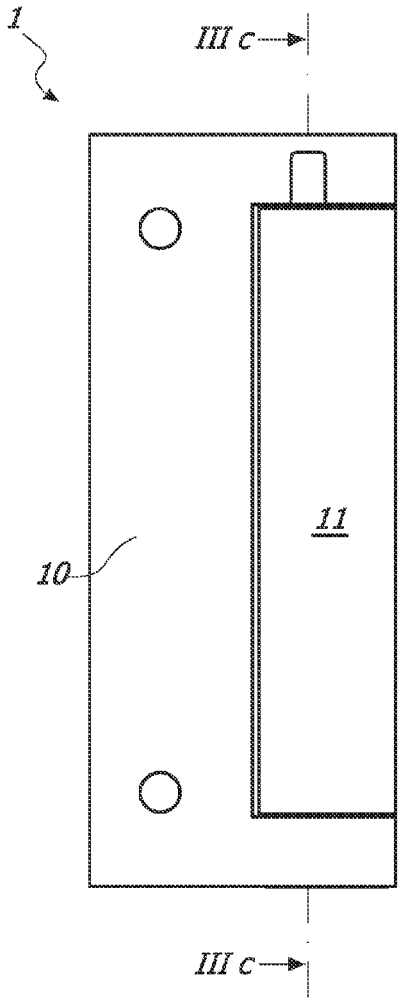
FIGS. 3*a*, 3*b* and 3*c* are respectively front, bottom and sectioned along a plane IIIc-IIIc views of the embodiment of the hinge device 1 of FIG. 1, with the movable element 10 in the open position.
Figure 3C:
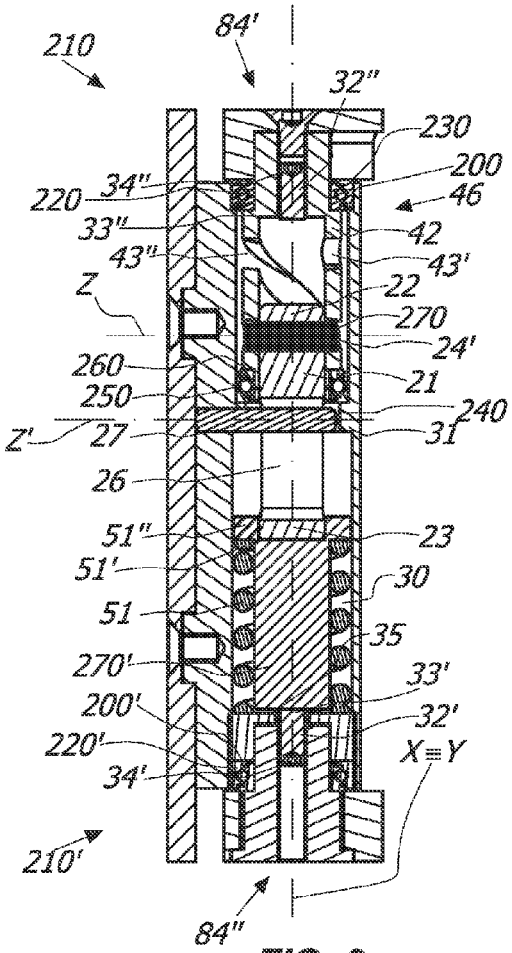
Figure 3B:
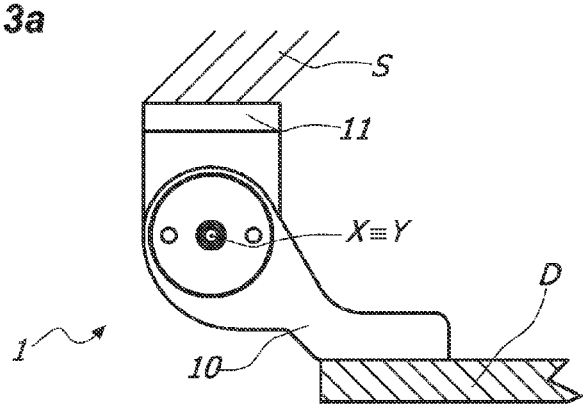
Figure 7:
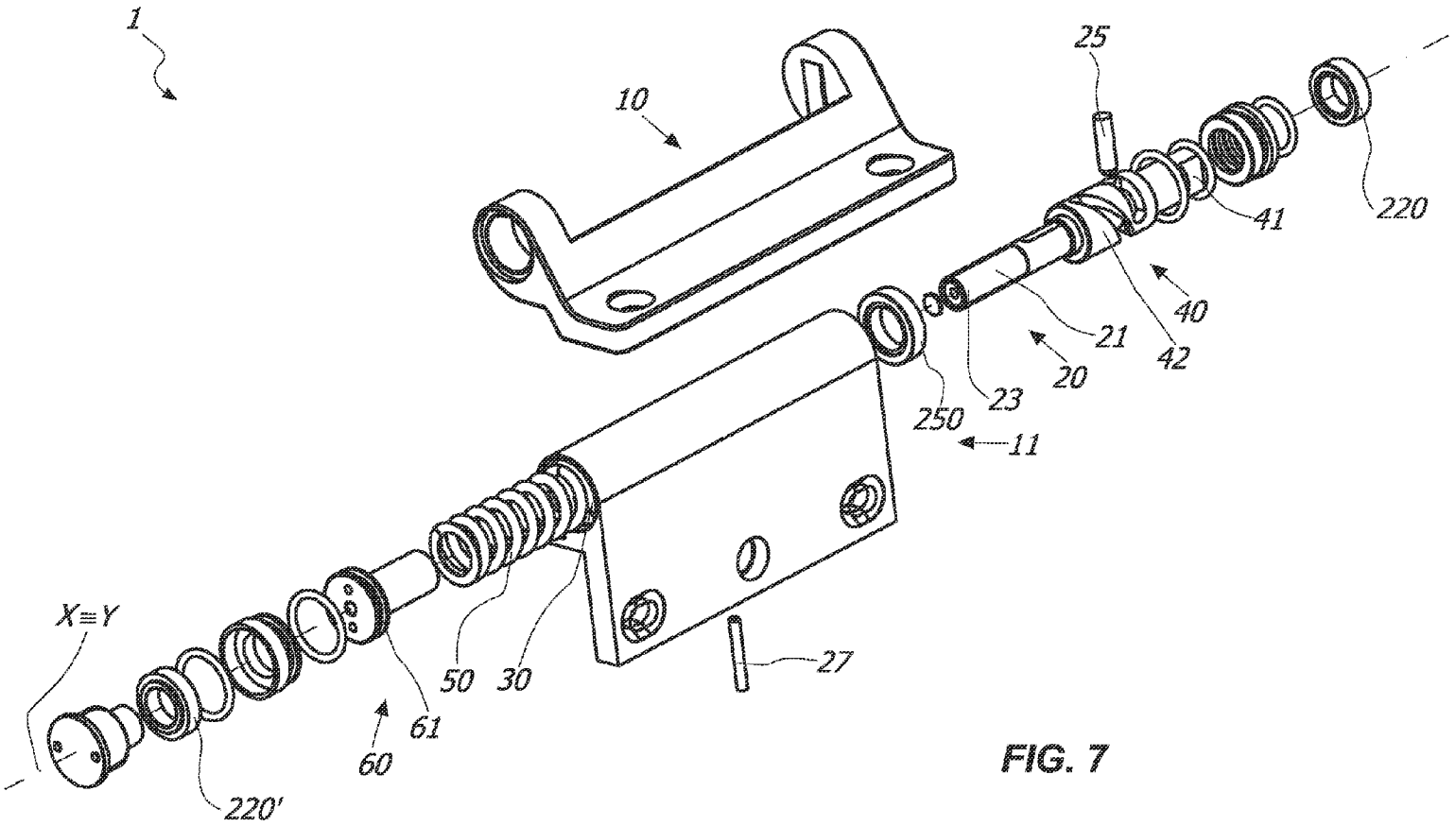
FIG. 7 is an exploded view of another embodiment of the hinge device 1.
Figure 9A:
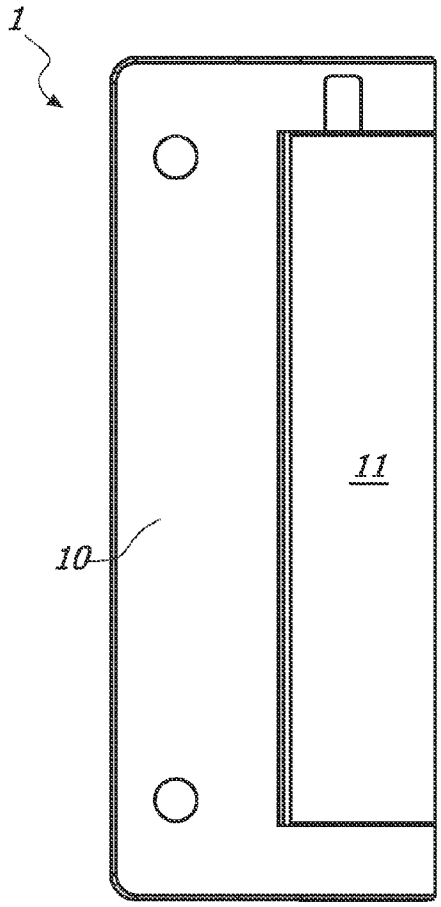
FIGS. 9*a*, 9*b* and 9*c* are respectively front, bottom and sectioned along a plane IXc-IXc views of the embodiment of the hinge device 1 of FIG. 7, with the movable element 10 in the open position.
Figure 9C:
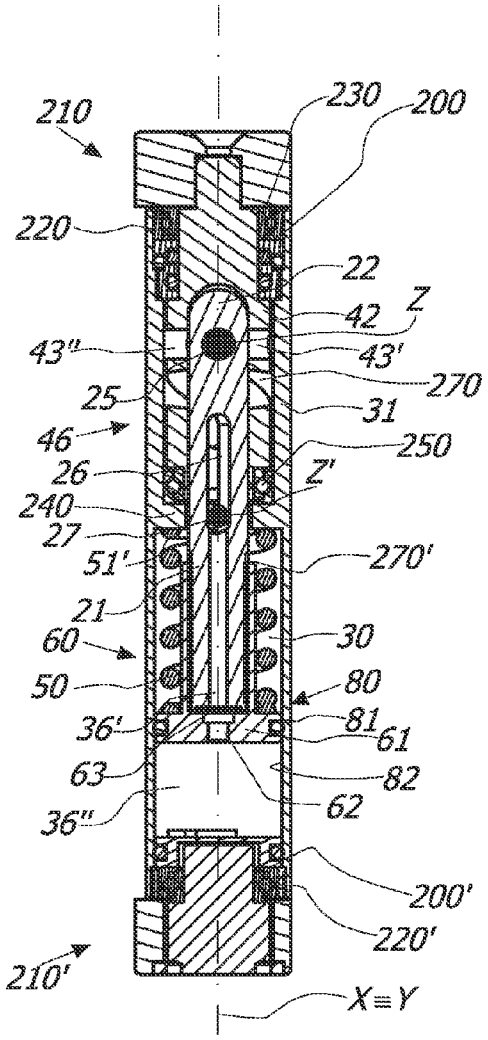
Figure 9B:
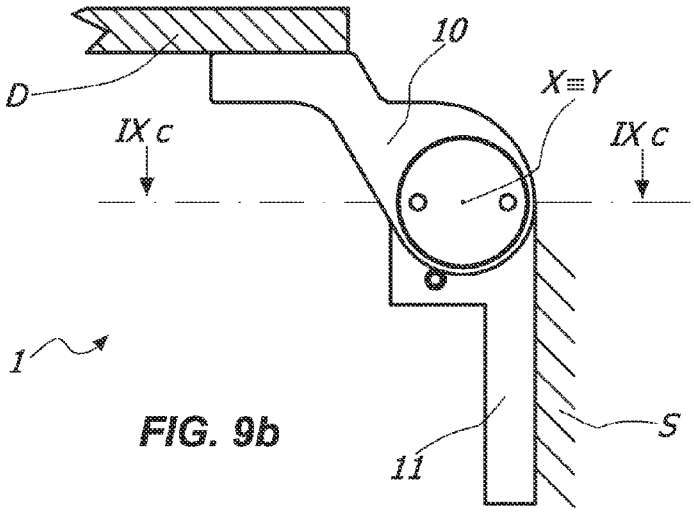
Figure 10:
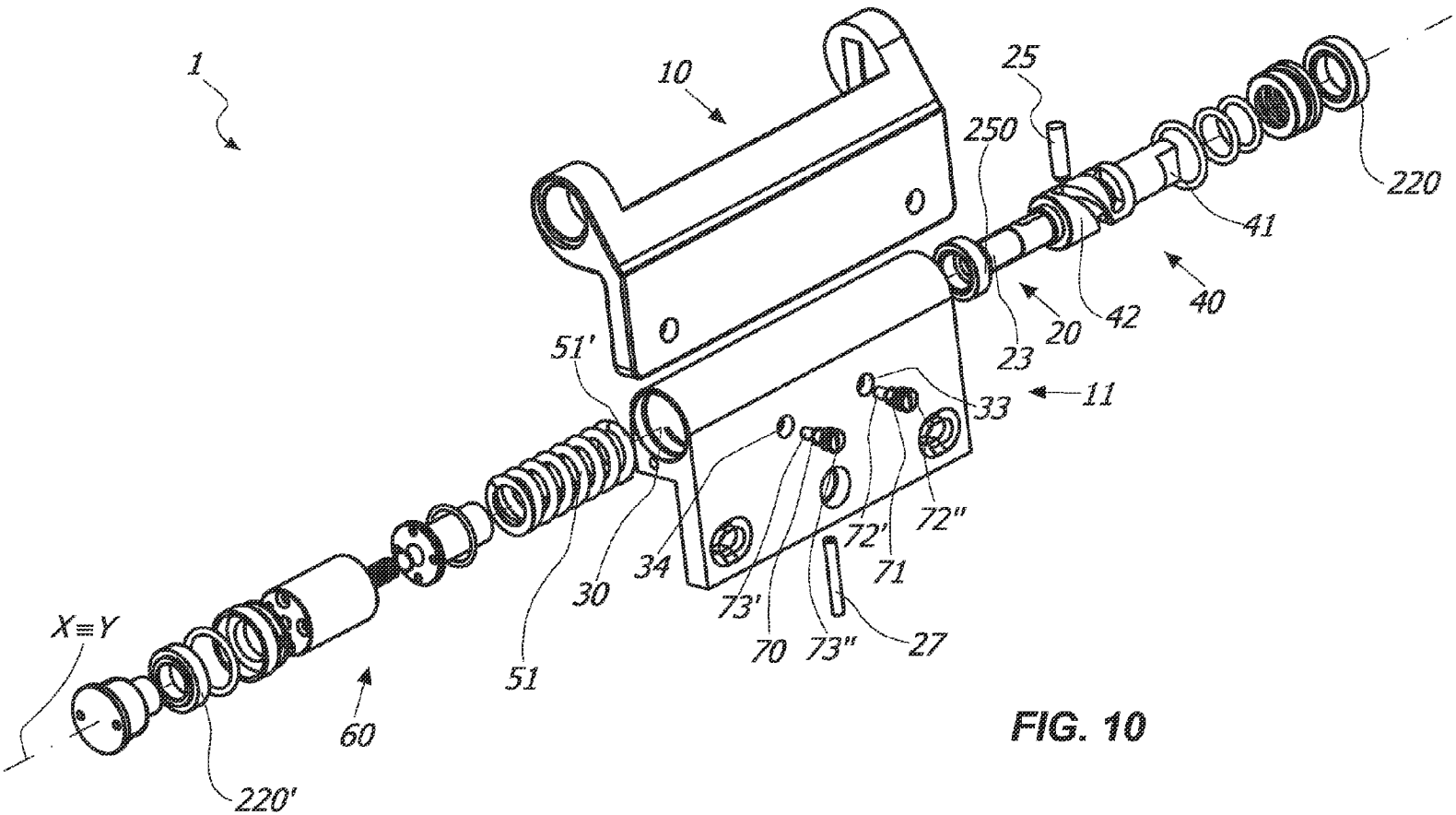
FIG. 10 is an exploded view of a further embodiment of the hinge device 1.
Figure 11A:
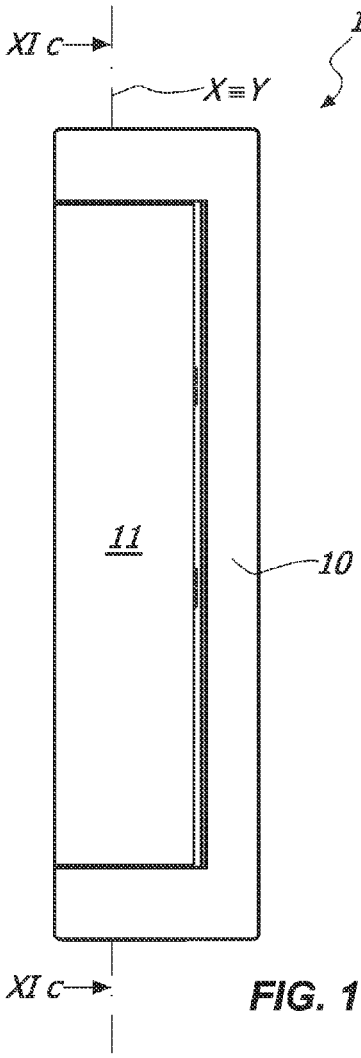
FIGS. 11*a*, 11*b* and 11*c* are respectively front, bottom and sectioned along a plane XIc-XIc views of the embodiment of the hinge device 1 of FIG. 10, with the movable element 10 in the closed position.
Figure 11C:
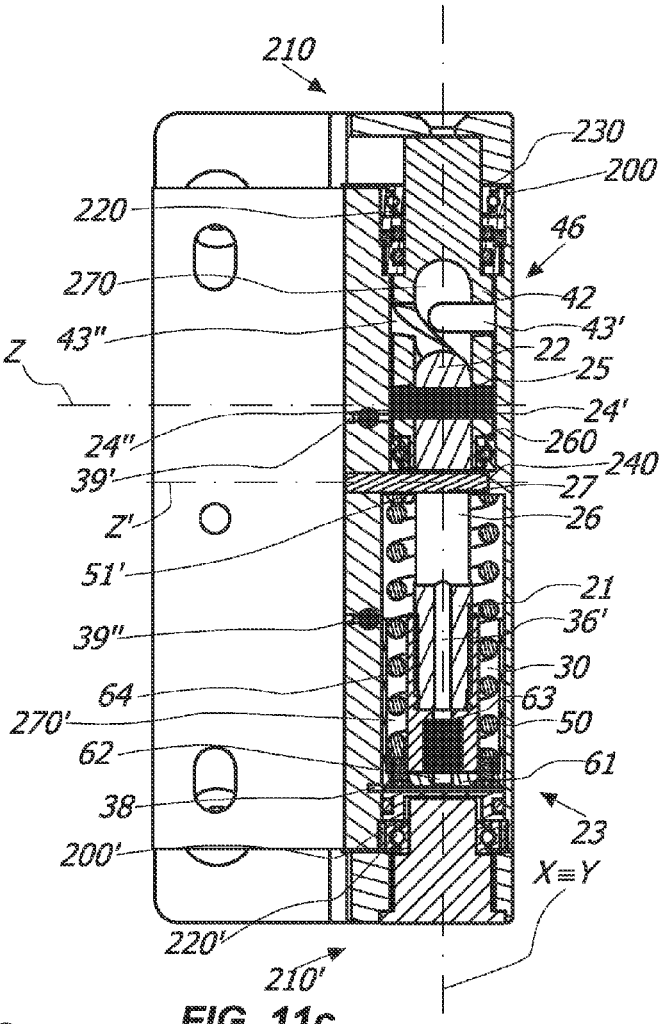
Figure 11B:
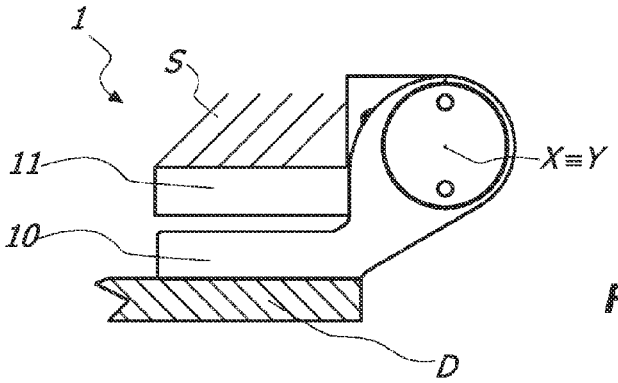
Figure 12A:
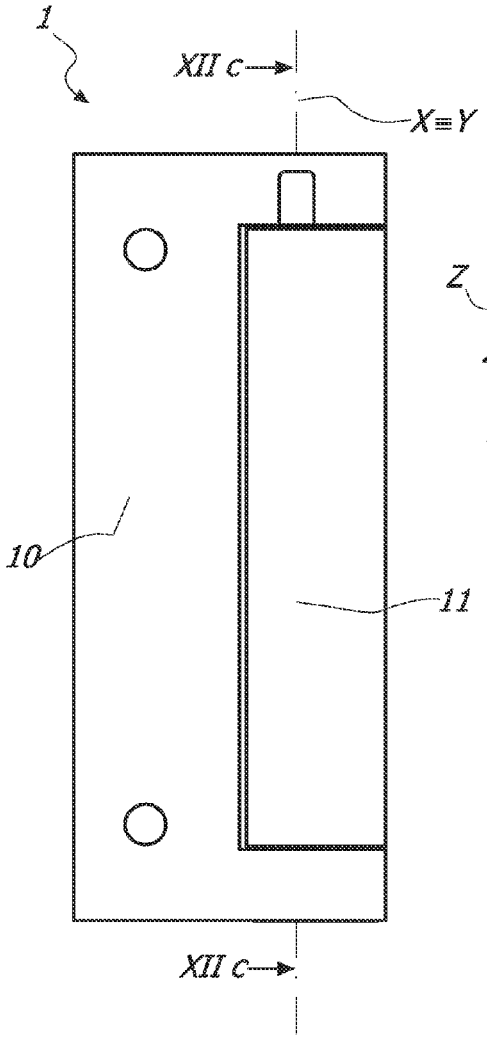
FIGS. 12*a*, 12*b* and 12*c* are respectively front, bottom and sectioned along a plane XIIc-XIIc views of the embodiment of the hinge device 1 of FIG. 10, with the movable element 10 in the open position.
Figure 12C:
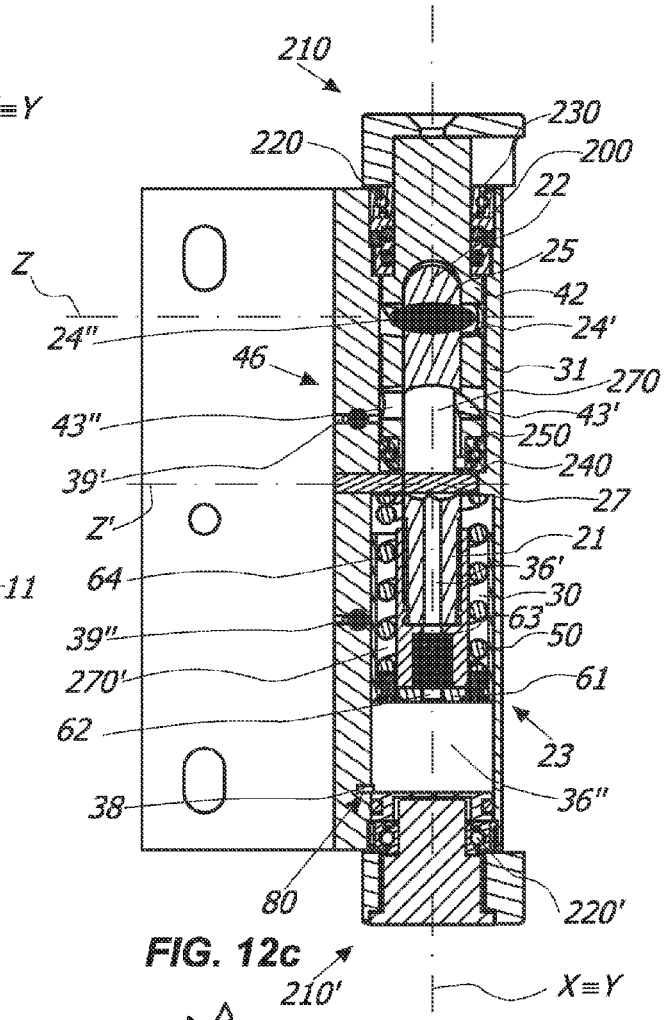
Figure 12B:
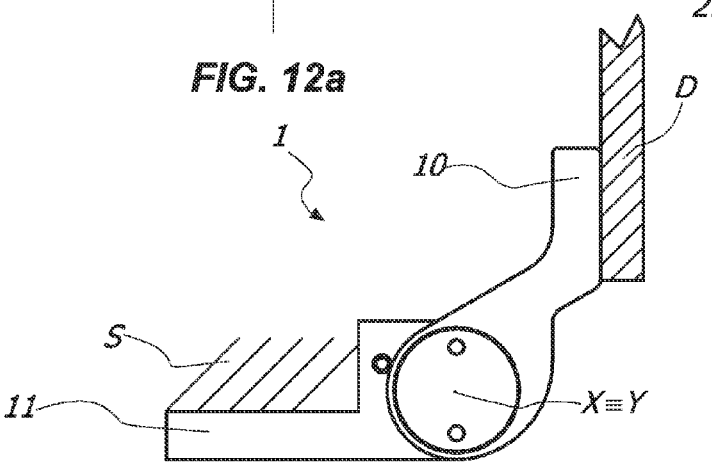

In some embodiments of the invention, as for example those shown in FIGS. 1, 7 and 10, the movable element may include the pivot 40, whereas the fix element may comprise the operating chamber 30.

Figure 28:
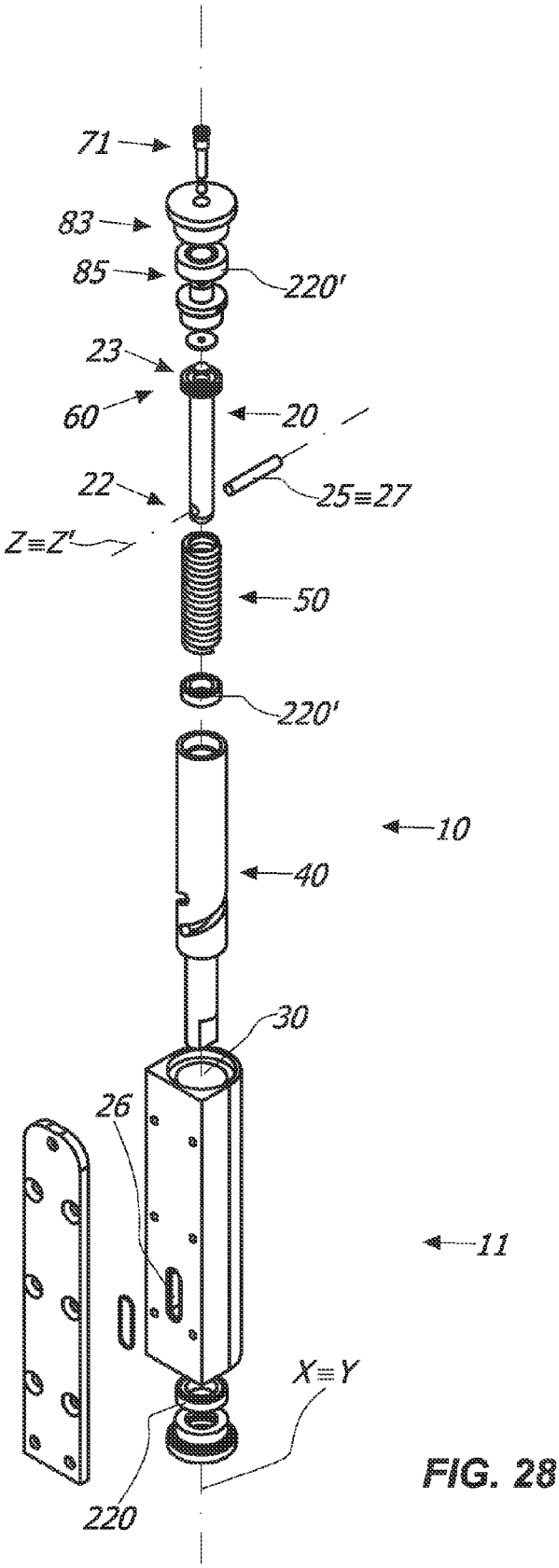
FIG. 28 is an exploded view of a further embodiment of the hinge device 1.
Figure 29A:
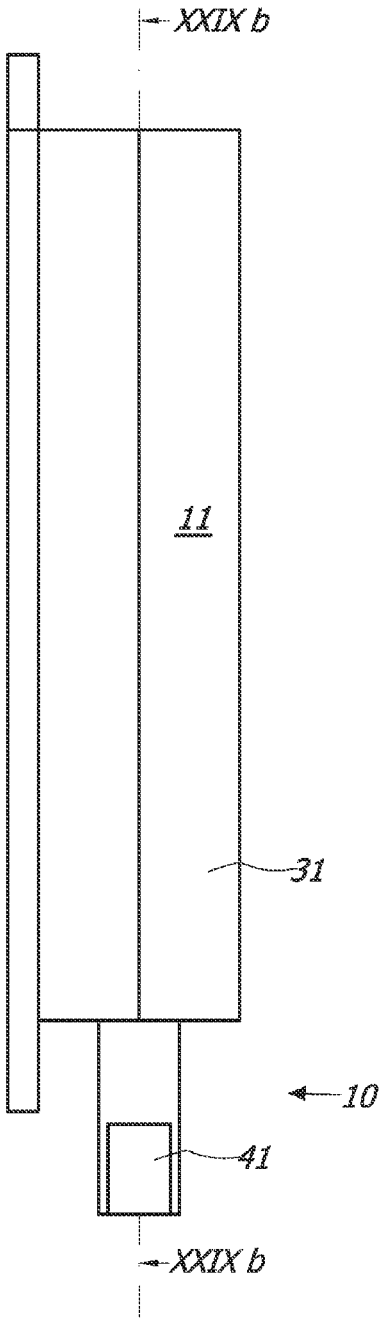
FIGS. 29*a* and 29*b* are respectively front and sectioned along a plane XXIXb-XXIXb views of the embodiment of the hinge device 1 of FIG. 28, with the movable element 10 in the closed position.
Figure 29B:
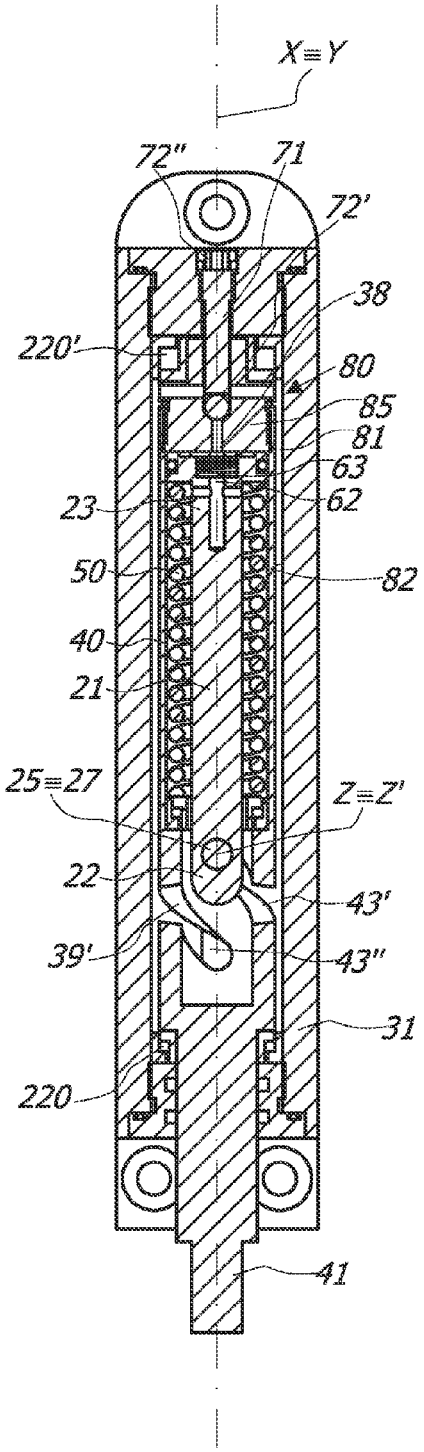
Figure 30A:
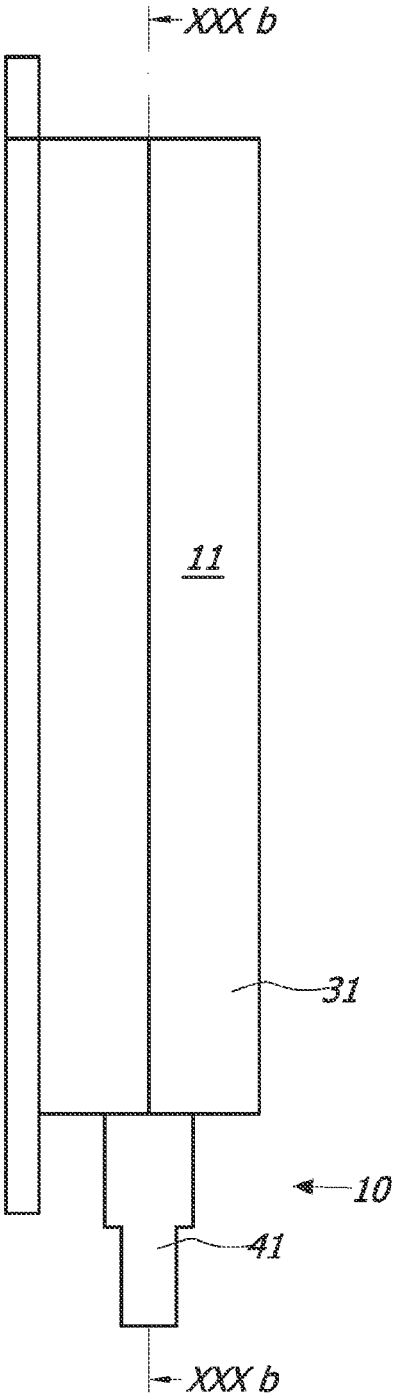
FIGS. 30*a* and 30*b* are respectively front and sectioned along a plane XXXb-XXXb views of the embodiment of the hinge device 1 of FIG. 28, with the movable element 10 in a partly open position.
Figure 30B:
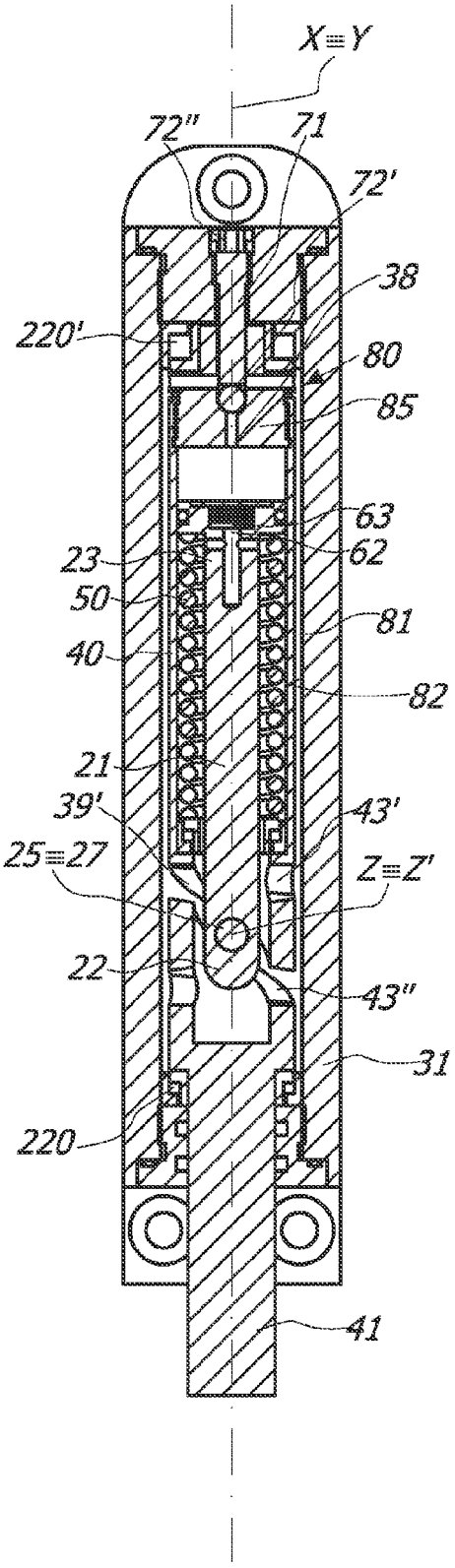
Figure 31A:
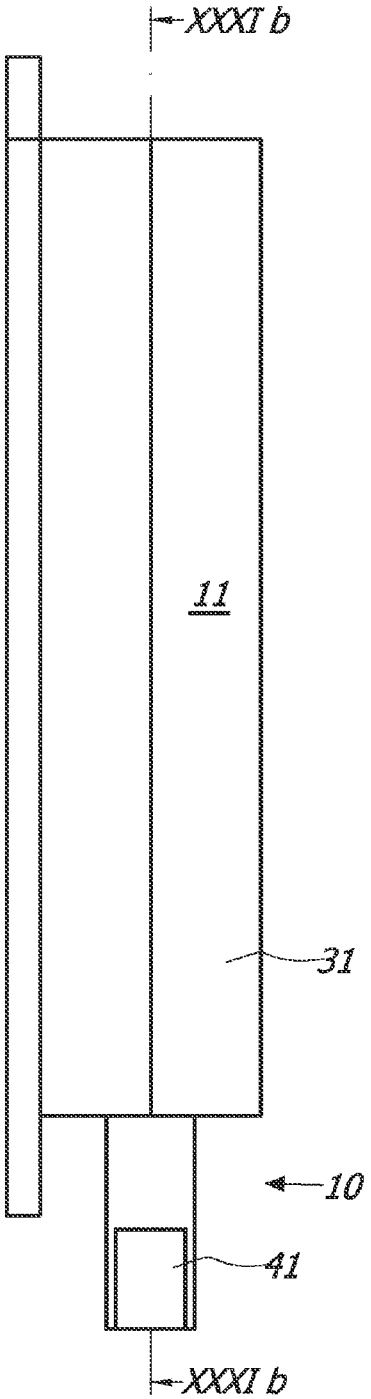
FIGS. 31*a* and 31*b* are respectively front and sectioned along a plane XXXIb-XXXIb views of the embodiment of the hinge device 1 of FIG. 28, with the movable element 10 in the fully open position.
Figure 31B:
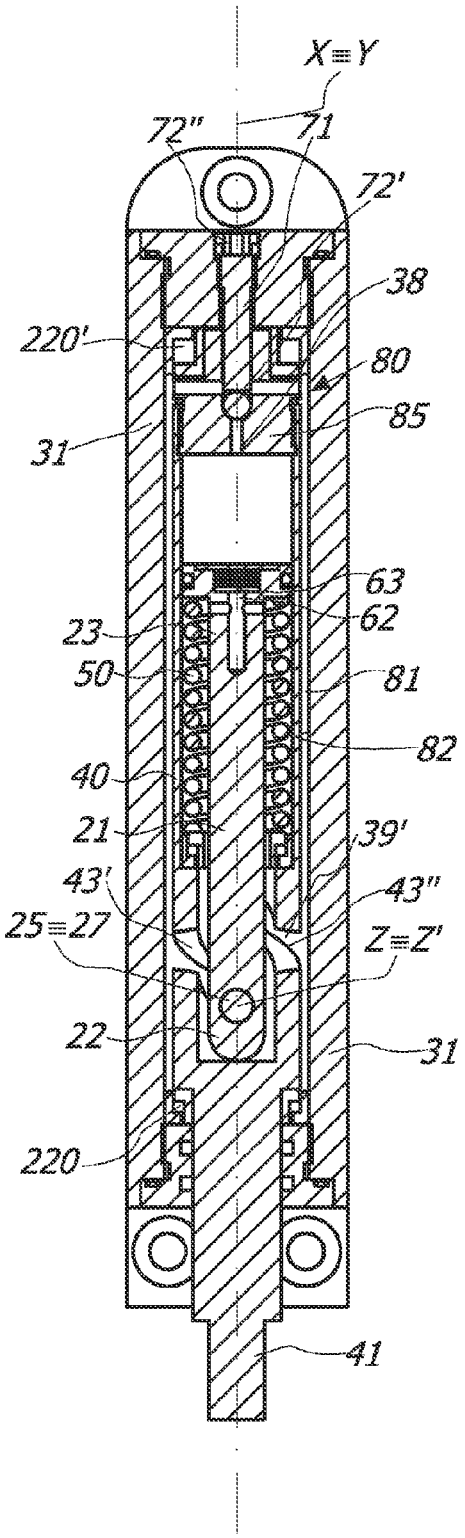

On the other hand, in other embodiments of the invention, such as the one shown in FIG. 28, the movable element may include the operating chamber 30, whereas the fix element may include the pivot 40.

Appropriately, the pivot 40 may comprise a portion 41 outgoing from the hinge body 31 for the coupling with the movable element 10 or with the stationary support structure S or with the closing element D.

Moreover, the pivot 40 may include a substantially cylindrical portion 42 internal to the hinge body 31 and suitable to cooperate with the slider 20 so that to the rotation of the movable element 10 around the first axis X corresponds the sliding of the slider 20 along the second axis Y and vice versa.

For this purpose, the cylindrical portion 42 of the pivot 40 may include at least one pair of grooves 43', 43" equal to each other and angularly spaced of 180°. Appropriately, the grooves 43', 43" may be communicating with one another so as to define a single guide element 46 passing through the cylindrical portion 42 of the pivot 40.

In this way, it is possible to obtain a total control of the closing element D upon its opening as well as upon its closing, and to act on the spring 50 with extremely great force.

Moreover, the first end 22 of the slider 20 may include one pair of appendices 24', 24" extending outwards from corresponding opposed parts thereof to slide each in a respective groove 43', 43". Appropriately, the appendices 24', 24" may define a third axis Z substantially perpendicular to the first and second axis X, Y.

On the other side, as shown in the embodiment depicted in FIGS. 6*a*, 6*b* and 6*c*, the slider 20 may comprise the cylindrical portion 42 with the grooves 43', 43" communicating with each other so as to define the single guide element 46, whereas the pivot 40 may include the elongated body 21 with the first end 22 including the appendices 24', 24".

It is to understand that the assembly pivot 40-slider 20 shown in FIGS. 6*a* to 6*c* may equivalently replace the assembly present in all embodiments of the invention shown in FIGS. 1 to 5*b* and from 7 to 35*b*.

Advantageously, the appendices 24', 24" may be defined by a first pin 25 passing through the slider 20 or the pivot 40 in proximity of the first end 22 and housed in the single guide element formed by the communicating grooves 43', 43". The first pin 25 may define an axis Z substantially perpendicular to the first and/or to the second axis X, Y.

In order to ensure the maximum control of the closing element D upon its opening and closing, each appendix 24', 24" may have at least one sliding portion in the respective groove which has an outer diameter 0e substantially equal to the width Ls of the respective groove 43', 43". Even if for sake of simplicity this feature has been shown only in FIG. 4*a*, it is understood that it may be present in all the embodiments of the invention shown herein.

Furthermore, in order to minimize the vertical bulk, each groove 43', 43" may have at least one helical portion 44', 44" wound around the first axis X defined by the pivot 40, which may be right-handed or left-handed.

Advantageously, the single guide element 46 may include a single helical portion 44', 44" having constant slope.

Moreover, in order to have optimal bulk, each helical portion 44', 44" may have a pitch comprised between 20 mm and 60 mm, and preferably comprised between 35 mm and 45 mm.

Appropriately, the slider 20 may be rotatably blocked in the respective operating chamber 30, so as to avoid rotations around the axis Y during the sliding thereof between the compressed and extended end positions.

With this aim, the slider 20 may include a passing-through axial slot 26 extending along the axis Y, a second pin 27 radially housed into the slot 26 and anchored to the operating chamber 30 being further provided. The second pin 27 may define an axis Z' substantially perpendicular to the first and/or to the second axis X, Y.

As shown in the embodiments depicted in FIGS. 1 to 17*c*, the first pin 25 and the second pin 27 may be different from each other.

However, as for instance particularly shown in FIGS. 20 to 34*c*, the hinge device 1 may include a single pin 25E 27, which acts as both guide of the slider 20 during the sliding thereof along the grooves 43', 43" and rotating blocking element thereof. In this case, the axis Z may coincide with the axis Z', so as to define a single axis Z≡Z'.

In order to minimize the vertical bulk of the hinge device 1, the pivot 40 and the slider 20 may be telescopically coupled to one another.

For this purpose, one between the pivot 40 and the slider 20 may comprise a tubular body to internally house at least one portion of the other between the pivot 40 and the slider 20.

In the embodiments wherein the pivot 40 internally houses the slider 20, such as for example those shown in the FIGS. 1 to 5*b* and from 7 to 17*c*, the tubular body is defined by the cylindrical portion 42, whereas the internally housed portion may be defined by the first end 22 which includes the first pin 25. On the other side, in the embodiment shown in FIGS. 6*a*, 6*b* and 6*c*, the tubular body is defined by the elongated body 21, whereas the internally housed portion may be defined by the cylindrical portion 42 of the slider 20.

In the embodiments wherein the slider 20 internally houses the pivot 40, such as for example those shown in FIGS. 20 to 25*b*, the tubular body is defined by the plunger element 60, whereas the internally housed portion may be defined by the cylindrical portion 42 of the pivot 40.

The assembly pivot 40-operating chamber 30-slider 20, therefore, defines a mechanism wherein the three components are mutually coupled by means of lower pairs.

In fact, the pivot 40 and the operating chamber 30 are connected to each other by a revolute pair, so that the only reciprocal movement can be the rotation of the first one with respect to the other one around the axis X. It is understood that the pivot 40 may rotate with respect to the operating chamber 30 or vice versa.

The slider 20 is then connected to the pivot 40 and with the operating chamber 30 by means of respective prismatic pairs, so that the only reciprocal movement can be the sliding of the slider 20 along the axis Y.

Moreover, the pivot 40 and the slider 20 are connected to each other by means of a screw pair, so that to the rotation of the pivot 40 or of the operating chamber 30 around the axis X corresponds exclusively to the sliding of the slider 20 along the axis Y.

The extreme simplicity of the mechanism allows obtaining an exceptionally efficient, reliable and long-lasting hinge device, even under the hardest work conditions.

In order to ensure a blocking point of the closing element D along the opening/closing path thereof, as for example shown FIGS. 15 to 19*c*, each groove 43', 43" may have a flat portion 45', 45" after or before the portion with helical course 44', 44", which may wind for at least 10° along the cylindrical portion 42, up to 180°.

In this way it is possible to block the closing element, for example in its open position.

Figure 35A:
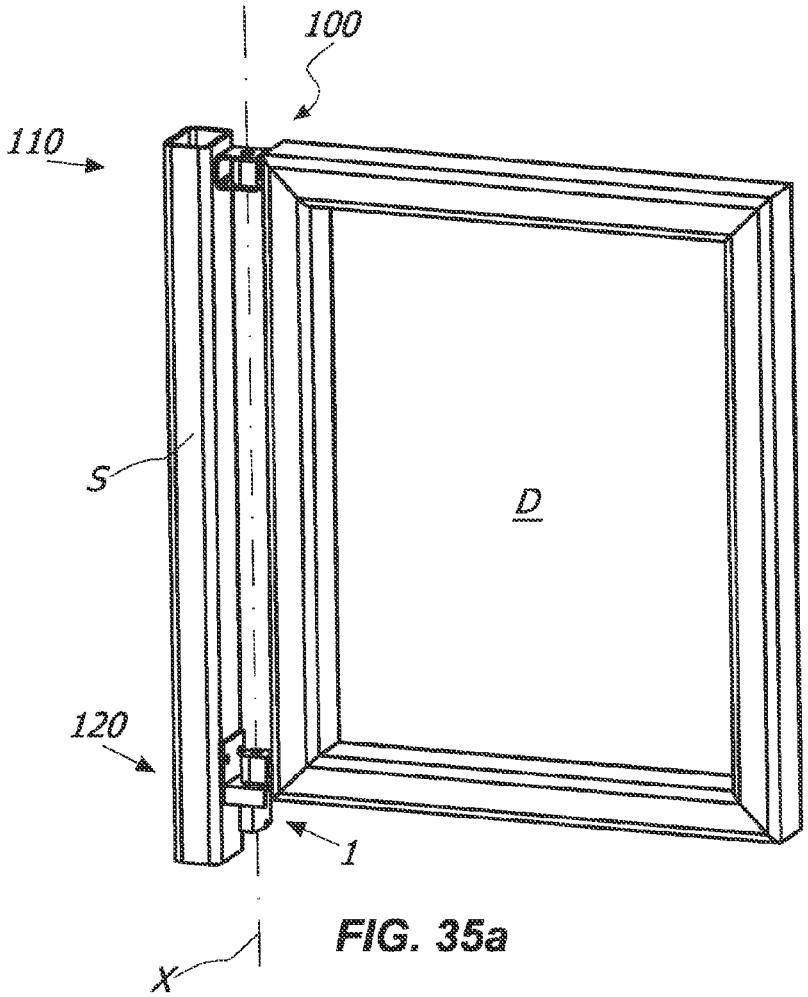
FIGS. 35*a* and 35*b* are respectively axonometric and detailed views of another embodiment of an assembly 100 for the controlled automatic closing of a closing element D, in the closed position thereof, wherein the hinge 110 is of the per se known type and the hinge 120 is configured according to the embodiment shown in FIGS. 32 to 34*c;*
Figure 35B:
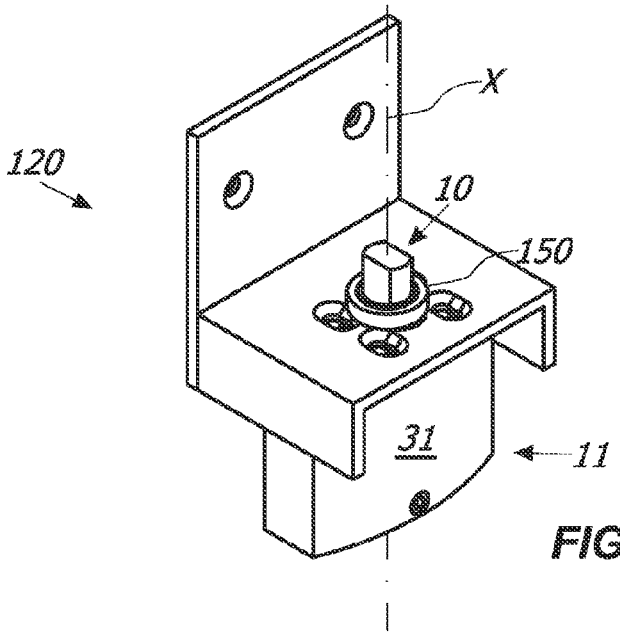
Figure 36A:
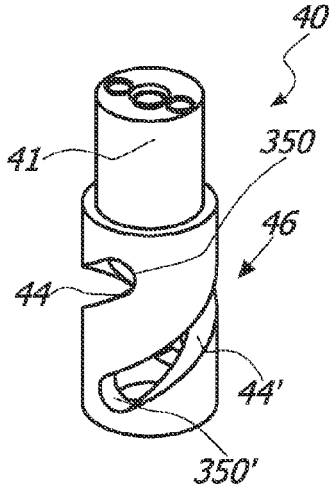
FIGS. 36*a* and 36*b* show axonometric views of a pivot 40 having respectively two blocking points 350, 350' for the pin 25 sliding through the closed path defined by the grooves 43, 43' and one blocking point 350 and one open end 350"

Advantageously, as shown in FIGS. 1 to 35*b* and particularly shown in FIG. 36*a*, the single guide element 46 of the cylindrical portion 42 may be closed to both ends so as to define a closed path having two blocking end point 350, 350' for the first pin 25 sliding therethrough. The closed path is defined by the grooves 43', 43".

Thanks to this feature, it is possible to obtain the maximum control of the closing element D.

Figure 36B:
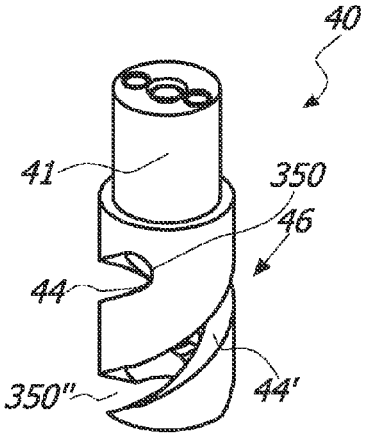

On the other hand, as shown in FIG. 36*b*, the single guide element 46 may be closed to only one end so as to define a partly open path having one blocking end point 350 for the first pin 25 sliding therethrough and one open end point.

In order to ensure the automatic closing of the door once opened, the hinge device 1 may further include counteracting elastic means, for example a spring 50, acting on the slider 20 to automatically return it from one between the compressed and extended end position and the other between the compressed and extended end position.

For example, in the embodiment shown in FIGS. 1 to 4*b*, the spring 50 acts on the slider 20 to return it from the extended end position to the compressed end position, which represents the rest position or maximum elongation of the spring 50.

On the other hand, in the embodiment shown in FIGS. 5*a* and 5*b*, the spring 50 acts on the slider 20 in the exactly contrary way, returning it from the compressed end position to the extended end position, which represents the rest position or maximum elongation of the spring 50.

Even if in the embodiments shown in FIGS. 1 to 22*c* and from 28 to 34*c* all hinge devices 1 include a single spring 50, it is understood that the counteracting elastic means may include also more springs or alternative means, for example a pneumatic cylinder, without departing from the scope of the invention defined by the appended claims.

The spring 50 may have any position along the axis Y. For example, in the embodiment shown in FIGS. 1 to 4*b* it is interposed between the end 23 of the slider 20 and an abutment wall 35 of the chamber 30.

On the other hand, it may be interposed between the pivot 40 and the end 23 of the slider 20, such as for example in the embodiment shown in FIGS. 7 to 12*c*.

The spring 50 may be then internal to the pivot 40, such as for example in the embodiment shown in FIGS. 15 to 22*c*.

In order to minimize the mutual frictions, the hinge device according to the invention may include at least one anti-friction element, which may be interposed between the movable and the fixed part of the hinge device.

Suitably, the at least one anti-friction element may include at least one annular bearing, while the box-like hinge body 31 may include at least one support portion to support the at least one annular bearing.

All embodiments of the invention may include a first support portion 200 positioned in correspondence of an end 210 of the box-like hinge body 31 to be loaded by the closing element D during use through the movable plate 10. The first support portion 200 is suitable to support a first annular bearing 220 interposed between the same first support end portion and the movable connecting plate 10.

Suitably, the movable connecting plate 10 may have a loading surface 230 susceptible to came into contact with the first annular bearing 220, in such a manner to rotate thereon.

The first annular bearing 220 which is positioned on the first support portion 200 of the hinge body 31 is suitable to support the load of the closing element D, so as to leave the pivot 40 free to rotate around the axis X with minimum friction. In other words, the pivot 40 is not loaded by the closing element D, which load is fully supported by the hinge body 31.

Figure 39A:
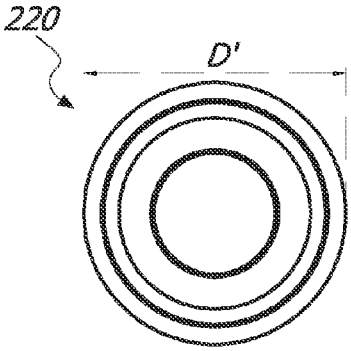
FIGS. 39*a* and 39*b* show respectively a top view and a radially sectioned view of the axial-radial first annular bearing 220.
Figure 39B:
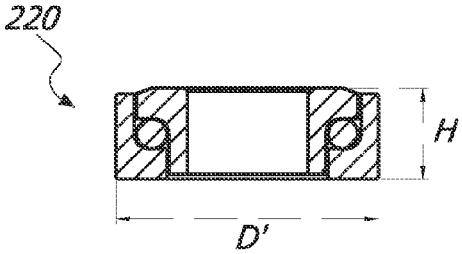

To this end, the first annular bearing 220 is of the radial-axial type, so as to support both the axial and the radial load of the closing element D. In FIGS. 39*a* and 39*b* there are shown a top and sectioned views of this kind of bearing.

Figure 37:
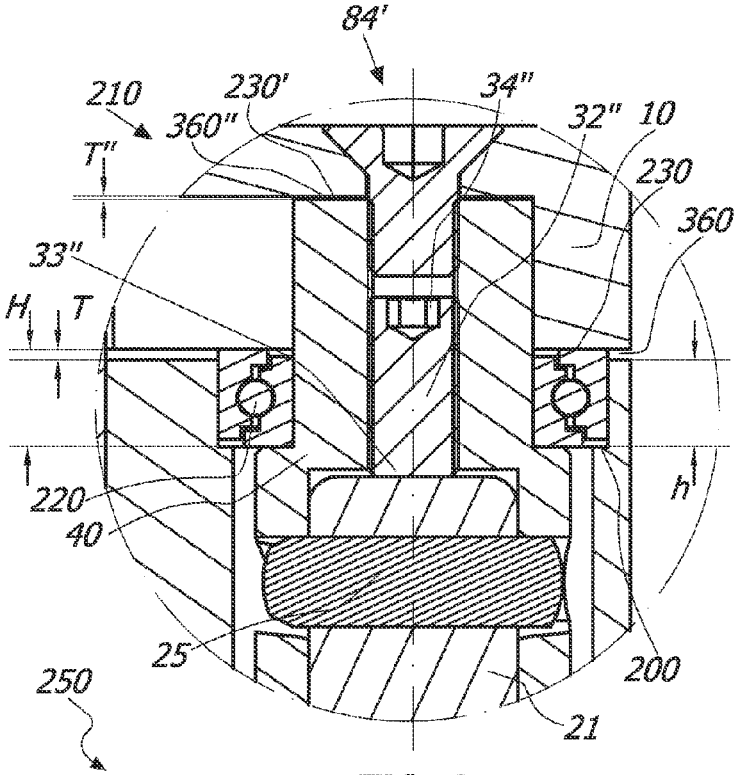
FIG. 37 shows an enlarged view of some enlarged particulars of FIG. 2*c;*

In order to maximize the anti-friction effect, the first annular bearing 220 and the first support end portion 200 may be configured and/or in a mutual spaced relationship so that during use the movable element 10 is spaced apart from the box-like hinge body 31, thus defining an interspace 360 as shown in FIG. 37. Indicatively, the interspace 360 may have a thickness T of about 0.5 mm.

The first annular bearing 220 may have a first outer diameter D' and a first height H, while the first support end portion 200 may be defined by an annular recess having a diameter substantially matching the first outer diameter D' of the first annular bearing 220 and a second height h.

Suitably, the first height H may be higher than the second height h. The thickness T of the interspace 360 may be defined by the difference between the first height H of the first annular bearing 220 and the second height h of the first support end portion 200.

In some preferred, non-exclusive embodiment of the invention, the hinge body 31 may include a couple of first annular axial-radial bearings 220, 220' positioned in correspondence of a respective couple of first support end portions 200, 200' located at both ends 210, 210' thereof.

In this manner, the hinge device of the invention may be reversible, i.e. may be turned upside down by maintaining the same anti-friction properties on both ends.

Suitably, the connecting plate 10 may include a couple of loading surfaces 230, 230' each susceptible to came into contact with a respective first annular bearing 220, 200' of said couple. In order to maximize the anti-friction effect, the first annular bearings 220, 220' and the couple of first support end portions 200, 200' may be configured and/or may be in a mutual spaced relationship so that the loading surfaces 230, 230' of the movable connecting plate 10 are both spaced apart from the box-like hinge body 31, so as to define respective interspaces 360, 360' having thickness T.

Advantageously, the hinge device 1 of the invention may comprise a second support portion 240 within the working chamber 30 to be loaded by the pivot 40 during use. The second support portion 240 may support a second annular bearing 250 interposed between the same second support portion 240 and the pivot 40.

The second annular bearing 250 may have a second outer diameter D" and a third height H', while the second support end portion 240 may be defined by an annular projecting bracket having a maximum diameter D'" substantially matching the second outer diameter D" of the second annular bearing 250. The second annular end portion may define a central bore 240' suitable for the passage of the slider 20 and/or the first and/or second pin 25, 27.

Suitably, the pivot 40 may have a loading surface 260 susceptible to came into contact with the second annular bearing 250 in such a manner to rotate thereon.

Figure 38A:
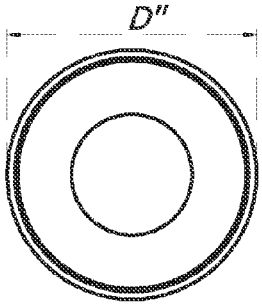
FIGS. 38*a* and 38*b* show respectively a top view and a radially sectioned view of the axial second annular bearing 250.
Figure 38B:
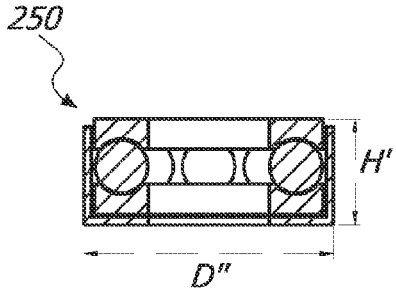

Advantageously, the second annular bearing 250 may be of the axial type. In FIGS. 38*a* and 38*b* there are shown a top and a sectioned view of this kind of bearings. On the other hand, the second annular bearing 250 may be of the axial-radial type, as shown in FIG. 39*d*.

Without being bound by any theory, it is possible to establish that in the embodiments of the invention which include the tubular bushing 300 the second annular bearing 250 may be of the axial type, while in the embodiments of the invention which do not include the tubular bushing 300 the second annular bearing 250 may be of the radial-axial type.

Figure 39C:
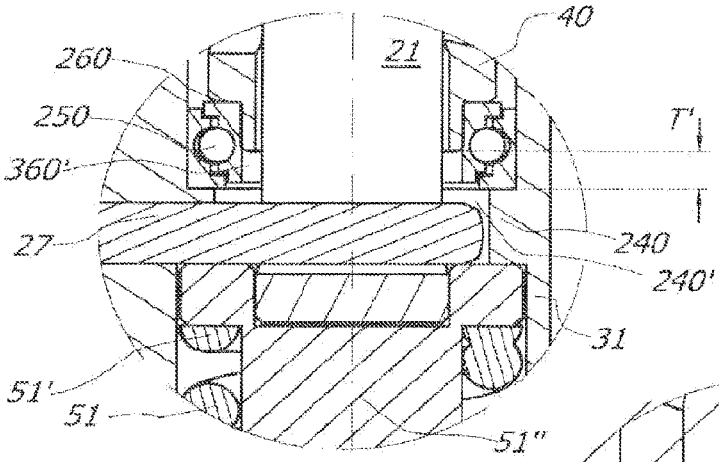
FIG. 39*c* shows an enlarged view of some enlarged particulars of FIG. 2*c;*
Figure 39D:
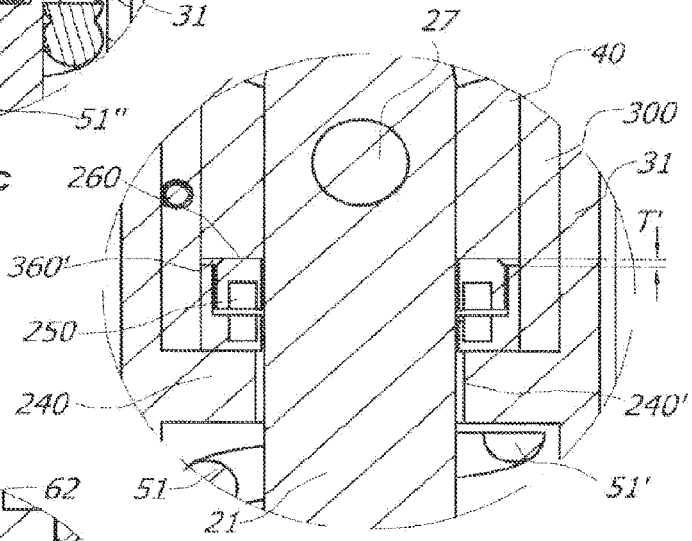
FIGS. 39*d* and 39*e* show respective enlarged views of some enlarged particulars of FIG. 43*b;*
Figure 39E:
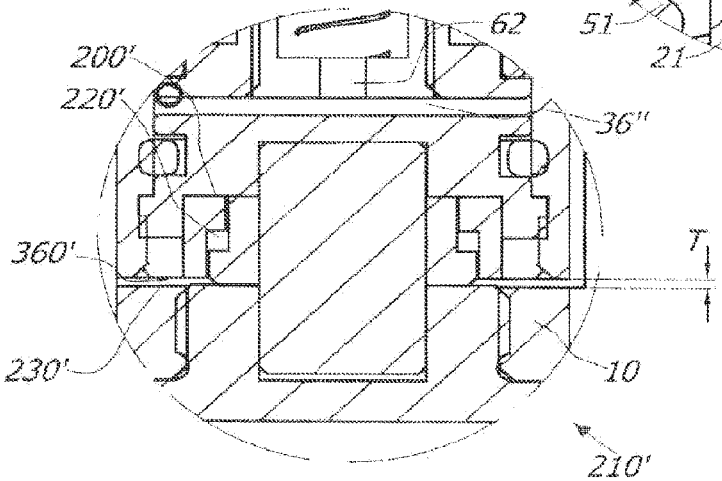

In order to maximize the anti-friction effect, the second annular bearing 250 and the pivot 40 may be configured and/or may be in a mutual spaced relationship so that the pivot 40 remains spaced apart from the second support portion 240, thus defining an interspace 360' as shown in FIGS. 39*c* and 39*d*.

In this manner, no part of the pivot 40 is in contact with the hinge body 31. In another words, the pivot 40 has both ends interposed between the first and the second annular bearings 220, 250.

FIG. 37 clearly shows that the upper part of the first annular bearing 220 is the only part in mutual contact with the loading surface 230 of the movable connecting plate 10. Therefore, the load of the closing element D is fully supported by the hinge body 31.

Moreover, in order to maximize the anti-friction effect, the pivot 40 and the first annular bearing 220 may be configured and/or may be in a mutual spaced relationship so that during use the upper end of the pivot 40 remains spaced apart from the second loading surface 230' of the connecting plate 10, thus defining an interspace 360" as shown in FIG. 37. Indicatively, the interspace 360" may have a thickness T" of about 0.5 mm.

Thanks to this feature, the pivot 40 is completely free to rotate without any friction effect imparted by the load of the closing element D.

Moreover, the pivot 40 is also free from the friction effect imparted by the elastic means 50, which "push" or "pull" the pivot against the second support portion 240.

In the embodiments of the hinge device 1 that include the counteracting elastic means 50 located within the working chamber 30 outside the pivot 40, such as the one shown in FIGS. 1, 7 and 10, the second support portion 240 may be susceptible to separate the working chamber 30 into a first and second areas 270, 270'.

Figure 42A:
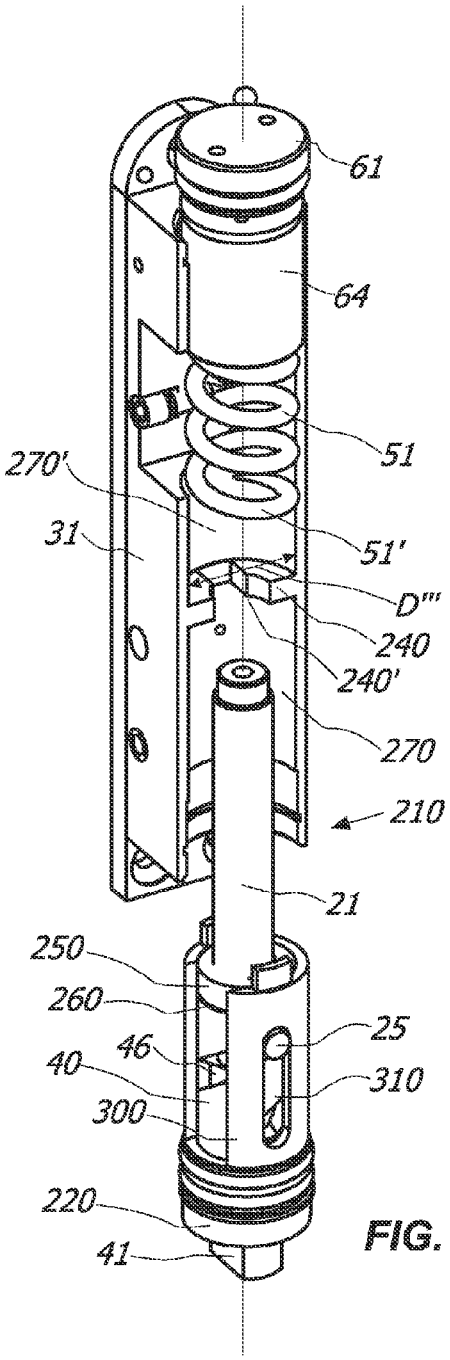
FIG. 42*a* is an exploded partly axially sectioned view of a further embodiment of the invention, in which the pivot 40 defines the fixed element and the hinge body 31 defines the movable element.
Figure 42B:
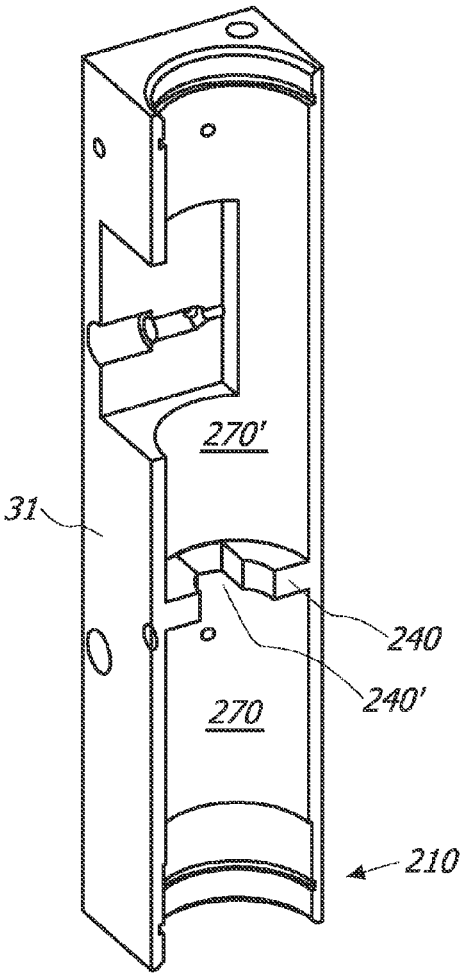
FIG. 42*b* is a perspective partly sectioned view of the hinge body 31 of the embodiment shown in FIG. 42*a*, clearly showing the second supporting portion 240.
Figure 43A:
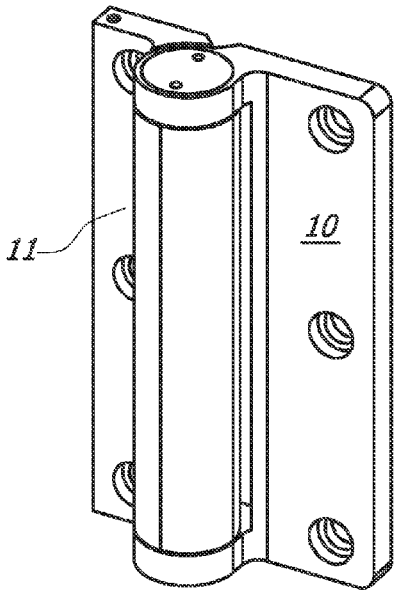
FIGS. 43*a*, 43*b* and 43*c* are respectively perspective, sectioned along a plane XLIII b-XLIII b and top views of a further embodiment of the hinge device according to the invention, in which the closing element D is in the closed position.
Figure 43B:
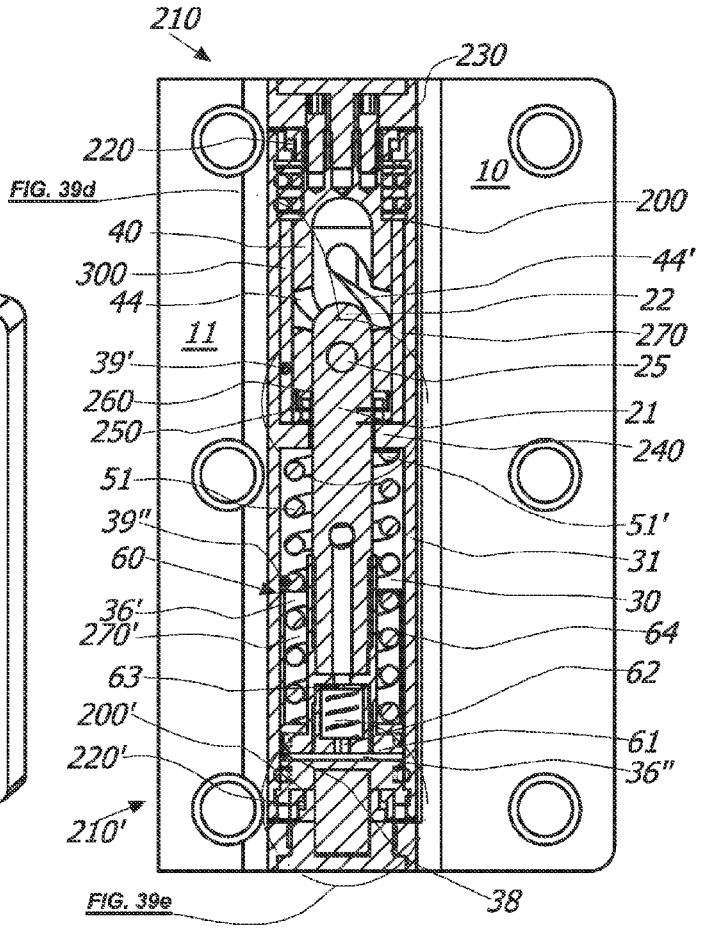
Figure 43C:
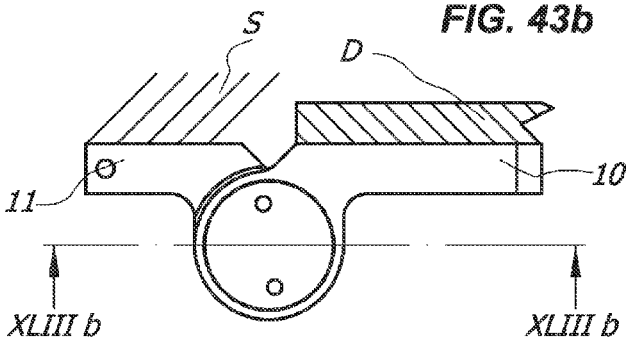
Figure 44A:
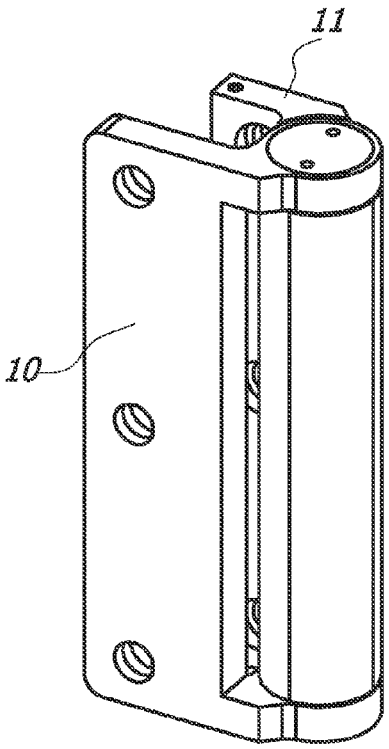
FIGS. 44*a*, 44*b* and 44*c* are respectively perspective, sectioned along a plane XLIV b-XLIV b and top views of the embodiment of the hinge device according to FIG. 43*a*, in which the closing element D is in the completely open position.
Figure 44B:
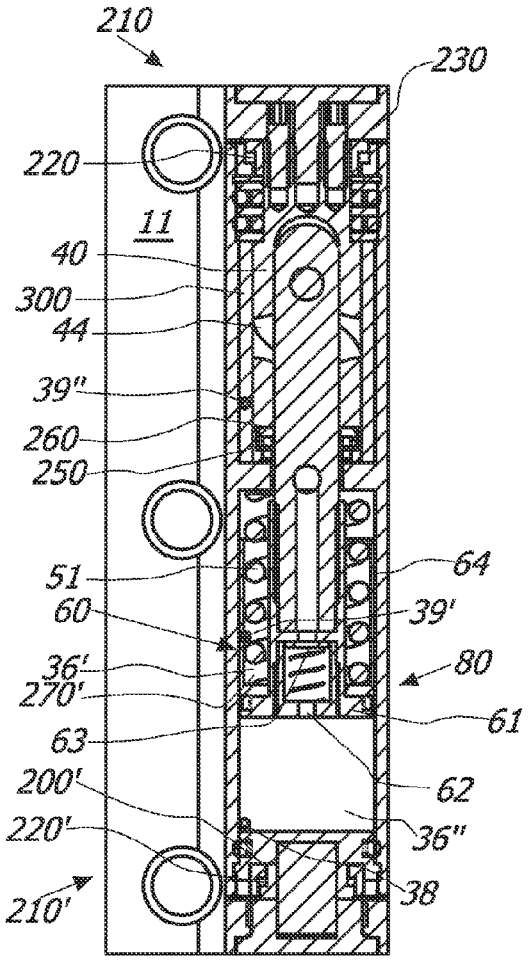
Figure 44C:
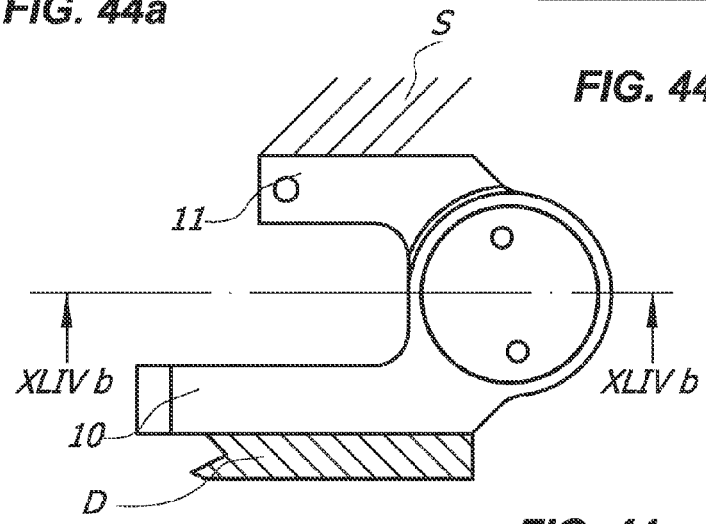

As particularly shown in FIGS. 42*a* and 42*b*, the pivot 40 and possibly the second annular bearing 250 may be housed into the first area 270, while the counteracting elastic means 50 may be housed in the second area 270'.

In this manner, the pivot 40 and the counteracting elastic means 50 are mutually separated by the second support portion 240. Therefore, the rotation of the pivot 40 does not affect the action of the elastic means 50, which work independently each other.

Moreover, the counteracting elastic means 50 have not loss of force due to frictions, since the pivot 40 rotate on the annular bearing 250 which is positioned onto the second support portion 240.

In this manner, it is possible to use the full force of the elastic means 50 for all the path of the single guide element 46.

For example, thanks to this feature it is possible to use a single guide element 46 including a single helical portion 44', 44" having constant slope and extending for 180° along the cylindrical portion 42, so as to obtain a closing element D which opens for 180°.

Advantageously, the counteracting elastic means 50 may include a spring 51 having one end 51'.

Suitably, the end 51' of the spring 51 may directly interact with the second support portion 240. As an alternative, as e.g. shown in FIG. 1, a pressing element 51" can be interposed between the end 51' of the spring 51 and the second support portion 240.

Figure 15:
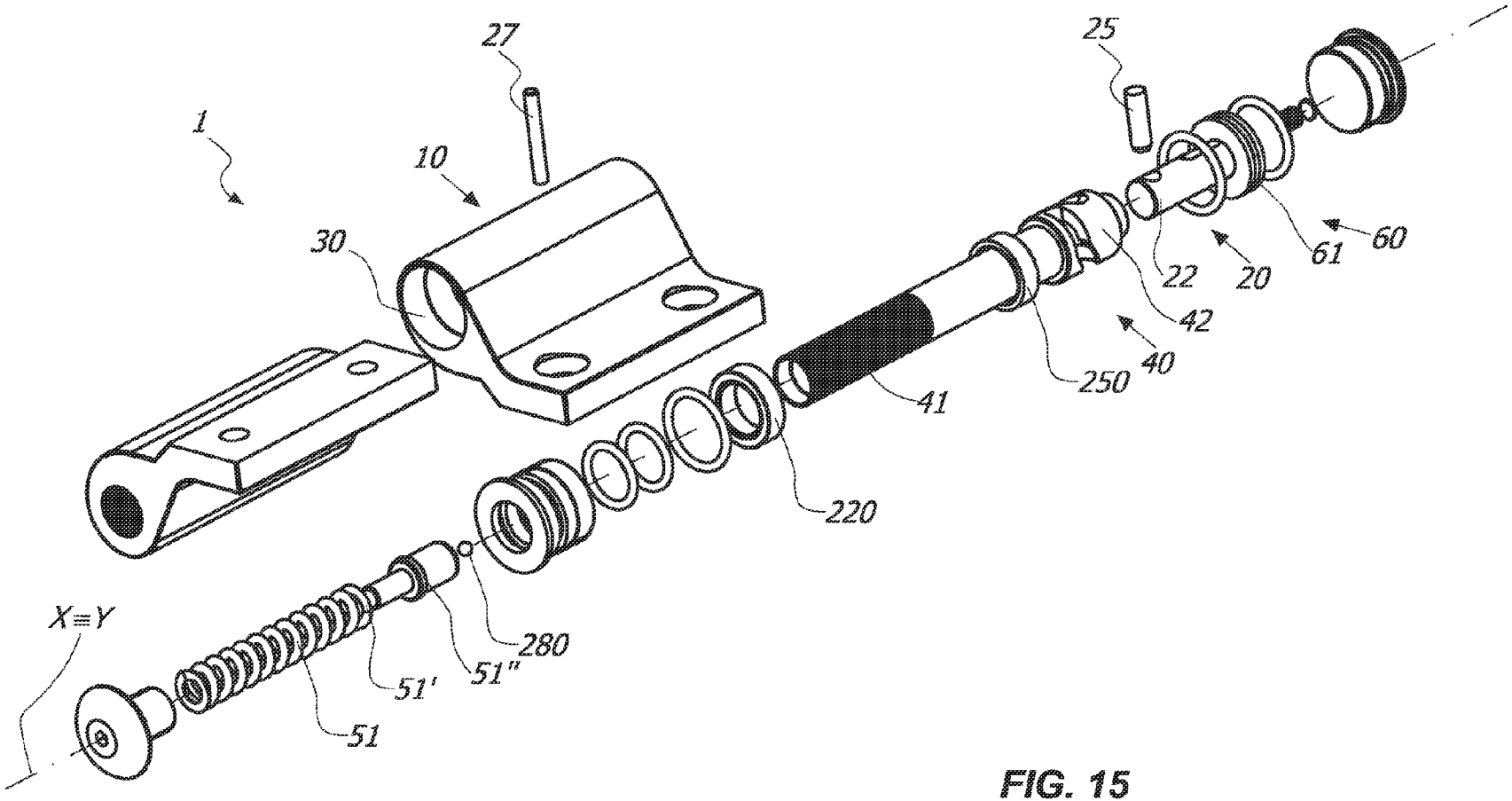
FIG. 15 is an exploded view of a further embodiment of the hinge device 1.
Figure 16A:
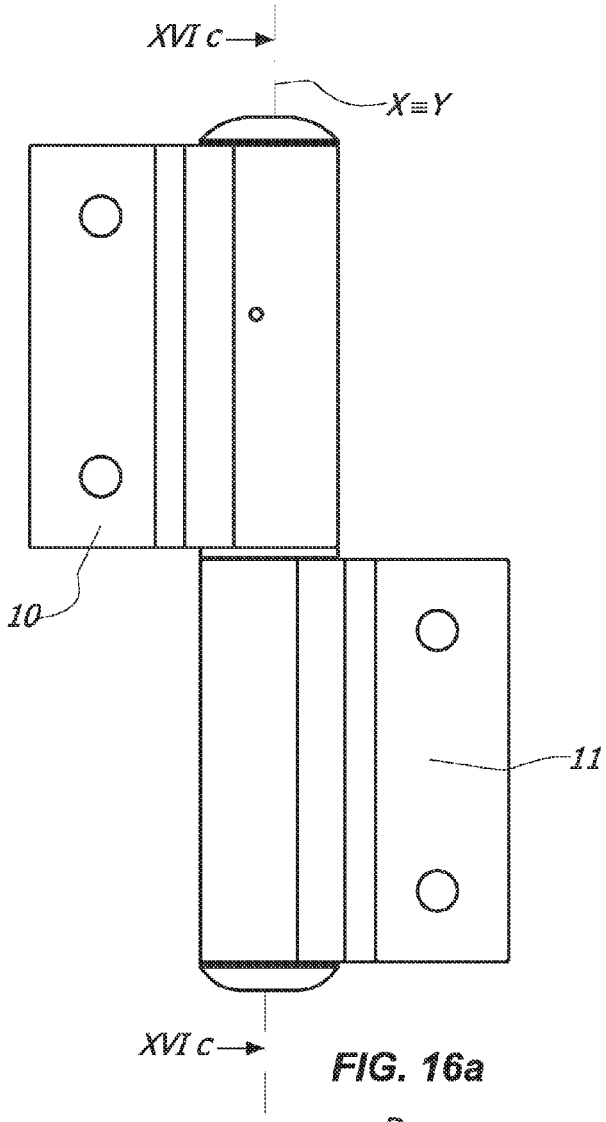
FIGS. 16*a*, 16*b* and 16*c* are respectively front, bottom and sectioned along a plane XVIc-XVIc views of the embodiment of the hinge device 1 of FIG. 15, with the movable element 10 in the closed position.
Figure 16C:
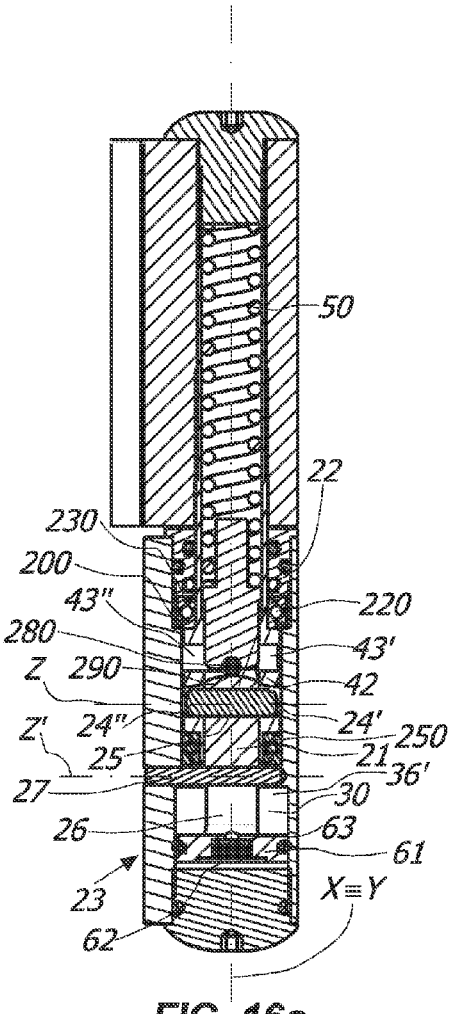
Figure 16B:
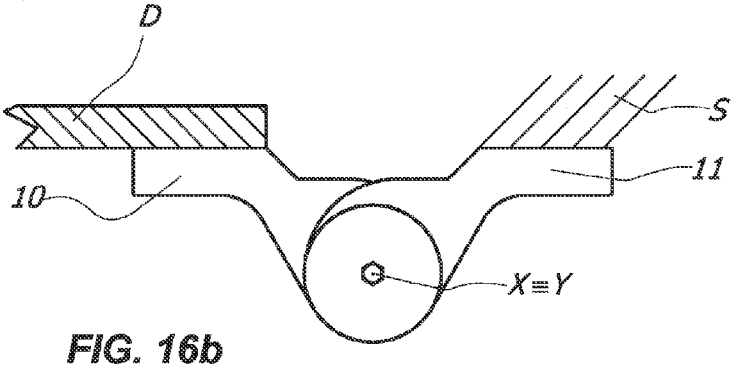
Figure 17A:
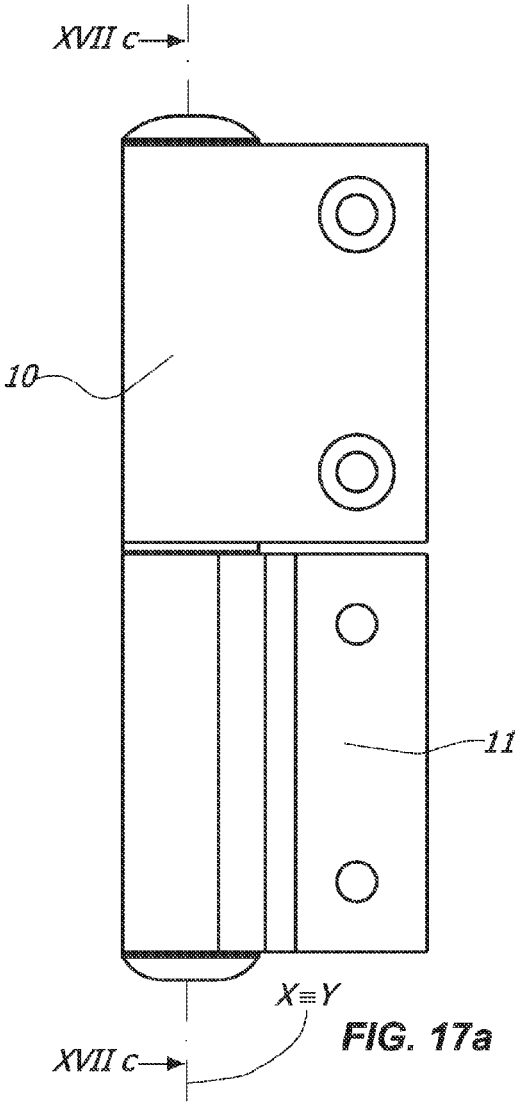
FIGS. 17*a*, 17*b* and 17*c* are respectively front, bottom and sectioned along a plane XVIIc-XVIIc views of the embodiment of the hinge device 1 of FIG. 15, with the movable element 10 in the open position.
Figure 17C:
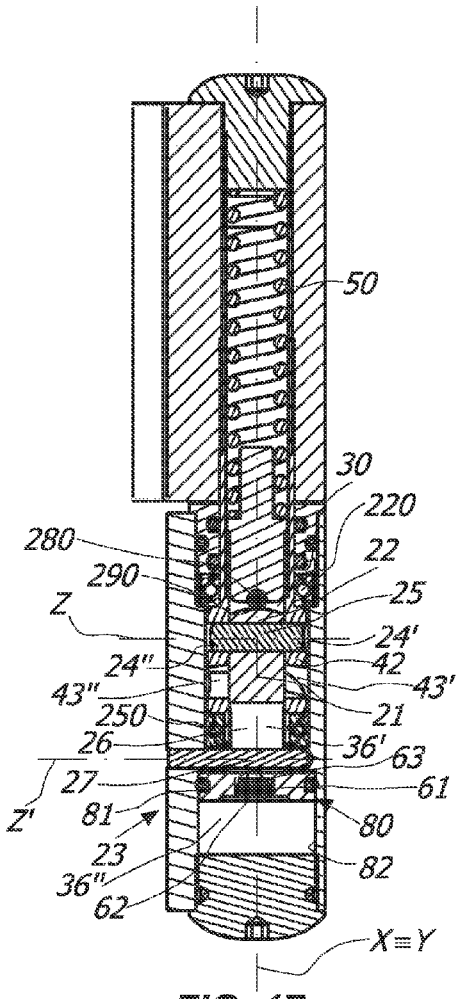
Figure 17B:
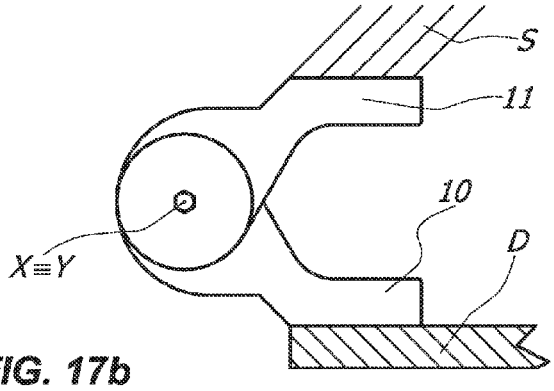
Figures 18A, 18B, 18C, 19A, 19B, 19C:
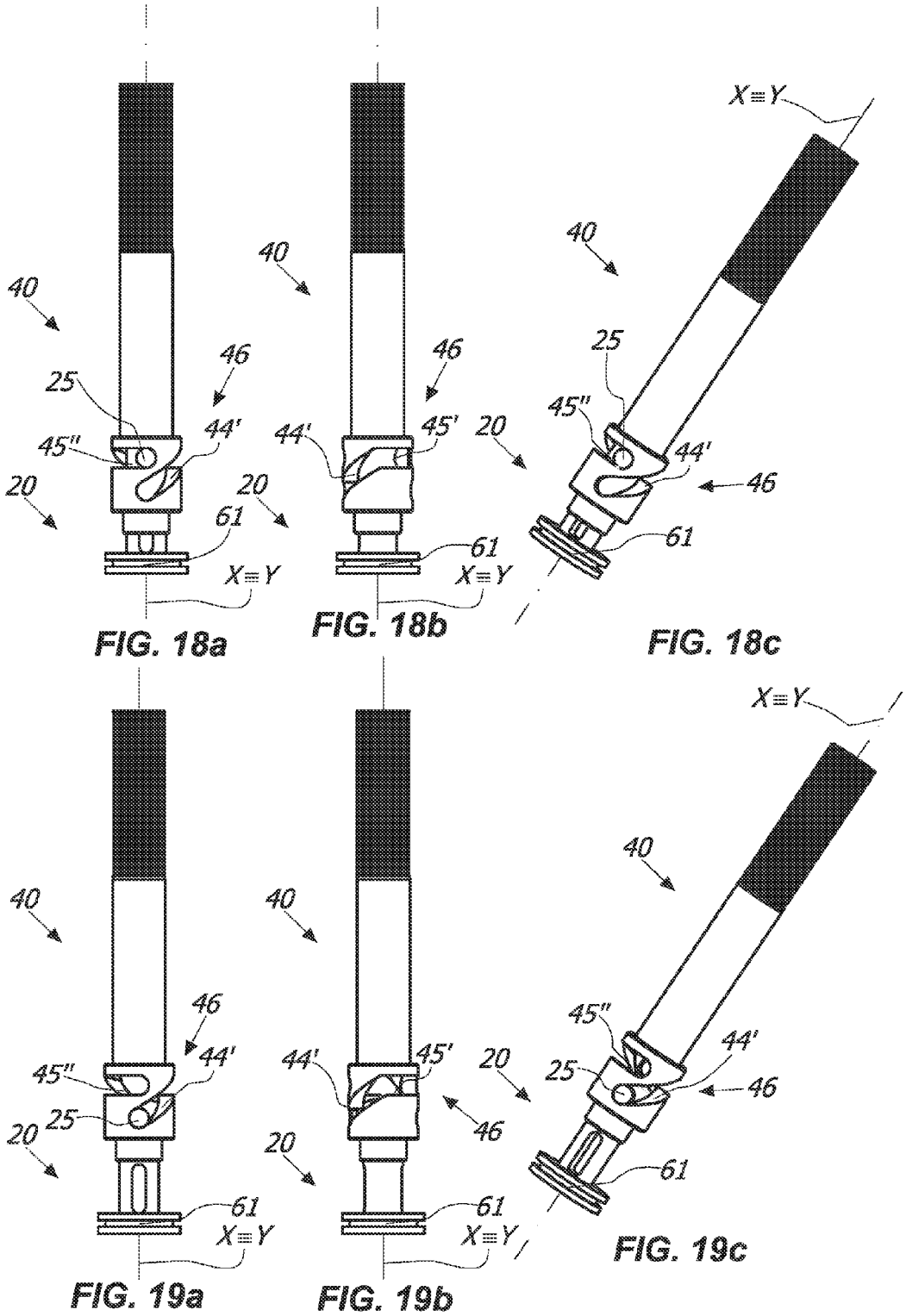
FIGS. 18*a*, 18*b* and 18*c* are respectively front, back and axonometric views of the assembly slider 20-pivot 40 (the spring 50 is internal to the pivot 40) of the embodiment of the hinge device 1 of FIG. 15, wherein the slider 20 is in the compressed end position.
FIGS. 19*a*, 19*b* and 19*c* are views respectively frontal, back and axonometric of the assembly slider 20-pivot 40 (the spring 50 is internal to the pivot 40) of the embodiment of the hinge device 1 of FIG. 15, wherein the slider 20 is in the extended end position.
Figure 20:
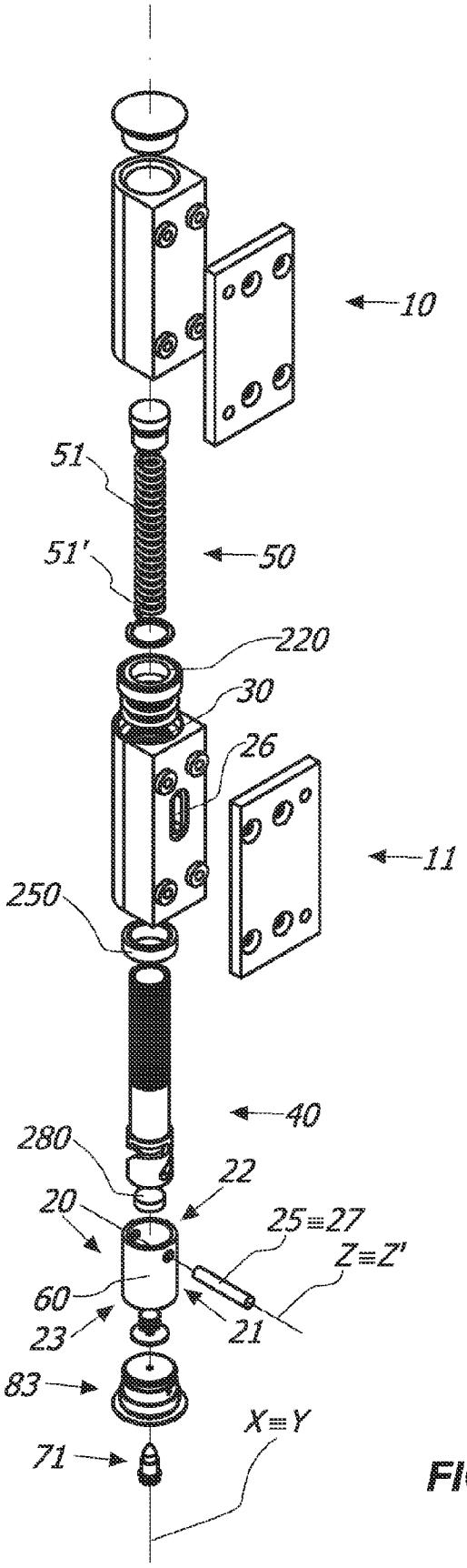
FIG. 20 is an exploded view of a further embodiment of the hinge device 1.
Figure 21A:
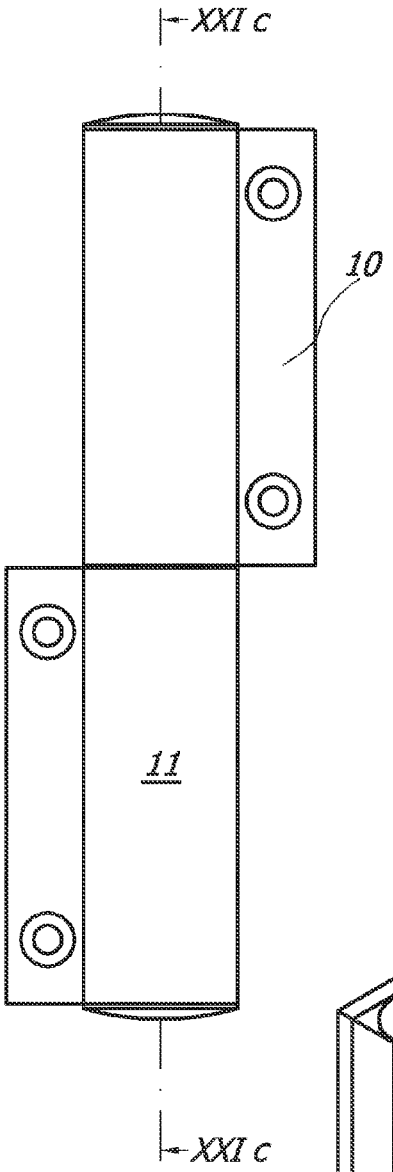
FIGS. 21*a*, 21*b* and 21*c* are respectively front, axonometric and sectioned along a plane XXIc-XXIc views of the embodiment of the hinge device 1 of FIG. 20, with the movable element 10 in the closed position.
Figure 21C:
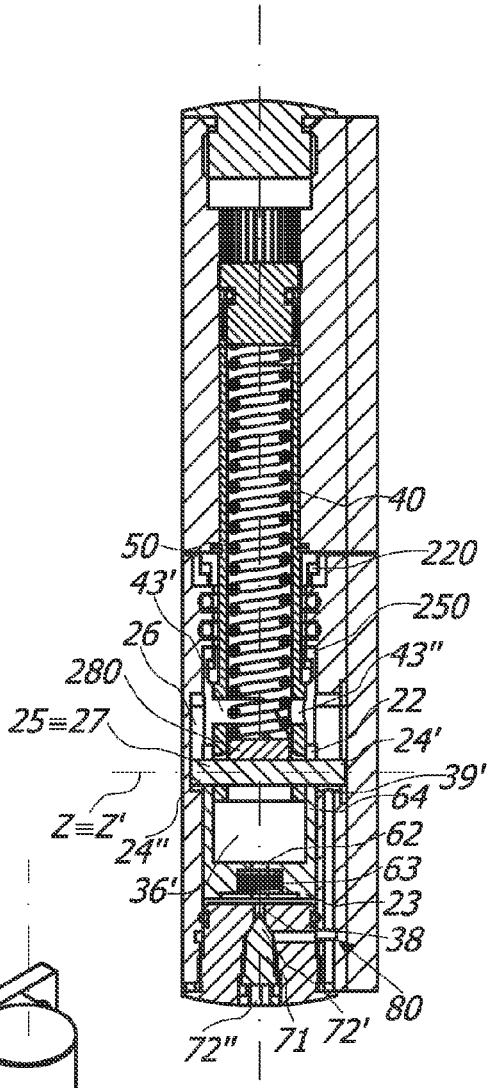
Figure 21B:
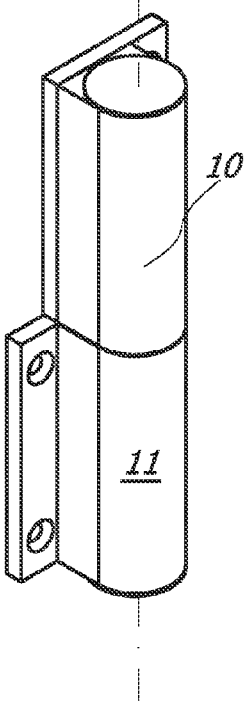
Figure 22A:
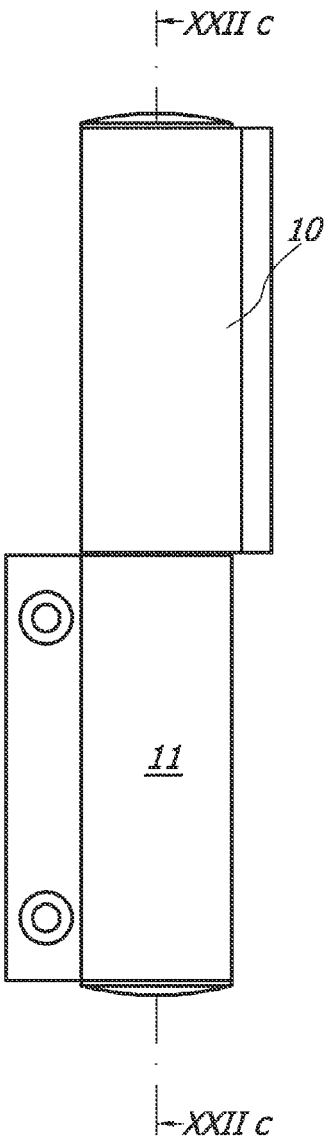
FIGS. 22*a*, 22*b* and 22*c* are respectively front, axonometric and sectioned along a plane XXIIc-XXIIc views of the embodiment of the hinge device 1 of FIG. 20, with the movable element 10 in the open position.
Figure 22C:
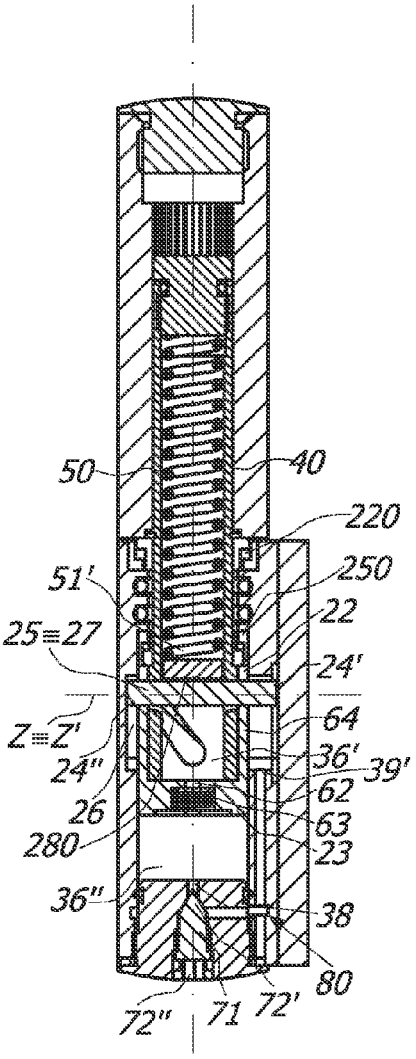
Figure 22B:
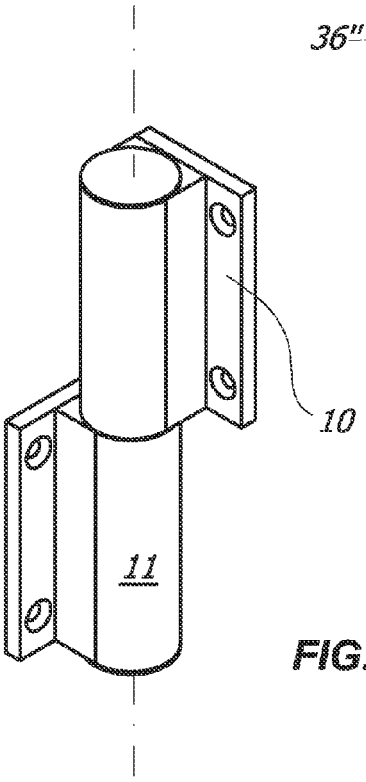

In case of hinge device 1 including the counteracting elastic means 50 located within the pivot 40, such as the one shown in FIGS. 15 and 20, the anti-friction element may be an anti-friction interface member 280 interposed between the counteracting elastic means 50 and the slider 20.

Suitably, the first end 22 of the slider 20 has a round surface, while the anti-friction interface member 280 has a contact surface 290 interacting with the rounded first end 22.

Advantageously, the anti-friction interface member 280 may have a spherical of discoidal shape, such as respectively in the embodiments of FIGS. 15 and 20.

Advantageously, the slider 20 may comprise a plunger element 60 movable in the operating chamber 30 along the axis Y. Appropriately, in some embodiments, such as for instance those shown in FIGS. 20, 23 and 32, the slider 20 may be defined by the plunger element 60.

Moreover, the chamber 30 may include a working fluid, for example oil, acting on the plunger element 60 to hydraulically counteract the action thereof, so as to control the action of the movable element 10 from the open to the closed position.

The presence of the plunger element 60 and of the oil may be independent from the presence of the counteracting elastic means 50.

Figure 23:
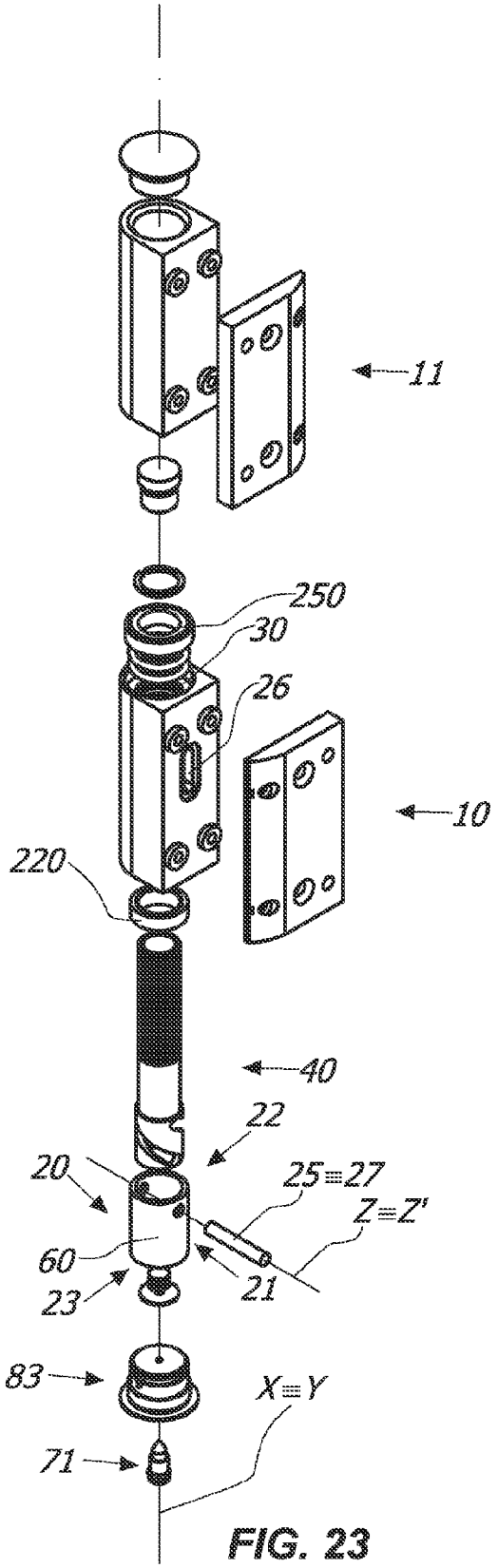
FIG. 23 is an exploded view of a further embodiment of the hinge device 1.
Figure 24A:
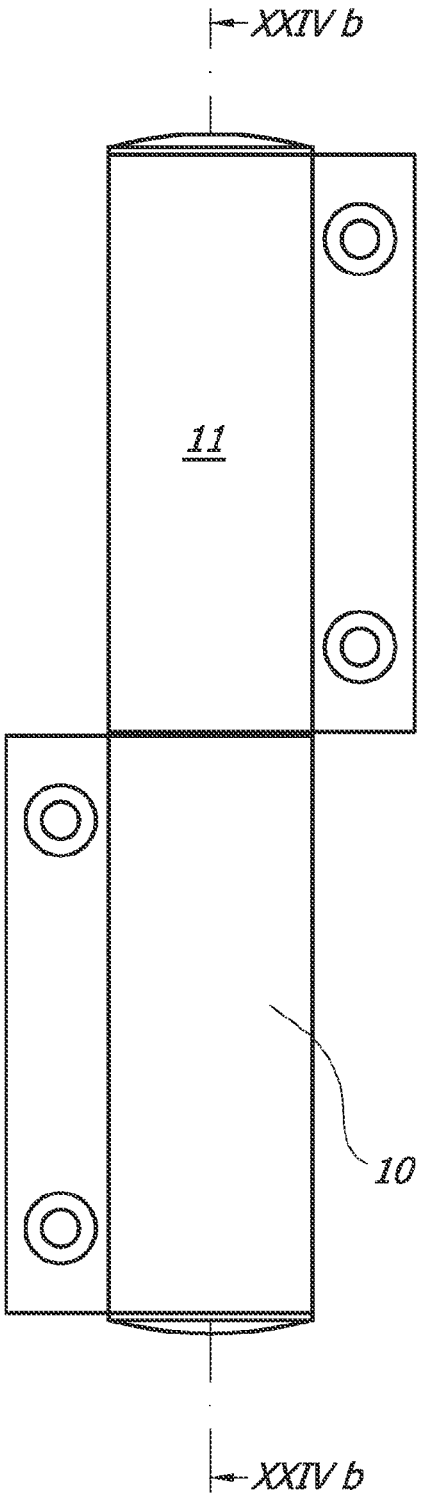
FIGS. 24*a* and 24*b* are respectively front and sectioned along a plane XXIVb-XXIVb views of the embodiment of the hinge device 1 of FIG. 23, with the movable element 10 in the closed position.
Figure 24B:
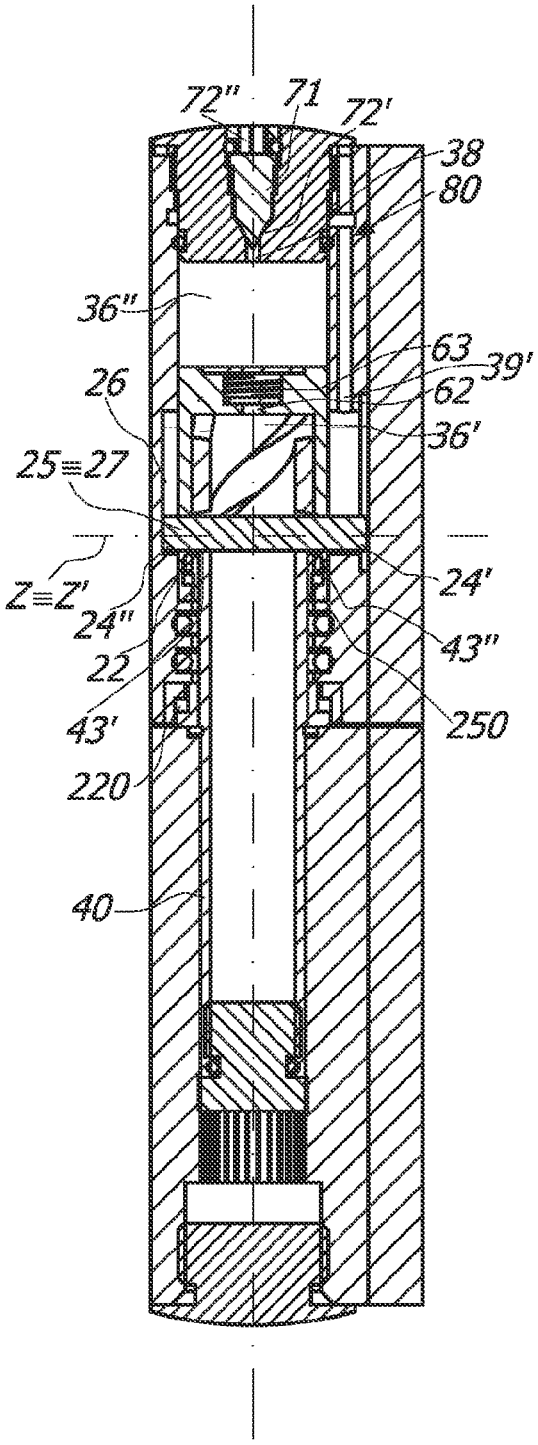
Figure 25A:
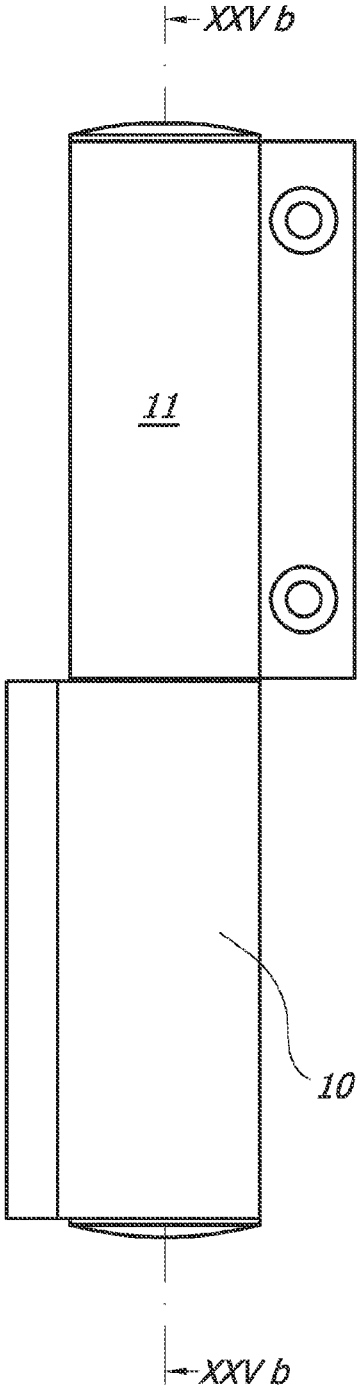
FIGS. 25*a* and 25*b* are respectively front and sectioned along a plane XXVb-XXVb views of the embodiment of the hinge device 1 of FIG. 23, with the movable element 10 in the open position.
Figure 25B:
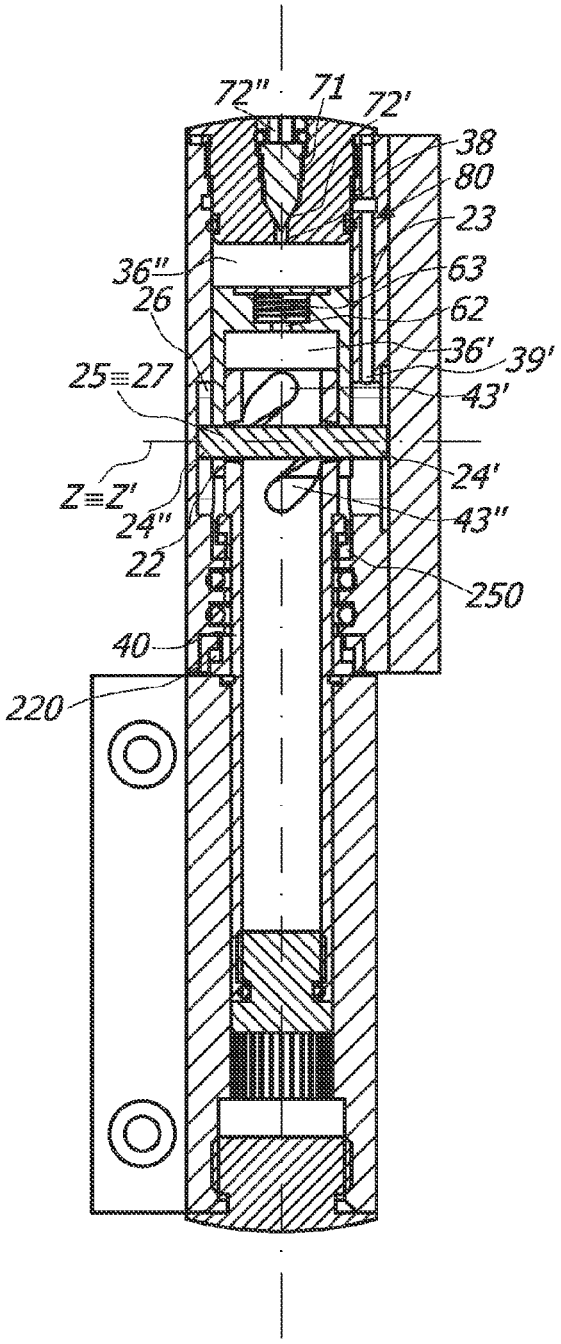
Figure 26A:
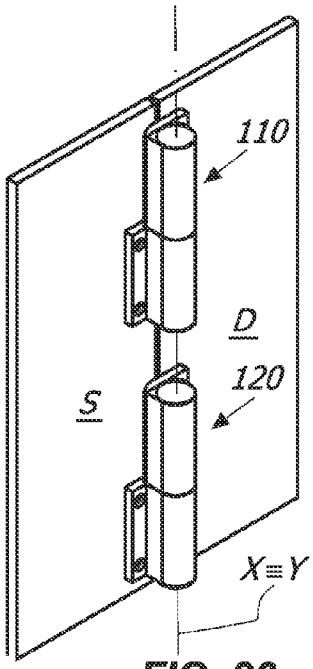
FIGS. 26*a*, 26*b*, 26*c* and 26*d* are respectively an axonometric view, a top view, a view of the assembly slider 20-pivot 40 and a sectioned view of another embodiment of an assembly 100 for the controlled automatic closing of a closing element D, in the closed position thereof, wherein the hinge 110 is configured according to the embodiment shown in FIGS. 23 to 25*b* and the hinge 120 is configured according to the embodiment shown in FIGS. 20 to 22*c;*
Figure 26B:
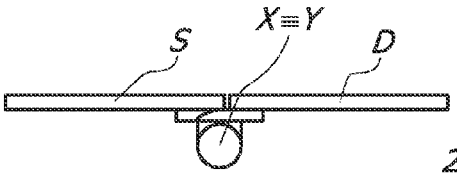
Figure 26C:
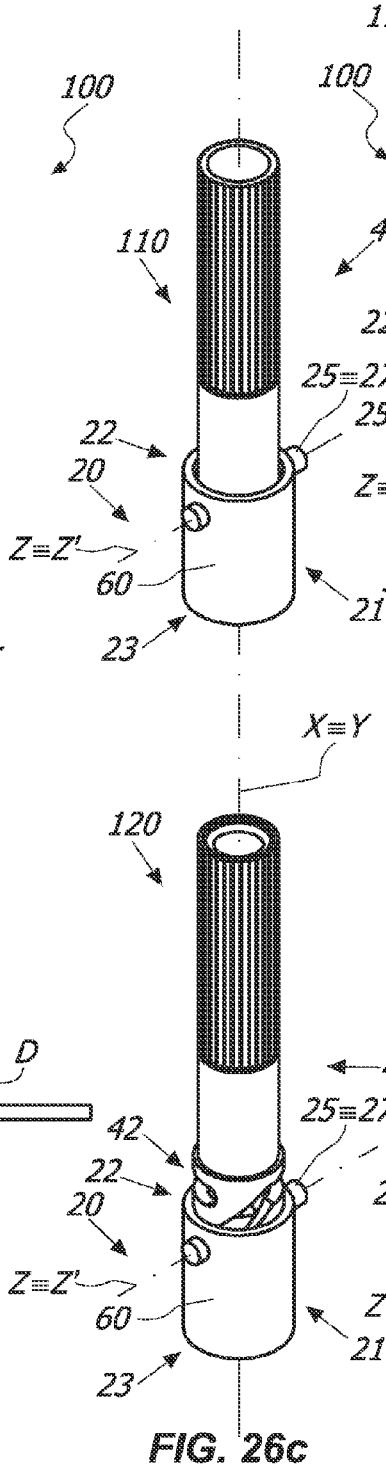
Figure 26D:
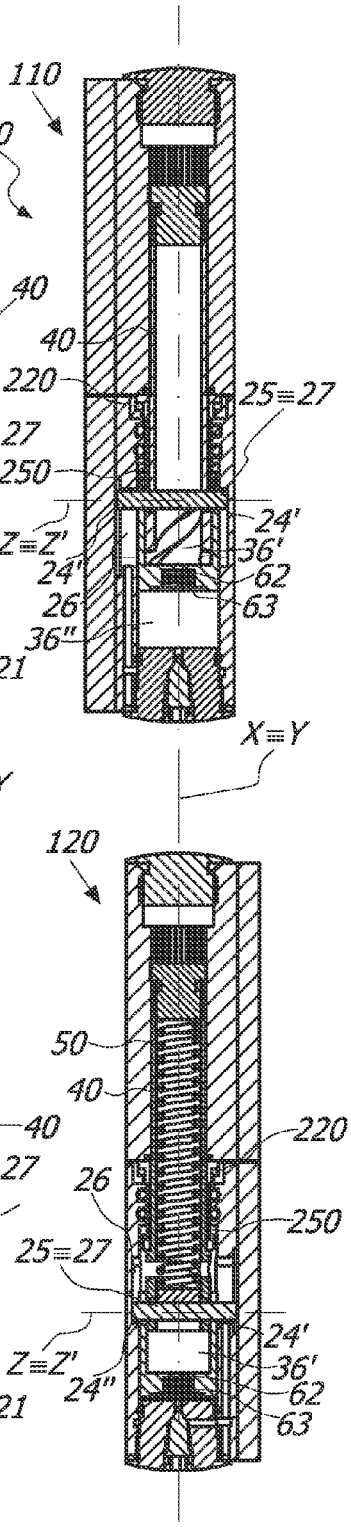

For example, the embodiments shown in FIGS. 1 to 5*b* do not include the plunger element 60 and the oil, whereas the embodiment shown in FIG. 23 does not include the counteracting elastic means 50 but include the plunger element 60 and of the oil. Therefore, whereas the first embodiments act as a hinge or a purely mechanical door closer with automatic system, the second embodiment acts as a hinge-hydraulic brake, to be possibly used with an automatic closing hinge.

Appropriately, the operating chamber 30 may preferably comprise a pair of set screws 32', 32" housed in opposite parts 84', 84" of the hinge body 31.

Each set screw 32', 32" may have a first end 33', 33" interacting with the slider 20 to adjust its sliding along the axis Y. Each set screw 32', 32" may further have a second end 34', 34" operable from the outside by a user.

In this way, the user can easily adjust the closing angle of the closing element D.

On the other hand, the hinge device 1 may include the plunger element 60 as well as the relative oil and the counteracting elastic means 50, such as for instance in the embodiments shown in FIGS. 7 to 19*c*. In this case, these hinge devices act as a hydraulic hinge or door closer with automatic closing.

Advantageously, the plunger element 60 may comprise a pushing head 61 configured to separate the operating chamber 30 a first and a second variable volume compartment 36', 36", preferably fluidically connected to one another and adjacent.

In order to allow the flow of the working fluid from the first compartment 36' to the second compartment 36" during the opening of the closing element D, the pushing head 61 of the plunger element 60 may comprise a passing through hole 62 to put into fluidic communication the first and the second compartment 36', 36".

Moreover, in order to prevent the backflow of the working fluid from the second compartment 36" to the first compartment 36' during the closing of the closing element D, valve means may be provided, which may comprise a check valve 63, which may preferably be of the one way normally closed type to open exclusively upon the opening of the closing element D.

Advantageously, the check valve 63 may include a disc 90 housed with a minimum clearance in a suitable housing 91 to axially move along the axis X and/or Y, with a counteracting spring 92 acting thereon to keep it normally closed. Depending from the sense in which the check valve 63 is mounted, it may open upon the opening or closing of the closing element D.

For the controlled backflow of the working fluid from the second compartment 36" to the first compartment 36' upon the closing of the closing element D, an appropriate hydraulic circuit 80 may be provided.

In the embodiments shown in FIGS. 7 to 9*c* and from 15 to 17*c*, the plunger element 60 may be housed with a predetermined clearance in the operating chamber 30. In these embodiments, the backflow hydraulic circuit 80 may be defined by the tubular interspace 81 between the pushing head 61 of the plunger element 60 and the inner surface 82 of the operating chamber 30.

In this case, the return speed of the working fluid from the second compartment 36" to the first compartment 36' may be predetermined and not adjustable, defined in practice by the dimensions of the backflow interspace 81. Moreover, it is not possible to have the latch action of the closing element D towards the closed position.

On the other hand, in the embodiments shown in FIGS. 10 to 12*c*, the plunger element 60 may be tightly housed in the operating chamber 30. In this embodiment, the backflow circuit 80 may be made within the hinge body 31.

In the embodiments shown in FIGS. 20 to 25*b*, for minimizing the bulk, the backflow circuit 80 may be made within the hinge body 31 and within the closing cap 83.

In the embodiment shown in FIGS. 28 to 31*b*, the backflow circuit 80 is made within the interspace 81 between the pivot 40 and the inner surface 82 of the operating chamber 30. With this aim, in correspondence of the closing cap 83, an interface element 85 appropriately shaped to keep in its position the pivot 40 and to define the inlet 38 of the circuit 80 may be inserted.

In these embodiments, the backflow speed of the working fluid from the second compartment 36" to the first compartment 36' may be adjustable by means of the screw 71, and further may be possibly possible to have the latch action of the closing element D towards the closed position. The force of the latch action is adjustable by means of the screw 70.

For this purpose, the hydraulic circuit may have an inlet 38 for the working fluid present in the second compartment 36" and one or more outlets thereof in the first compartment 36', respectively indicated with 39', 39", which may be fluidically connected in parallel.

The first and second outlets 39', 39" may control and adjust, respectively, the speed of the closing element D and its latch action towards the closed position.

For this purpose, the plunger element 60 may comprise a substantially cylindrical rear portion 64 unitary sliding therewith and facing the inner surface of the first compartment 36', which may remain decoupled to the first outlet 39' for the whole stroke of the plunger element 60. In other words, the cylindrical rear portion 64 of the plunger element 60 does not obstruct the first outlet 39' for its whole stroke.

On the other hand, the rear portion 64 of the plunger element 60 may be in a spatial relationship with the second outlet 39" so that the second outlet is fluidly coupled with the rear portion 64 for a first initial part of the stroke of the plunger element 60 and is fluidly uncoupled therefrom for a second final part of this stroke, so that the closing element latches towards the closed position when the movable connecting plate 10 is in proximity of the connecting plate 11.

In other words, the cylindrical rear portion 64 of the plunger element 60 obstructs the second outlet 39" for a first initial part of its stroke and does not obstruct the second outlet 39" for a second final part of its stroke.

Appropriately designing the parts, it is possible to adjust the latch position, which may normally take place when the movable element 10 is in a position comprised between 5° and 15° with respect to the closed position.

The screw 71 has a first end 72' interacting with the first outlet 39' to progressively obstruct it and a second end 72" operable from the outside by a user to adjust the flow speed of the working fluid from the second compartment 36" to the first compartment 36'.

On the other side, the screw 70 has a first end 73' interacting with the second outlet 39" to progressively obstruct it and a second end 73" operable from the outside by a user to adjust the force with which the closing element D latches towards the closed position.

FIG. 1 shows a mechanical hinge with automatic closing, which includes the counteracting elastic means 50 but does not include any working fluid. In this case, the spring 50 acts by putting into traction or by compressing the slider 20.

FIG. 7 shows a hydraulic hinge with automatic closing, which includes counteracting elastic means 50 as well as the working fluid acting on the plunger element 60. In this hinge the backflow circuit 80 of the working fluid into the first compartment 36' is defined by the interspace 81. The return speed is predetermined, and there is no possibility to have the latch action of the closing element D.

It is understood that in order to have the control of the speed in this last embodiment, it is necessary to tightly insert the plunger element 60 into the operating chamber 30 and to replace the backflow circuit 80 by making it within the hinge body 31, as for example in the embodiment of FIG. 10.

Moreover, if also the latch action of the closing element is desired, it is sufficient to mount on the plunger element 60 the cylindrical portion 64, as for example in the embodiment of FIG. 10.

As particularly shown in FIG. 7, this embodiment has flat portions 45', 45" which extend for 90° around the axis X, in correspondence of which the closing element remains blocked.

FIG. 10 shows a hydraulic hinge with automatic closing, which includes the counteracting elastic means 50 as well as the working fluid acting on the plunger element 60. In this hinge the backflow circuit 80 of the working fluid in the first compartment 36' is made within the hinge body 31. The return speed and the force of the latch action of the closing element D are adjustable by acting on the screws 70 and 71.

As particularly shown in FIG. 7, this embodiment has flat portions 45', 45" which extend for 90° around the axis X, in correspondence of which the closing element remains blocked.

In FIGS. 13*a* to 14*b* there are schematically shown some embodiments of assemblies 100 for the controlled automatic closing of a closing element D, which include a pair of hinges 110 and 120.

Figure 13A:
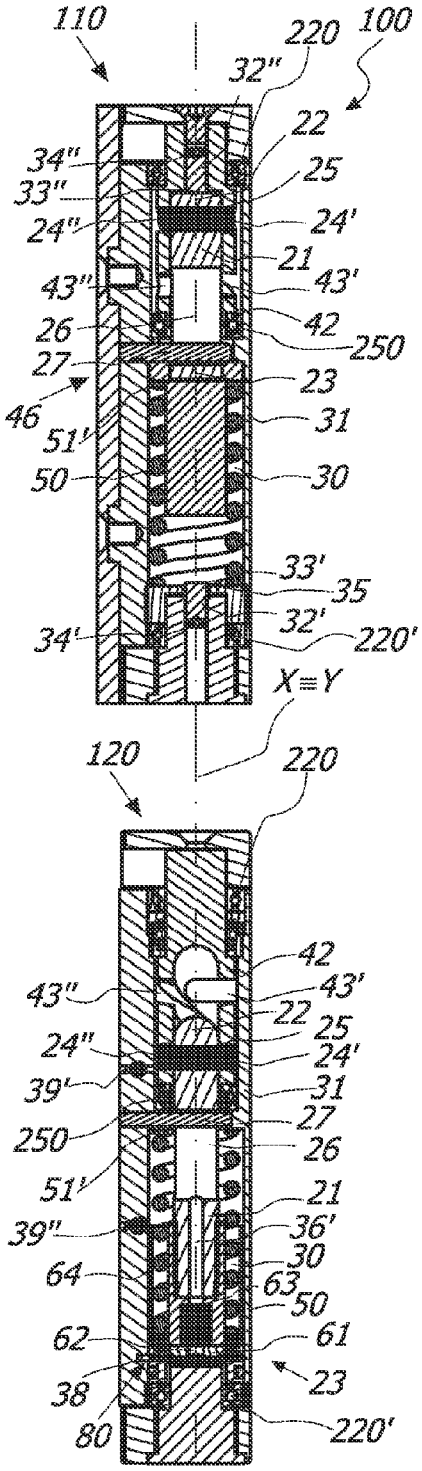
FIGS. 13*a* and 13*b* are sectional views of an embodiment of an assembly 100 for the controlled automatic closing of a closing element D, respectively in the closed and open position thereof, wherein the hinge 110 is configured according to the embodiment shown in FIGS. 1 to 3*c* and the hinge 120 is configured according to the embodiment shown in FIGS. 10 to 12*c;*
Figure 13B:
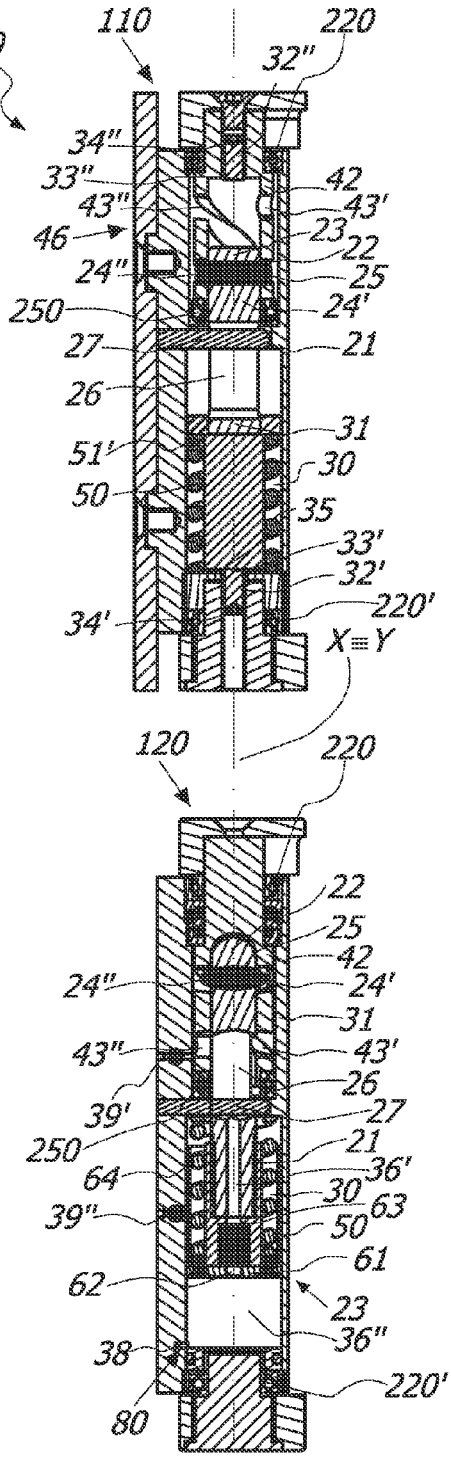

In the embodiment shown in FIGS. 13*a* and 13*b*, which show respectively the closed and open position of the closing element D, the hinge 110 is constituted by the mechanical hinge shown in FIG. 1, whereas the hinge 120 is constituted by the hydraulic hinge shown in FIG. 10.

In other words, in this assembly the spring 50 of the two hinges 110 and 120 cooperates with each other to close the closing element D once opened, whereas the oil present in the hinge 120 hydraulically damps this closing action.

In this embodiment, by acting on the set screws 32', 32" it is possible to adjust the opening and closing angle of the closing element D. In particular, by acting on the screw 32' it is possible to adjust the closing angle of the closing element D, whereas acting on the screw 32" it is possible to adjust the opening angle thereof.

Moreover, by appropriately acting on the screws 70 and 71 it is possible to adjust the closing speed and the force of the latch action of the closing element D.

Figures 14A, 14B, 14C, 14D:
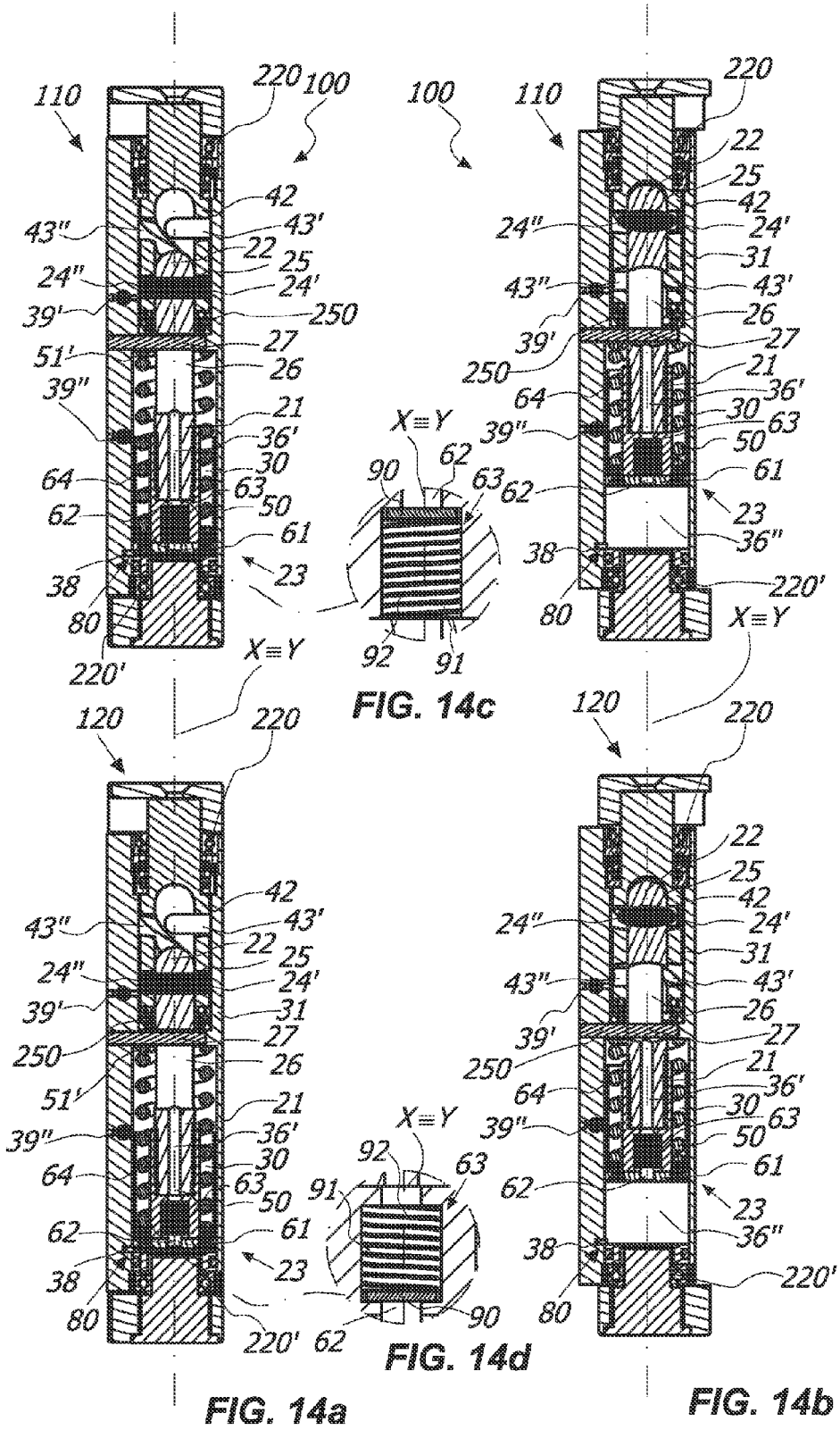
FIGS. 14*a* and 14*b* are sectional views of an embodiment of another assembly 100 for the controlled automatic closing of a closing element D, respectively in the closed and open position thereof, wherein both hinges 110 and 120 are configured according to the embodiment shown in FIGS. 10 to 12*c*, with in FIGS. 14*c* and 14*d* some enlarged particulars.

In the embodiment shown in FIGS. 14*a* and 14*b*, which depict respectively the closed and open position of the closing element D, both hinges 110 and 120 are constituted by the hydraulic hinge shown in FIG. 10.

In practice, in this assembly the springs 50 of the two hinges 110 and 120 cooperate with each other so as to close the closing element D once opened, whereas the oil present in both hinges 110 and 120 hydraulically damps this closing action.

As particularly shown in the FIGS. 14*c* e 14*d*, the two check valves 63 are mounted one in one sense and the other one in the opposite sense.

In this way, the check valve 63 of the upper hinge 110 opens upon the opening of the closing element D, allowing the flow of the working fluid from the first compartment 36' to the second compartment 36", and closes upon the closing of the closing element D, forcing the working fluid to flow through the backflow circuit 80.

On the other side, the check valve 63 of the lower hinge 120 opens upon the closing of the closing element D, allowing the flow of the working fluid from the second compartment 36" to the first compartment 36', and closes upon the opening of the closing element D, forcing the working fluid to flow through the backflow circuit 80, which allows the flow of the working fluid from the first compartment 36' to the second compartment 36".

In this way the maximum control on the closing element D is obtained, the movement of which is controlled upon its opening as well as upon its closing.

In this embodiment, acting on the screws 70 and 71 it is possible to adjust the closing speed and the force of the latch action of the closing element D.

FIG. 15 shows a hydraulic hinge with automatic closing of the "anuba" type, which includes the counteracting elastic means 50 as well as the working fluid acting on the plunger element 60. In this hinge the backflow circuit 80 of the working fluid in the first compartment 36' is defined by the interspace 81. The backflow speed is predetermined, and there is no possibility to have the latch action of the closing element D.

The pivot 40 has a portion 41 which is elongated to internally house the spring 50.

It is understood that, in order to have the control of the speed in this embodiment, it is necessary to tightly insert the plunger element 60 in the operating chamber 30 and to replace the backflow circuit 80 by making it within the hinge body 31 and/or within the closing cap 83, as for example in the embodiment of FIG. 20.

Furthermore, if also the latch action of the closing element is desired, it is sufficient to mount on the plunger element 60 the cylindrical portion 64 and to manufacture a suitable outlet of the circuit 80 in the compartment 36".

As particularly shown in the FIGS. 18*a* to 19*c*, this embodiment has two flat portions 45', 45" extending for 180° around the axis X, in correspondence of which the closing element D is blocked.

FIG. 20 shows a hydraulic hinge with automatic closing of the "anuba" type, which includes the counteracting elastic means 50 as well as the working fluid acting on the plunger element 60.

The pivot 40 has an elongated portion 41 to internally include the spring 50.

For bulkiness reasons, in this hinge the backflow circuit 80 of the working fluid in the first compartment 36' is made within the hinge body 31 and the closing cap 83, within which the screw 71 for adjusting the closing speed of the closing element D is housed.

Moreover, if also the latch action of the closing element is desired, it is sufficient to mount on the plunger element 60 the cylindrical portion 64 and to manufacture a suitable outlet of the circuit 80 in the compartment 36".

As particularly shown in FIG. 20, this embodiment has flat portions 45', 45" extending for 90° around the axis X, in correspondence of which the closing element D is blocked.

In this embodiment, the plunger element 60 acts also as a slider 20, and is connected to the pivot 40 by means of a single pin 25≡27 which defines a single axis Z≡Z' substantially perpendicular to the single axis X≡Y.

FIG. 23 shows a hinge-hydraulic brake of the "anuba" type, which includes the working fluid acting on the plunger element 60 but not the counteracting elastic means 50. It is understood that this embodiment of the invention may includes a little spring, not shown in the enclosed figures, which helps the slider come back from one of the compressed and extended end position to the other of the compressed and extended end position.

Apart from this, this hinge is substantially similar to the hinge of FIG. 20, apart from the different orientation of the helical portions 44', 44", which is left-handed instead of right-handed, and from the fact that this embodiment does not include flat portions for the blocking of the closing element D.

It is also understood that it is possible to use a hinge having the counteracting elastic means 50 for hydraulically braking the closing element, during opening and/or during closing thereof according to the orientation of the valve means 63.

For example, FIGS. 14*a* to 14*d* show two hinges having the same orientation of the helical portions 44, 44' and valve means 63 acting in opposite senses.

Thanks to the counteracting elastic means 50, both hinges automatically close the closing element D once opened.

During opening of the closing element, in the upper hinge 110 the oil passes from the compartment 36' to the compartment 36" through the valve means 63, while in the lower hinge 120 the oil passes from the compartment 36' to the compartment 36" through the circuit 80.

During closing of the closing element, in the upper hinge 110 the oil flows back from the compartment 36" to the compartment 36' through the circuit 80, while in the lower hinge 120 the oil flows back from the compartment 36" to the compartment 36' through the valve means 63.

As a result, the upper hinge 110 acts as an hydraulic brake during closing of the closing element, while the lower hinge 120 acts as an hydraulic brake during opening thereof.

It is understood that the upper and lower hinges 110, 120 may be used also separate each other, as well as that each hinge can be used in cooperation with any other hinge and/or hydraulic brake.

FIGS. 26*a* to 27*d* schematically show an embodiment of an assembly 100 for the controlled automatic closing and opening of the closing element D. FIGS. 26*a* to 26*d* show the closed position of the closing element D, whereas FIGS. 27*a* to 27*d* show the open position thereof.

In this embodiment, the hinge 110 consists of the hinge-hydraulic brake shown in FIG. 23, whereas the hinge 120 is constituted by the hydraulic hinge shown in FIG. 20. The pivot 40 of the hinge 110 has right-handed helical portions 44', 44", whereas the pivot 40 of the hinge 120 has left-handed portions 44', 44".

Figures 27A, 27B, 27C, 27D, 27E, 27F:
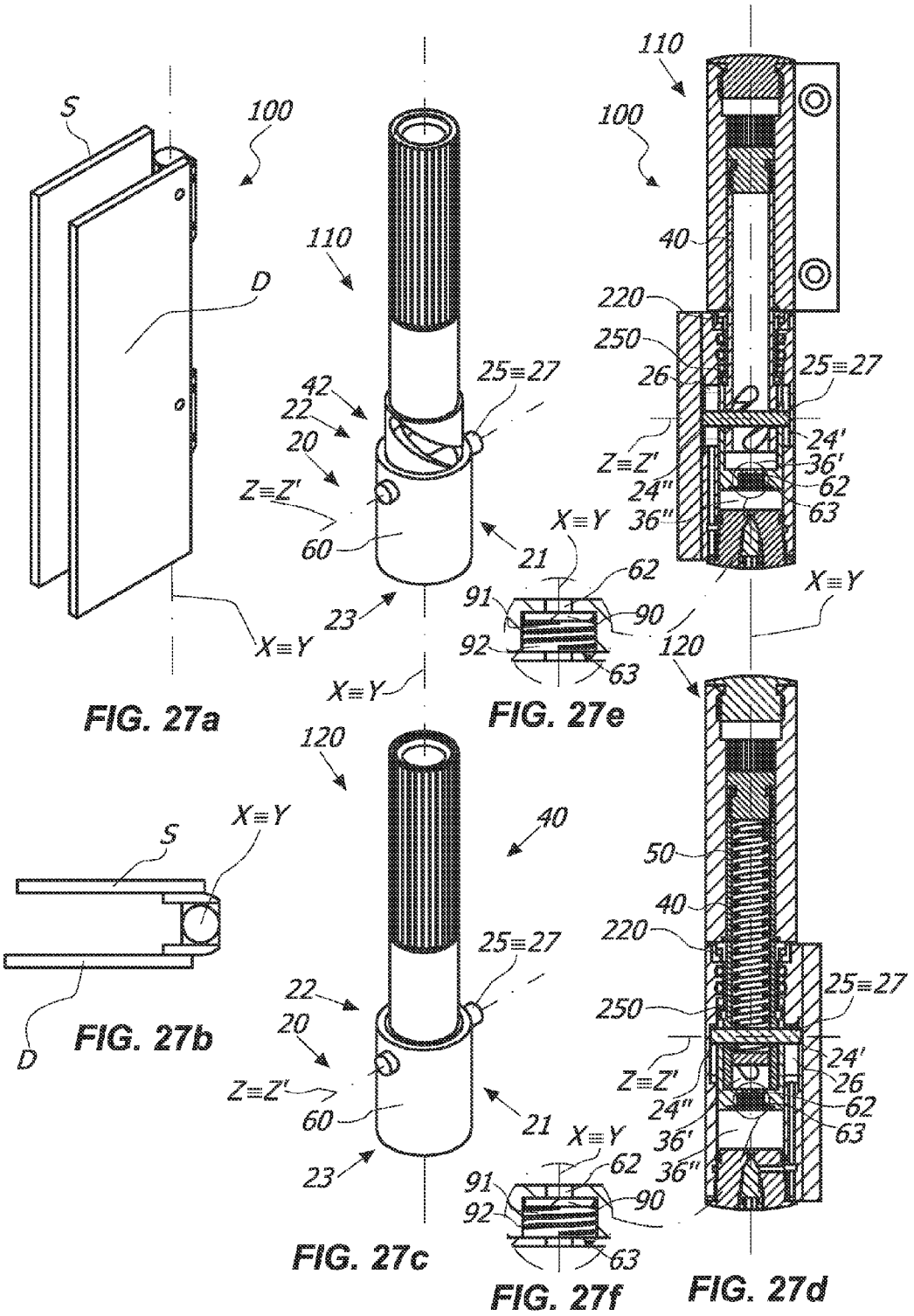
FIGS. 27*a*, 27*b*, 27*c* and 27*d* are respectively an axonometric view, a top view, a view of the slider and a sectioned view of another embodiment of an assembly 100 for the controlled automatic closing of a closing element D, in the open position thereof, wherein the hinge 110 is configured according to the embodiment shown in FIGS. 23 to 25*b* and the hinge 120 is configured according to the embodiment shown in FIGS. 20 to 22*c*, with in FIGS. 27*e* and 27*f* some enlarged particulars.

As particularly shown in FIGS. 27*e* and 27*f*, the two check valves 63 are mounted in the same sense.

In practice, in this assembly the spring 50 of the hinge 120 closes the closing element D once opened, whereas the oil in both hinges 110 and 120 hydraulically damps the closing element D upon its opening as well as upon its closing. In particular, the hinge-hydraulic brake 110 damps the closing element D upon its opening, whereas the hinge 120 damps the closing element D upon its closing.

Therefore, in this embodiment, by acting on the screws 71 of the hinges 110 and 120 it is possible to adjust the speed of the closing element D upon its opening as well as upon its closing.

For example, by closing to the utmost the screw 71 of the upper 110, it is possible to completely prevent the opening of the closing element.

Moreover, by adjusting the oil quantity present in the hinge 110 and acting on the screw 71, it is possible to adjust the point beyond which the damping action of the closing element D upon its opening begins. In this case, it is necessary to fill the chamber 30 with less oil than the actual capacity thereof.

In this way, it is possible for example to prevent the closing element D from impacting against a wall or a support, so preserving the integrity of the hinges.

Furthermore, by adjusting the oil quantity present in the hinge 110 and completely closing the screw 71, it is possible to hydraulically create a stopping point to the closing element D upon its opening.

FIG. 28 shows a hydraulic door closer with automatic closing, which includes the counteracting elastic means 50 as well as the working fluid acting on the plunger element 60. This embodiment is particularly suitable to be slide-away housed in the closing element D, with the only portion 41 of the pivot 40, which acts as fix element 11, outgoing from the closing element.

In this hinge the backflow circuit 80 of the working fluid in the first compartment 36' is made within the interspace 81 between the pivot 40 and the inner surface 82 of the operating chamber 30 in the interface element 85, within which the screw 71 for the adjusting of the closing speed of the closing element D is placed.

In this embodiment, the plunger element 60 acts as slider 20, and it is connected to the pivot 40 by means of a single pin 25≡27 which defines a single axis Z≡Z' substantially parallel to the single axis X≡Y.

The pivot 40 has an elongated cylindrical portion to internally house the spring 50 and the slider 20-plunger 60. The latter is tightly housed within the pivot 40.

Figure 32:
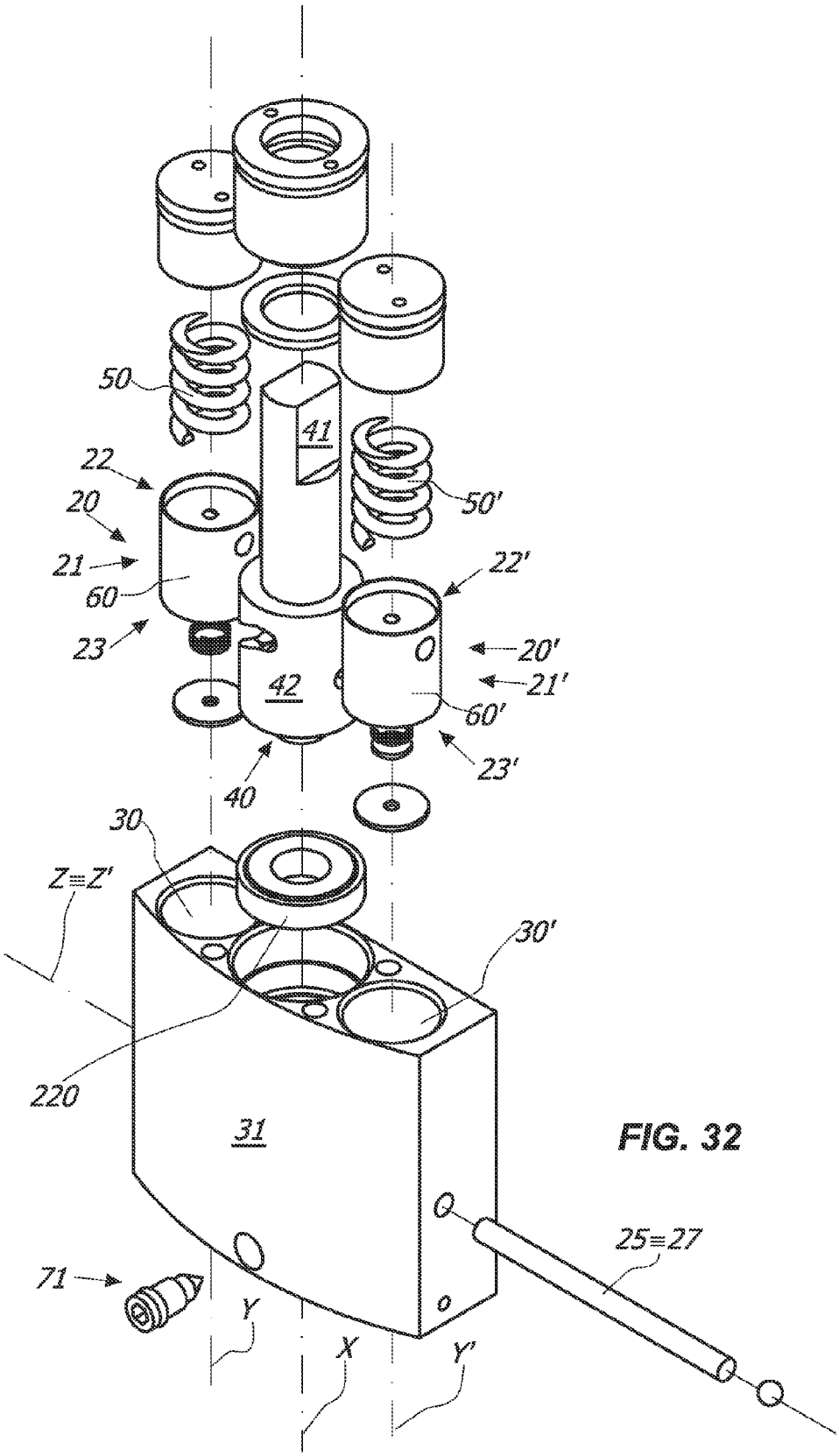
FIG. 32 is an exploded view of a further embodiment of the hinge device 1.
Figure 33A:
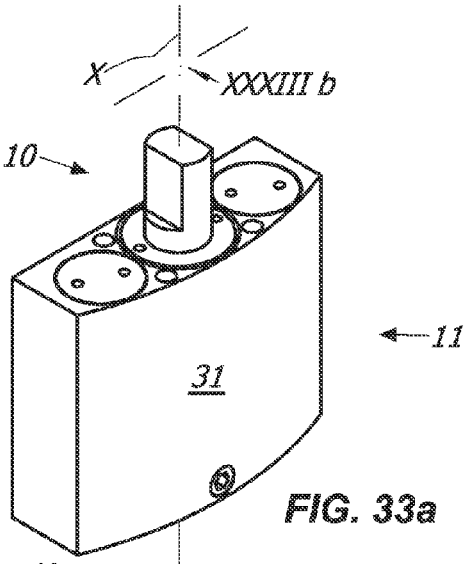
FIGS. 33*a*, 33*b* and 33*c* are respectively axonometric, sectioned along a plane XXXIIIb-XXXIIIb and sectioned along a plane XXXIIIc-XXXIIIc views of the embodiment of the hinge device 1 of FIG. 32, with the movable element 10 in the closed position.
Figure 33B:
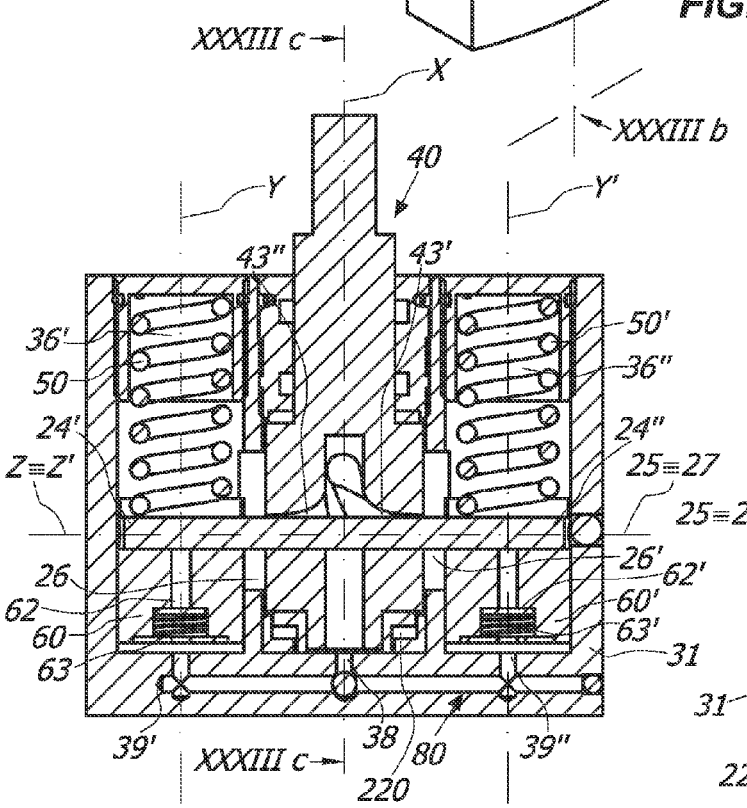
Figure 33C:
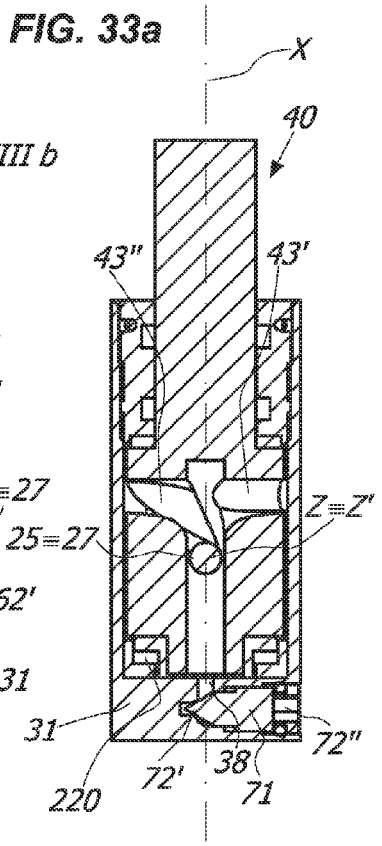
Figure 34A:
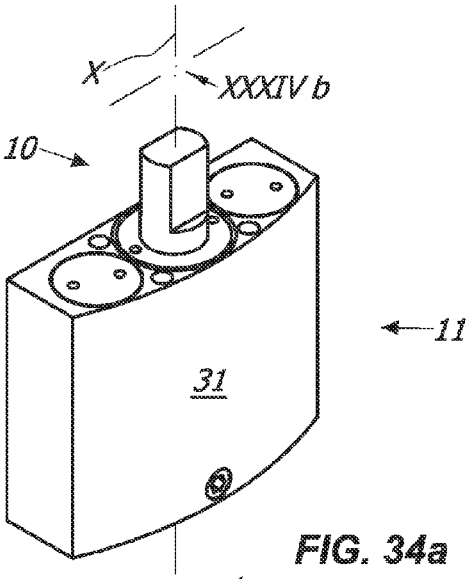
FIGS. 34*a*, 34*b* and 34*c* are respectively axonometric, sectioned along a plane XXXIVb-XXXIVb and sectioned along a plane XXXIVc-XXXIVc views of the embodiment of the hinge device 1 of FIG. 32, with the movable element 10 in the open position.
Figure 34B:
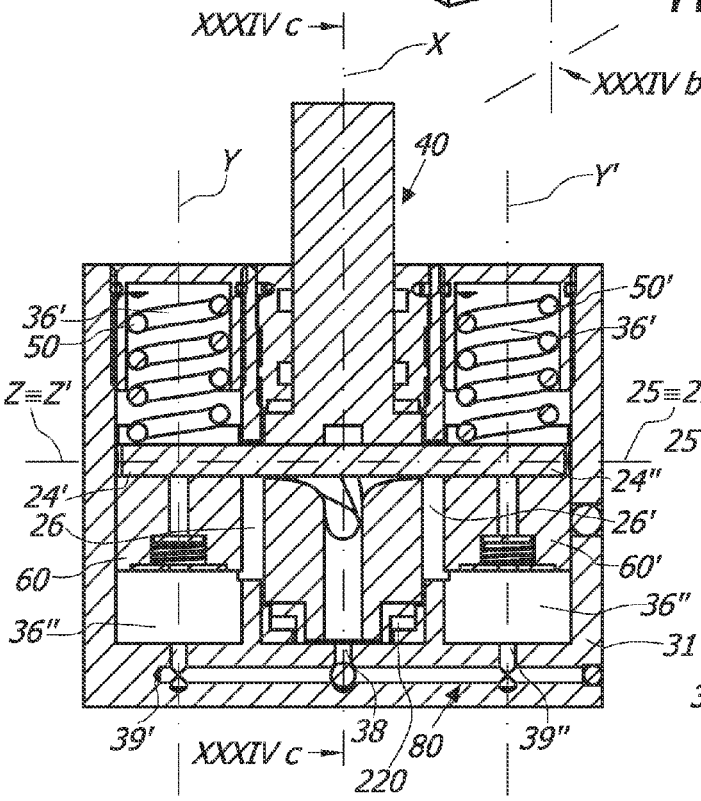
Figure 34C:
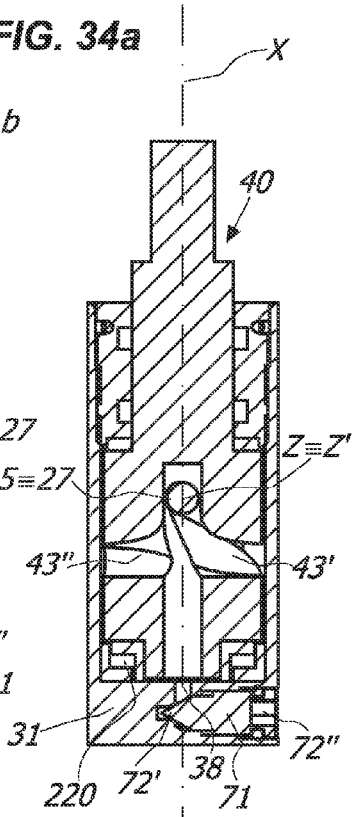

FIG. 32 shows a hydraulic door closer with automatic closing, which includes two sliders 20, 20'-plunger elements 60, 60' which slide along the respective axis Y, Y' in respective operating chambers 30, 30'. Respective springs 50, 50' may be provided.

The sliders 20, 20'-plunger elements 60, 60' may be operatively connected to the grooves of the single pivot 40, which may be interposed therebetween for defining the axis X, by means of the single pin 25E 27 inserted into the slots 26, 26'.

By acting on the screw 71 it is possible to adjust the closing speed of the closing element D.

As shown in FIG. 35*a*, this embodiment is particularly indicated to automatically close gates or like closing elements. FIG. 35*b* shows the load-bearing plate of the gate D, which has a thrust bearing 150 suitable to conduct the whole weight of the gate to the floor.

FIGS. 40*a* to 45*c* show another embodiment of the invention, having a pivot 40 with a single constant slope helical portion 44', 44" extending for 180° or more along the cylindrical portion 42.

Advantageously, these embodiments of the hinge device 1 may comprise an antirotation tubular bushing 300 having a couple of cam slots 310 extending along the first and/or second axis X, Y. The tubular bushing 300 may be coaxially coupled externally to the pivot 40 in such a manner that the first pin 25 operatively engages the cam slots 310.

In this manner, it is possible to have an optimal control of the closing element during opening and/or closing.

Apparently, all stresses of the rotation movement imparted by the pin 25 act on the pivot 40 and/or the tubular bushing 300.

Therefore, advantageously, the material in which the tubular bushing 300 and/or the pivot 40 are made may be different from the material in which the hinge body 31 is made.

For example, the tubular bushing 300 and/or the pivot 40 may be made of a metallic material, e.g. steel, while the hinge body 31 may be made of a polymeric material. In this manner, a very low-cost hinge device is provided.

These embodiments of the hinge device 1, as well as the embodiments shown in FIGS. 1 to 35*b*, may include one or more set screws 32', 32" located at respective ends of the hinge body 31. By operating on the set screws 32', 32" a user can regulate the stroke of the slider 20, thus adjusting the closing and opening angle of the closing element D.

Figures 40A, 40B, 40C:
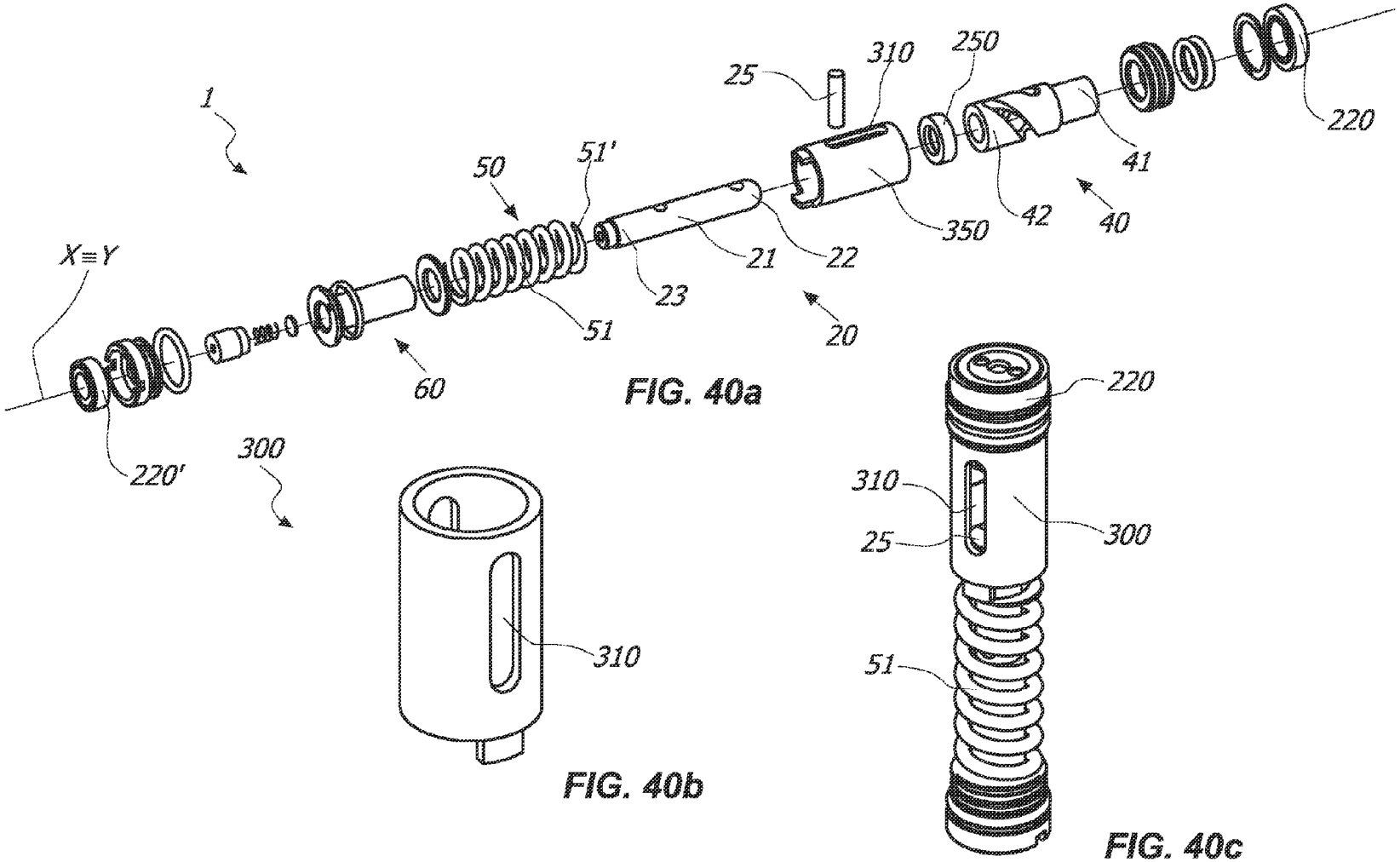
FIGS. 40*a* and 40*c* show respectively an exploded view and an assembled view of a further embodiment of the invention, including the anti-rotation tubular bushing 300 encompassing the pivot 40, the pin engaging both the single guide element 46 of the pivot 40 and the axial cam slots 310.
FIG. 40*b* is a perspective view of the tubular bushing 300.

FIGS. 40*a* to 40*c* show a first embodiment of a slider/pivot/tubular bushing/plunger assembly, in which the plunger 60 is mounted without the cylindrical portion 64. This embodiment of the invention, once inserted into the hinge body 31, does not allow imparting a latch action to the closing element D.

Figures 41A, 41B, 41C:
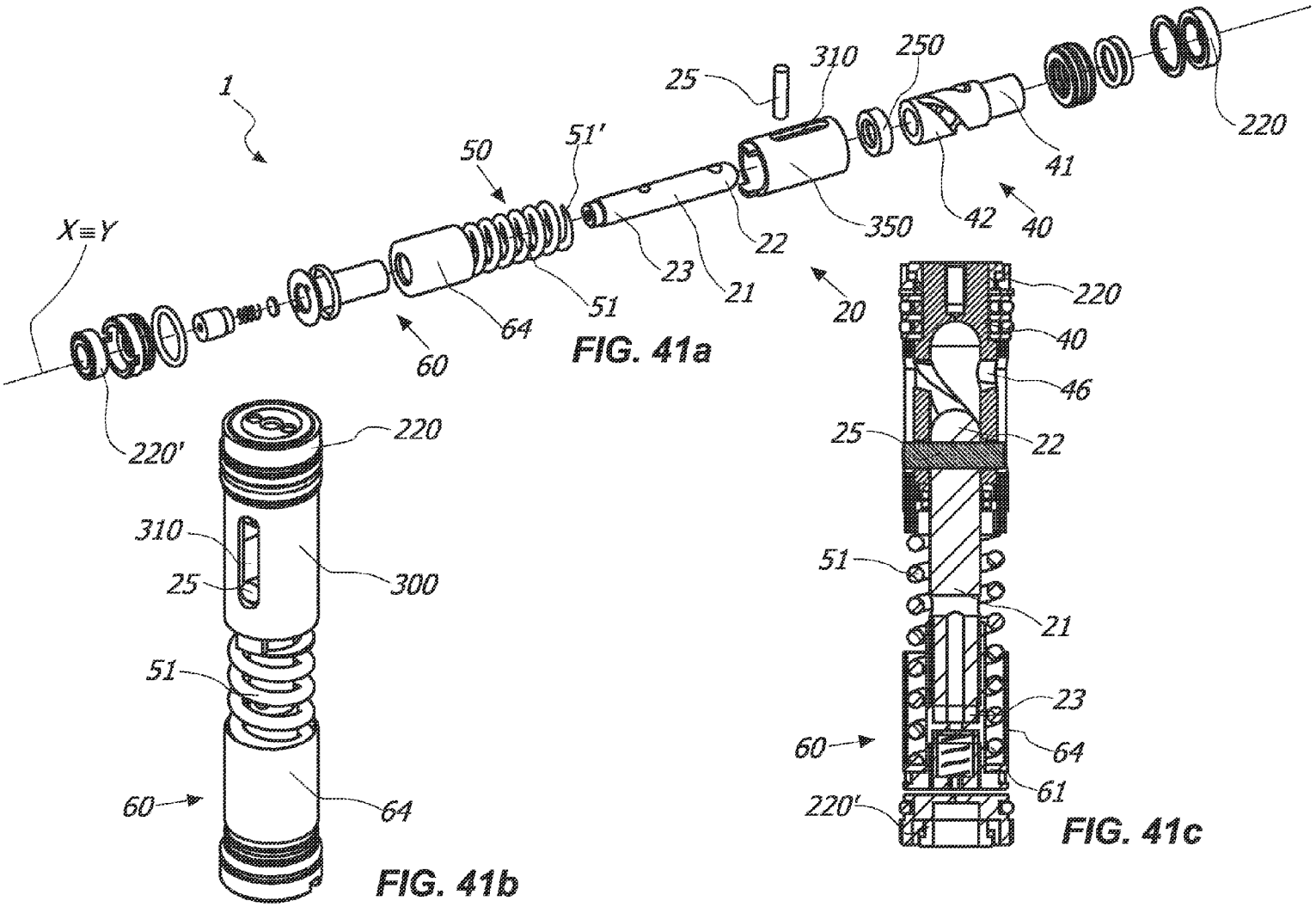
FIGS. 41*a* and 41*b* show respectively an exploded view and an assembled view of a further embodiment of the invention, including the anti-rotation tubular bushing 300 encompassing the pivot 40, the pin engaging both the single guide element 46 of the pivot 40 and the axial cam slots 310.
FIG. 41*c* is an axially sectioned view of the assembly of FIG. 41*b;*

By contrast, FIGS. 41*a* to 41*c* show a second embodiment of a slider/pivot/tubular bushing/plunger assembly, in which the plunger 60 is mounted with the cylindrical portion 64. This embodiment of the invention, once inserted into the hinge body 31, allows imparting a latch action to the closing element D.

FIGS. 42*a* and 42*b* show an embodiment of the invention including the assembly of FIGS. 41*a* to 41*c*, wherein the fixed element 11 includes the pivot 40 and the movable element 10 includes the hinge body 31. For example, the pivot 40 can be fixed to the floor by suitable fixing means, not shown in the figures since per se known.

FIGS. 43*a* to 45*c* show another embodiment of the invention including the assembly of FIGS. 41*a* to 41*c*, wherein the pivot 40 is movable unitary with the connecting plate 10 and the closing element D, while the hinge body 31 is to be fixed to the stationary support S.

Figure 45B:
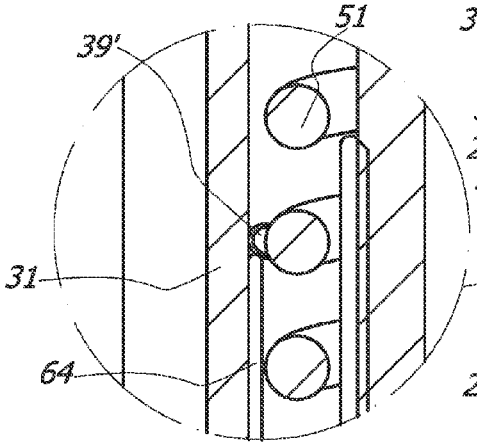
FIG. 45*b* shows an enlarged view of some enlarged particulars of FIG. 45*a*.
Figure 45A:
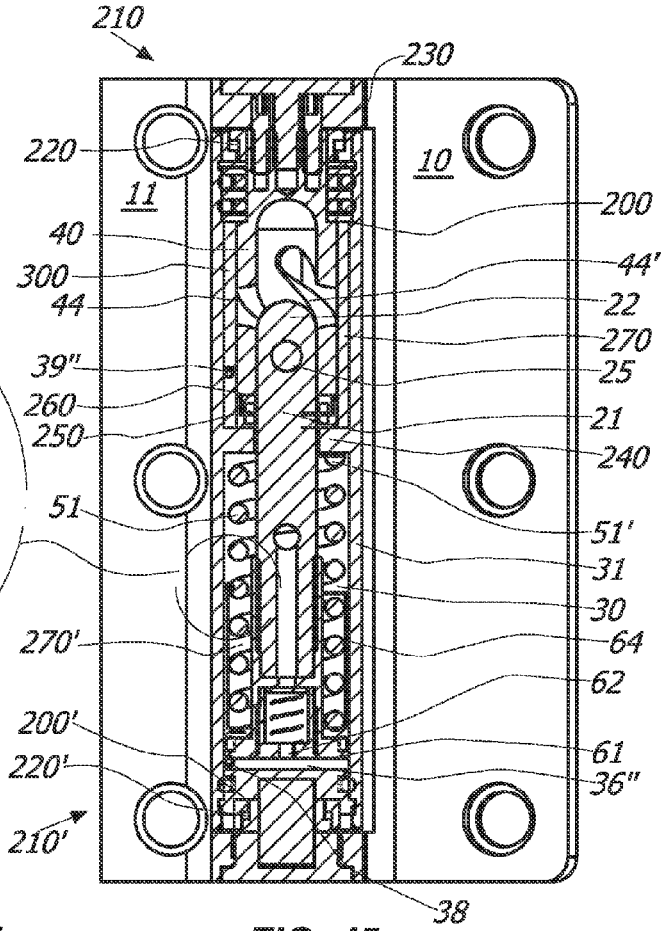
FIGS. 45*a* and 45*c* are respectively a sectioned view along a plane XLV a-XLV a and a top one of the embodiment of the hinge device according to FIG. 43*a*, in which the closing element D is in the latching position.
Figure 45C:
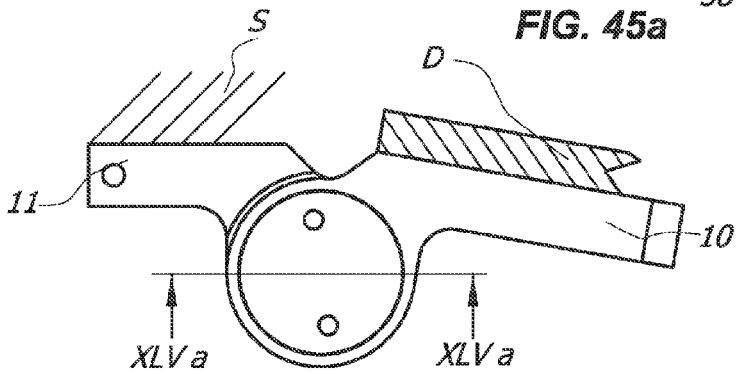

In particular, FIG. 45*b* is an enlarged view of the hinge device shown in FIGS. 45*a* and 45*c*, in which the cylindrical rear portion 64 is fluidly uncoupled from the outlet 39" so as to impart a latch action to the closing element D toward the closed position.

The above disclosure clearly shows that the invention fulfils the intended objects.

The invention is susceptible to many changes and variants, all falling within the inventive concept expressed in the annexed claims. All particulars may be replaced by other technically equivalent elements, and the materials may be different according to the needs, without departing the scope of the invention as defined by the annexed claims.

The invention claimed is:

1. A hinge for automatically closing a closing element which is anchored to a stationary support structure, the hinge comprising:

a fixed element configured to be fixed to the stationary support structure;

a movable element fixable to the closing element, the movable element and the fixed element being mutually coupled so that the closing element rotates around a longitudinal axis between an open position and a closed position, one of the movable element or the fixed element comprising a box-shaped hinge body including a working chamber defining the longitudinal axis, the other one of the movable element and the fixed element including a pivot coaxial to the longitudinal axis;

a slider slidably movable within the working chamber between a retracted end position and an extended end position, the pivot and the slider being telescopically coupled to each other such that a rotation of the movable element around the longitudinal axis corresponds to a sliding of the slider along the longitudinal axis and vice versa; and a counteracting elastic member acting on the slider for automatically returning the slider from the retracted end position toward the extended end position, the counteracting elastic member being configured to slidably move along the longitudinal axis between a maximum elongation position, corresponding to the extended end position of the slider, and a minimum elongation position, corresponding to the retracted end position of the slider, wherein the pivot includes a cylindrical portion having a plurality of substantially equal grooves angularly spaced 180° each including a helical portion wound around the longitudinal axis, the grooves being communicating with each other to define a single guide element passing through the cylindrical portion, wherein the slider includes an elongated body with a first end which comprises a pin transversely inserted through the single guide element to slide therein, such to allow a mutual engagement of the cylindrical portion and the elongated body, the elongated body of the slider including a second end slidably moving between a position proximal to the cylindrical portion of the pivot, corresponding to the retracted position of the slider, and a position distal from the cylindrical portion of the pivot, corresponding to the extended position of the slider, the counteracting elastic member being interposed between the cylindrical portion of the pivot and the second end of the slider so that the cylindrical portion is in a position of minimum elongation when the second end is in the retracted end position and in a position of maximum elongation when the slider is in the extended end position, such to promote an automatic closing of the closing element from the open position, and wherein the box-shaped hinge body includes a support portion to be loaded by the pivot, the support portion being configured to separate the box-shaped hinge body into a first area and a second area, the pivot being housed into the first area, the counteracting elastic member being housed in the second area.

2. The hinge according to claim 1, wherein the counteracting elastic member interacts with the support portion so as to be interposed between the support portion and the second end of the slider.

3. The hinge according to claim 2, wherein the counteracting elastic member includes an end abutting against the support portion.

4. The hinge according to claim 1, wherein the pin has a portion sliding into a respective groove, the portion of the pin having an outer diameter substantially equal to a width of the respective groove.

5. The hinge according to claim 1, wherein the single guide element is closed at both ends, thereby defining a closed path having two blocking end points for the pin to slide therethrough, the closed path being defined by the grooves.

6. The hinge according to claim 1, wherein the helical portion extends for at least 180° along the cylindrical portion, the slider further comprising a tubular bushing having a couple of cam slots coaxially coupled externally to the pivot such that the pin operatively engages the cam slots.

7. The hinge according to claim 1, wherein the movable element includes the pivot, the fixed element including the working chamber.

8. The hinge according to claim 1, wherein the slider includes a plunger element movable into the working chamber along the longitudinal axis, the working chamber including a working fluid acting on the plunger element to hydraulically counteract an action thereof, the plunger element being configured to separate the working chamber into a first and a second variable volume compartments fluidically communicating with each other, the first and the second variable volume compartments being configured to have at the closed position of the closing element respectively maximum and minimum volume.

9. The hinge according to claim 8, wherein a pushing head of the plunger element includes a valve member to allow a passage of the working fluid between the first compartment and the second compartment during one of the opening and closing of the closing element and to prevent a backflow of the working fluid during the other one of the opening and the closing of the closing element, a hydraulic circuit being provided for a controlled backflow of the working fluid between the first compartment and the second compartment during the other one of the opening and the closing of the closing element.

10. The hinge according to claim 9, wherein the hinge body includes at least partially the hydraulic circuit, the hydraulic circuit including a first opening for the working fluid which is in the first compartment and a second opening for the working fluid which is in the second compartment, the plunger element being in a spaced relationship with the working chamber and the first and the second opening such to remain fluidly uncoupled from the first opening during an entire stroke of the plunger element, the box-shaped hinge body having a first adjustment member having a first end interacting with the first opening and a second end operable by a user from outside to adjust flow speed of the working fluid flowing through the hydraulic circuit.

11. The hinge according to claim 10, wherein the hydraulic circuit has a third opening in the first compartment, the plunger element being in a spaced relationship with the third opening such to remain fluidly coupled with the third opening for a part of the stroke of the plunger element and to be fluidly uncoupled therefrom for a remaining part of the stroke, thereby imparting a latch action to the closing element toward the closed position when the movable element is in proximity of the fixed element, the box-shaped hinge body including a second adjustment member having a first end interacting with the third opening and a second end operable by the user from the outside to adjust a force by which the closing element latches toward the closed position.

12. The hinge according to claim 11, wherein the first and the third openings of the hydraulic circuit are fluidically connected to one another in parallel.

13. The hinge according to claim 9, wherein the valve member is adapted to allow a passage of the working fluid from the first compartment to the second compartment during the opening of the closing element and to prevent the backflow thereof during a closure of the closing element.

14. A hinge for automatically closing a closing element which is anchored to a stationary support structure, the hinge comprising:

a fixed element configured to be fixed to the stationary support structure;

a movable element fixable to the closing element, the movable element and the fixed element being mutually coupled so that the closing element rotates around a longitudinal axis between an open position and a closed position, one of the movable element and the fixed element comprising a box-shaped hinge body including a working chamber defining the longitudinal axis, the other one of the movable element and the fixed element including a pivot coaxial to the longitudinal axis;

a slider slidably movable within the working chamber between a retracted end position and an extended end position, the pivot and the slider being telescopically coupled to each other such that a rotation of the movable element around the longitudinal axis corresponds to the sliding of the slider along the longitudinal axis and vice versa; and a counteracting elastic member acting on the slider for the automatically returning thereof from the retracted end position toward the extended end position, the counteracting elastic member being configured to slidably move along the longitudinal axis between a maximum elongation position, corresponding to the extended end position of the slider, and a minimum elongation position, corresponding to the retracted end position of the slider, wherein the pivot includes a cylindrical portion having a plurality of substantially equal grooves angularly spaced of 180° each including a helical portion wound around the longitudinal axis, the grooves being communicating with each other to define a single guide element passing through the cylindrical portion, wherein the slider includes an elongated body with a first end which comprises a pin transversely inserted through the single guide element to slide therein, such to allow a mutual engagement of the cylindrical portion and elongated body, the elongated body of the slider including a second end slidably moving between a position proximal to the cylindrical portion of the pivot, corresponding to the retracted position of the slider, and a position distal from the cylindrical portion of the pivot, corresponding to the extended position of the slider, the counteracting elastic member being interposed between the cylindrical portion of the pivot and the second end of the slider so that the cylindrical portion is in a position of minimum elongation when the second end is in the retracted end position and in a position of maximum elongation when the slider is in the extended end position, such to promote the automatic closing of the closing element from the open position, wherein the box-shaped hinge body includes a support portion to be loaded by the pivot, the support portion being adapted to separate the box-shaped hinge body into a first area and a second area, the pivot being housed into the first area, the counteracting elastic member being housed in the second area, and wherein the box-shaped hinge body further includes an antifriction element interposed between the support portion and the pivot to facilitate a mutual rotation thereof.

15. The hinge according to claim 14, wherein the antifriction element and the pivot are configured and/or are in a mutual spaced relationship so that the pivot is spaced apart from the support portion.

16. The hinge according to claim 15, wherein the pivot has a loading surface susceptible to came into contact with the antifriction element so that the loading surface rotates thereon.

17. The hinge according to claim 16, wherein the loading surface of the pivot is in mutual contact with a first surface of the antifriction element, the antifriction element having a second surface opposed to the first surface which is in contact with the support portion.

18. A hinge for automatically closing a closing element which is anchored to a stationary support structure, the hinge comprising:

a fixed element configured to be fixed to the stationary support structure;

a movable element fixable to the closing element, the movable element and the fixed element being mutually coupled so that the closing element rotates around a longitudinal axis between an open position and a closed position, one of the movable element and the fixed element comprising a box-shaped hinge body including a working chamber defining the longitudinal axis, the other one of the movable element and the fixed element including a pivot coaxial to the longitudinal axis;

a slider slidably movable within the working chamber between a retracted end position and an extended end position, the pivot and the slider being telescopically coupled to each other such that a rotation of the movable element around the longitudinal axis corresponds to the sliding of the slider along the longitudinal axis and vice-versa; and a counteracting elastic member acting on the slider for the automatically returning thereof from the retracted end position toward the extended end position, the counteracting elastic member being configured to slidably move along the longitudinal axis between a maximum elongation position, corresponding to the extended end position of the slider, and a minimum elongation position, corresponding to the retracted end position of the slider, wherein the pivot includes a cylindrical portion having a plurality of substantially equal grooves angularly spaced of 180° each including a helical portion wound around the longitudinal axis, the grooves being communicating with each other to define a single guide element passing through the cylindrical portion, wherein the slider includes an elongated body with a first end which comprises a pin transversely inserted through the single guide element to slide therein, such to allow a mutual engagement of the cylindrical portion and elongated body, the elongated body of the slider including a second end slidably moving between a position proximal to the cylindrical portion of the pivot, corresponding to the retracted position of the slider, and a position distal from the cylindrical portion of the pivot, corresponding to the extended position of the slider, the counteracting elastic member being interposed between the cylindrical portion of the pivot and the second end of the slider so that the cylindrical portion is in a position of minimum elongation when the second end is in the retracted end position and in a position of maximum elongation when the slider is in the extended end position, such to promote the automatic closing of the closing element from the open position, wherein the movable element includes a fixing leaf for the fixing with the closing element, the box-shaped hinge body including a first support portion susceptible to be loaded by the closing element through the fixing leaf and a second support portion to be loaded by the pivot, the first support portion being positioned in correspondence of an end of the box-shaped hinge body to be loaded by a loading surface of the fixing leaf, wherein the box-shaped hinge body further including a first antifriction element interposed between first support portion and the loading surface of the fixing leaf and a second antifriction element interposed between the a second support portion and the pivot to facilitate a mutual rotation thereof, the pivot being interposed between the first and the second antifriction elements, and wherein the second support portion being adapted to separate the box-shaped hinge body into a first area and a second area, the pivot being housed into the first area, the counteracting elastic member being housed in the second area.

19. The hinge according to claim 18, wherein the first antifriction element and the first support portion are configured and/or are in a mutual spaced relationship so that the loading surface of the fixing leaf is spaced apart from the box-shaped hinge body and from the pivot, the second antifriction element and the pivot being configured and/or in a mutual spaced relationship so that the pivot is spaced apart from the second support portion.

20. The hinge according to claim 19, wherein the loading surface of the fixing leaf is susceptible to came into contact with the first antifriction element so as to rotate thereon, the pivot having a loading surface susceptible to came into contact with the second antifriction element so as to rotate thereon.

* * * * *